US005459022A

United States Patent [19]

Ishii et al.

[11] Patent Number: 5,459,022

[45] Date of Patent: Oct. 17, 1995

[54] SILVER HALIDE COLOR PHOTOGRAPHIC MATERIAL CONTAINING A YELLOW-COLORED CYAN COUPLER AND A COMPOUND CAPABLE OF RELEASING A BLEACHING ACCELERATOR OR A PRECURSOR THEREOF, AND A METHOD FOR PROCESSING THE SAME

[75] Inventors: Yoshio Ishii; Yoshihiro Fujita; Keiji Mihayashi, all of Kanagawa, Japan

[73] Assignee: Fuji Photo Film Co., Ltd., Kanagawa, Japan

[21] Appl. No.: 150,791

[22] Filed: Nov. 12, 1993

Related U.S. Application Data

[63] Continuation of Ser. No. 696,905, May 7, 1991, abandoned.

[30] Foreign Application Priority Data

| | | | |
|---|---|---|---|
| May 8, 1990 | [JP] | Japan | 2-118040 |
| Jan. 31, 1991 | [JP] | Japan | 3-029261 |

[51] Int. Cl.[6] ..... G03C 7/333; G03C 7/305

[52] U.S. Cl. ..... 430/549; 430/226; 430/359; 430/543; 430/553; 430/563

[58] Field of Search ..... 430/359, 549, 430/553, 562, 226, 543, 955, 563

[56] References Cited

U.S. PATENT DOCUMENTS

| | | | |
|---|---|---|---|
| H830 | 10/1990 | Deguchi et al. | 430/955 |
| 4,072,525 | 2/1978 | Inouye et al. | 430/387 |
| 4,146,396 | 3/1979 | Yokota et al. | 430/387 |
| 4,439,513 | 3/1984 | Sato et al. | 430/203 |
| 4,647,527 | 3/1987 | Ikenoue et al. | 430/504 |
| 4,833,069 | 5/1989 | Hamada et al. | 430/552 |
| 4,842,994 | 6/1989 | Sakanoue et al. | 430/553 |
| 4,865,959 | 9/1989 | Sakanoue et al. | 430/553 |
| 5,064,753 | 11/1991 | Sohei et al. | 430/567 |
| 5,075,207 | 12/1991 | Langen et al. | 430/552 |
| 5,112,730 | 5/1992 | Ohkawa et al. | 430/226 |
| 5,178,993 | 1/1993 | Fujita et al. | 430/359 |
| 5,266,456 | 11/1993 | Mihayashi et al. | 430/359 |

FOREIGN PATENT DOCUMENTS

| | | | |
|---|---|---|---|
| 0310125 | 4/1989 | European Pat. Off. . | |
| 3815469 | 11/1989 | Germany . | |
| 1221748 | 10/1986 | Japan . | |
| 3121843 | 5/1988 | Japan | 430/553 |
| 3121844 | 5/1988 | Japan | 430/553 |
| 63-304242 | 12/1988 | Japan . | |
| 1209447 | 8/1989 | Japan | 430/543 |

*Primary Examiner*—Lee C. Wright

*Attorney, Agent, or Firm*—Sughrue, Mion, Zinn, Macpeak & Seas

[57] ABSTRACT

A silver halide color photographic material comprises a support having thereon at least one silver halide emulsion layer, a yellow-colored cyan coupler, and a compound capable of releasing a bleaching accelerator or a precursor thereof on reaction with an oxidation product of an aromatic primary amine developing agent.

9 Claims, No Drawings

SILVER HALIDE COLOR PHOTOGRAPHIC MATERIAL CONTAINING A YELLOW-COLORED CYAN COUPLER AND A COMPOUND CAPABLE OF RELEASING A BLEACHING ACCELERATOR OR A PRECURSOR THEREOF, AND A METHOD FOR PROCESSING THE SAME

This is a Continuation of application Ser. No. 07/696,905 filed May 7, 1991.

FIELD OF THE INVENTION

This invention relates to a silver halide color photographic material and a method for processing the same. More particularly, it relates to a silver halide color photographic material having improved color reproducibility and to a method of rapidly processing such a photographic material.

BACKGROUND OF THE INVENTION

One of the properties required for silver halide color photographic materials (hereinafter simply referred- to as "light-sensitive material" as necessary) is color reproductivity.

One approach for improving color reproducibility is to use colored couplers in, e.g., color negative light-sensitive materials for picture taking, to correct for undesired absorption of colored dye images. These colored couplers are disclosed in many publications and patents, for instance *Research Disclosure* No. 17643, VII-G.

Colored couplers used for the correction of undesired absorption of cyan images include those which exhibit a maximum absorption wavelength between about 500 nm and 600 nm in the visible light range and undergo a coupling reaction with an oxidation product of an aromatic primary amine developing agent to form a cyan dye image which exhibits a maximum absorption wavelength between about 630 nm and 750 nm.

However, a cyan dye image also has an absorption in the visible light range of 400 to 500 nm. If these undesired absorptions are also corrected for by the so-called yellow-colored cyan couplers, an effect which photographically approximates the interimage effect developed from a cyan colored image layer and a yellow colored image layer can be obtained, probably providing an advantage in color reproduction. This possibility is described in JP-A-61-221748 and JP-A-319774 (the term "JP-A" as used herein means an "unexamined published Japanese patent application").

On the other hand, it has been keenly demanded in the art to speed up photographic processing, i.e., to reduce the requisite time of processing. In particular, reduction in desilvering time, which accounts for almost half of the total processing time, has been an important subject of study.

Known means for speeding up desilvering include the use of a bleach-fix monobath containing an aminopolycarboxylic acid iron (II) complex salt and a thiosulfate, as disclosed in German Patent 866,605. However, since the aminopolycarboxylic acid iron (II) complex salt, which essentially has weak oxidizing power (bleaching power), is combined with a thiosulfate having reducing power, such bleach-fix baths have considerably reduced bleaching power and are of no practical use, particularly for high sensitivity and high silver content color light-sensitive materials for photographing. The bleach-fix monobaths have great difficulty in achieving sufficient desilvering.

In order to improve bleaching power, it has been proposed to add various bleaching accelerators to the bleach bath, the bleach-fix bath or a respective prebath thereof. Bleaching accelerators so far proposed include various mercapto compounds described, e.g., in U.S. Pat. No. 3,893,858, British Patent 1,138,842, and JP-A-53-141623; compounds having a disulfide linkage as described in JP-A-53-95630; thiazolidine derivatives as described in JP-B-53-9854 (the term "JP-B" as used herein means an "examined published Japanese patent application"); isothiourea derivatives as described in JP-A-53-94927; thiourea derivatives as described in JP-B- 45-8506 and JP-B-49-26586; thioamide compounds as described in JP-A-49-42349; dithiocarbamic acid salts as described in JP-A-55-26506; and arylenediamine compounds as described in U.S. Pat. No. 4,552,834.

Although some of these known bleaching accelerators exhibit bleaching accelerating effects, they still involve problems which render them unsatisfactory for practical use. For example, some are expensive; some have poor stability in the bath having bleaching ability; and some have insufficient bleaching accelerating effects.

Further, where a bleaching accelerator having a mercapto group is added to any of the bleaching bath, the bleach-fix bath, or a respective prebath thereof, cases often arise in which the mercapto compound reacts with undeveloped silver halide in an emulsion layer or with silver halide formed by the bleaching reaction, resulting in the formation of a sparingly insoluble silver salt, which is not solubilized by the fixing agent and causes insufficient fixing.

In addition, where continuous processing is performed with replenishment using a processing bath having bleach-fixing ability, silver ions accumulate in the bleach-fix bath. The accumulated silver ions form a sparingly soluble silver salt with the above-described mercapto compound, which cannot be solubilized by a fixing agent, especially when the rate of replenishment is reduced, thus worsening the state of fixing.

Hence, use of a bleaching accelerator in the bleach bath, the bleach-fix bath or a respective prebath thereof is subject to various restrictions.

It is also known to incorporate the above-mentioned mercapto-containing bleaching accelerator or a precursor thereof into the light-sensitive material. However, this technique also involves problems. For example, the mercapto compound present in the light-sensitive material not only has considerable influence on photographic properties, but it also forms a sparingly soluble salt with the silver halide in the undeveloped area of the light-sensitive material.

On the other hand, disclosures of couplers capable of releasing a bleaching accelerator are found in *Research Disclosure*, Item 24241, ibid., Item 11449, and JP-A-61-201247.

Although these bleaching accelerator-releasing couplers bring about some improvement in the abovementioned problems, they are still unsatisfactory in bleaching or desilvering effect, particularly in rapid processing in which the processing time of desilvering after color development is reduced, giving rise to a problem of unsatisfactory color reproduction. Moreover, when processing is carried out rapidly and continuously at a low rate of replenishment, the desilvering properties are deteriorated, making these couplers impractical.

SUMMARY OF THE INVENTION

An object of the present invention is to provide a light-sensitive material having excellent color reproducibility by (i) correcting the undesired absorption of the cyan dye image in the visible region of from 400 to 500 nm with the use of a yellow-colored cyan coupler and (ii) improving the desilvering properties.

Another object of the present invention is to provide a light-sensitive material which is stable under continuous processing conditions and has satisfactory preservability.

A further object of the present invention is to provide a light-sensitive material which provides a stable dye image.

A still further object of the present invention is to provide a light-sensitive material which has improved desilvering properties such that the material may be rapidly processed in a reduced processing time.

The above objects of the present invention are accomplished by a silver halide color photographic material comprising a support having thereon at least one silver halide emulsion layer, a yellow-colored-cyan coupler, and a compound capable of releasing a bleaching accelerator or a precursor thereof on reaction with an oxidation product of an aromatic primary amine developing agent.

DETAILED DESCRIPTION OF THE INVENTION

The yellow-colored cyan coupler to be used in the present invention will be further described hereinafter.

The yellow colored cyan coupler of the present invention is a cyan coupler which exhibits a maximum absorption wavelength between 400 nm and 500 nm in the visible absorption range and undergoes coupling with an oxidation product of an aromatic primary amine developing agent to form a cyan dye having a maximum absorption wavelength between 630 nm and 750 nm in the visible absorption range.

Examples of such yellow-colored cyan couplers include couplers disclosed in JP-A-61-221748 and JP-A-1-319744.

In addition to these yellow-colored cyan couplers, a cyan coupler capable of undergoing reaction with an oxidation product of an aromatic primary amine developing agent to release a group containing a water-soluble 6-hydroxy-2-pyridone-5-ylazo group, a water-soluble pyrazolone-4-ylazo group, a water-soluble 5-aminopyrazole- 4-ylazo group, a water-soluble 2-acylaminophenylazo group, or a water-soluble 2-sulfonamidephenylazo group may be preferably used in view of color reproducibility.

The yellow-colored cyan couplers of the present invention may be preferably represented by one of general formulae (CI) to (CIV):

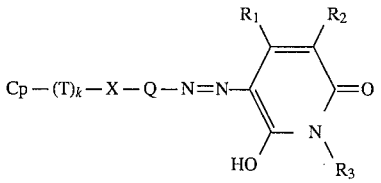

(CI)

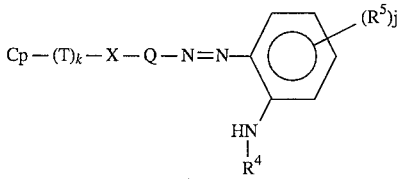

(CII)

-continued

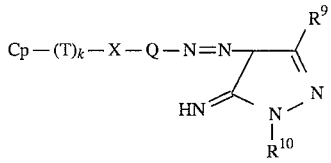

(CIII)

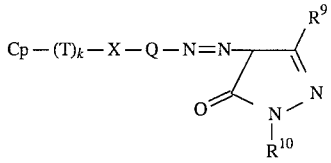

(CIV)

In the general formulae (CI) to (CIV), Cp represents a cyan coupler group (T is connected to the coupling position thereof), T represents a timing group, k represents an integer 0 or 1, X represents a divalent connecting group containing N, O or S by which $(T)_k$ and Q are connected to each other, and Q represents an arylene group or a divalent heterocyclic group.

In the general formula (CI), $R_1$ and $R_2$ each independently represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group or an alkylsulfonyl group, and $R_3$ represents a hydrogen atom, an alkyl group, a cycloalkyl group, an aryl group or a heterocyclic group, with the proviso that at least one of T, X, Q, $R_1$, $R_2$ and $R_3$ of formula (CI) contains a water-soluble group (e.g., hydroxyl, carboxyl, sulfo, amino, ammoniumyl, phosphono, phosphino, hydroxysulfonyloxy).

It will be recognized by one skilled in the art that

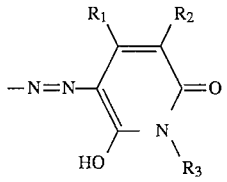

in the general formula (CI) can take any of the following tautomeric structures:

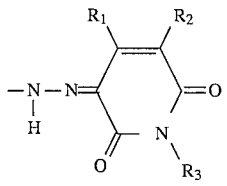

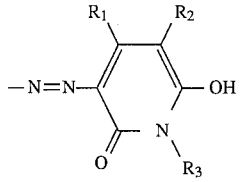

-continued

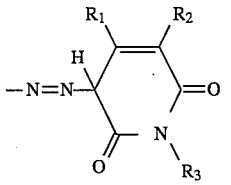

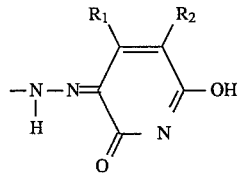

(when $R_3$ is a hydrogen atom)

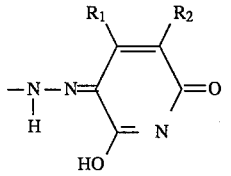

(when $R_3$ is a hydrogen atom)

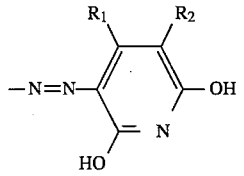

(when $R_3$ is a hydrogen atom)

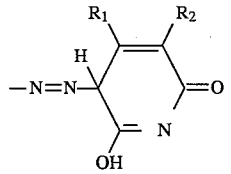

(when $R_3$ is a hydrogen atom)

These tautomeric structures are within the scope of general formula (CI) of the present invention.

In the general formula (CII), $R^4$ represents an acyl group or sulfonyl group, $R^5$ represents a substitutable group, and j represents an integer from 0 to 4. When j is an integer from 2 to 4, the plurality of $R^5$ groups may be the same or different, with the proviso that at least one of T, X, Q, $R_4$, and $R_5$ contains a water-soluble group (e.g., hydroxyl, carboxyl, sulfo, phosphono, phosphino, hydroxysulfonyloxy, amino, ammoniumyl).

In the general formulae (CIII) and (CIV), $R^9$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamide group, a sulfonamide group or an alkylsulfonyl group, and $R^{10}$ represents a hydrogen atom, an alkyl group, a cycloalkyl group, an aryl group or a heterocyclic group, with the proviso that at least one of T, X, Q, $R^9$, and $R^{10}$contains a water-soluble group (e.g., hydroxyl, carboxyl, sulfo, phosphono, phosphino, hydroxysulfonyloxy, amino, ammoniumyl).

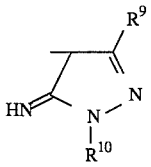

and

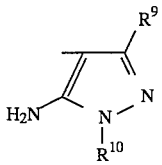

are in tautomeric relationship with each other and thus are the same compound.

The compounds represented by the general formulae (CI) to (CIV) will be further described hereinafter.

Examples of the coupler group represented by Cp include known cyan coupler groups (e.g., phenolic, naphthoic, diphenylimidazolic, hydroxypyridinic, long wavelength-absorbing pyrazolotriazolic cyan coupler groups).

Preferred examples of Cp include coupler groups represented by the following general formulae (Cp-6), (Cp-7) and (Cp-8):

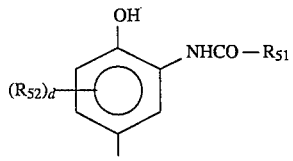

(Cp-6)

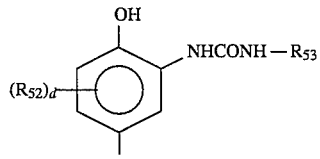

(Cp-7)

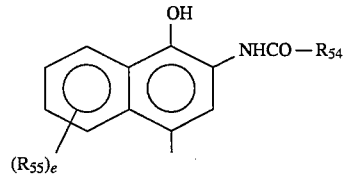

(Cp-8)

In these general formulae, the free bond extending from the coupling position indicates the position at which a coupling-separable moiety is connected to Cp.

In these general formulae, if $R_{51}$, $R_{52}$, $R_{53}$, $R_{54}$ or $R_{55}$ contains a nondiffusing group, then $R_{51}$, $R_{52}$, $R_{53}$, $R_{54}$ or $R_{55}$ is selected so that the total number of carbon atoms contained in $R_{51}$, $R_{52}$, $R_{53}$, $R_{54}$, or $R_{55}$ is from 8 to 40, preferably 10 to 30. When $R_{51}$, $R_{52}$, $R_{53}$, $R_{54}$, and $R_{55}$ do not contain a non-diffusing group, the total number of carbon atoms contained therein is preferably 15 or less. In the case of bis type, telomer type or polymer type couplers, any of the above mentioned substituents represents a divalent group which connects repeating units. In this case, the total number of carbon atoms contained in these substituents may exceed the above specified ranges.

Hereinafter, $R_{41}$ represents an aliphatic, aromatic or heterocyclic group, $R_{42}$ represents an aromatic or heterocyclic group, and $R_{43}$, $R_{44}$ and $R_{45}$ each represents a hydrogen atom, an aliphatic group, aromatic group or a heterocyclic group.

$R_{51}$, $R_{52}$, $R_{53}$, $R_{54}$, $R_{55}$, d and e will be further described hereinafter.

$R_{51}$ has the same meaning as $R_{42}$. $R_{52}$ has the same meaning as $R_{41}$ or represents $R_{41}CON(R_{43})$—, $R_{41}OCON(R_{43})$—, $R_{41}SO_2N(R_{43})$—, $(R_{43})(R_{44})$—$NCON(R_{45})$—, $R_{41}O$—, $R_{41}S$—, a halogen atom or $(R_{41})(R_{43})N$—. The suffix d represents an integer from 0 to 3. The suffix e represents an integer from 0 to 4. When d is plural, the plurality of $R_{52}$ groups represent the same substituent or different substituents. $R_{52}$ may be several divalent groups which are connected to each other to form a cyclic structure. Typical examples of divalent groups for the formation of a cyclic structure include:

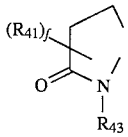

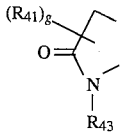

wherein f represents an integer from 0 to 4; and g represents an integer from 0 to 2; when e is plural, the plurality of $R_{55}$ groups represent the same substituent or different substituents; $R_{53}$ has the same meaning as $R_{41}$; $R_{54}$ has the same meaning as $R_{41}$. $R_{55}$ has the same meaning as $R_{41}$ or represents $R_{41}OCONH$—, $R_{41}SO_2NH$—, $(R_{43})(R_{44})NCON(R_{45})$—, $(R_{43})(R_{44})NSO_2N(R_{45})$—, $R_{43}O$—, $R_{41}S$—, a halogen atom or $(R_{41})(R_{43})N$— group. When there is a plurality of $R_{55}$ groups, they may be the same or different.

In the foregoing description, the aliphatic group is a $C_{1-32}$, preferably C1–22 saturated or unsaturated, acyclie or cyclic, straight-chain or branched, substituted or unsubstituted aliphatic hydrocarbon group. Typical examples of such an aliphatic group include methyl, ethyl, propyl, isopropyl, butyl, (t)-butyl, (i) butyl, (t) amino, hexyl, cyclohexyl, 2-ethylhexyl, octyl, 1,1,3,3-tetramethylbutyl, decyl, dodecyl, hexadecyl, and octadecyl groups.

The aromatic group is a $C_{6-20}$ aromatic group, and preferably is a substituted or unsubstituted phenyl group or a substituted or unsubstituted naphthyl group.

The heterocyclic group is a $C_{1-20}$, preferably $C_{1-7}$, preferably 3- to 8-membered substituted or unsubstituted heterocyclic group containing a hetero atom selected from nitrogen, oxygen and sulfur atoms. Typical examples of such a heterocyclic group include 2-pyridyl, 2-thienyl, 2-furyl, 1,3,4-thiadiazole-2-yl, 2,4-dioxo-1,3-imidazolidine-5-yl, 1,2,4-triazole-2-yl, and 1-pyrazolyl.

If the above mentioned aliphatic hydrocarbon group, aromatic group and heterocyclic group contain substituents, typical examples of such substituents include a halogen atom, an $R_{47}O$— group, an $R_{46}S$— group, an $R_{47}CON(R_{48})$— group, an $(R_{47})(R_{48})NCO$— group, an $R_{46}OCON(R_{48})$— group, an $R_{46}SO_2N(R_{47})$— group, an $(R_{47})(R_{48})NSO_2$— group, an $R_{46}SO_2$— group, an $R_{47}OCO$— group, an $(R_{47})(R_{48})NCON(R_{49})$— group, groups having the same meaning as $R_{46}$,

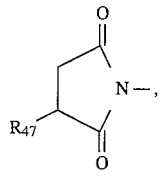

an $R_{46}COO$— group, an $R_{47}OSO_2$— group, a cyano group, and a nitro group, wherein $R_{46}$ represents an aliphatic group, aromatic group or heterocyclic group, and $R_{47}$, $R_{48}$ and $R_{49}$ each represents an aliphatic group, aromatic group, heterocyclic group or hydrogen atom. The aliphatic group, aromatic group and heterocyclic group are as defined above in connection with $R_{41}$, $R_{42}$, $R_{43}$ and $R_{44}$.

In the general formula (Cp-6), $R_{51}$ is preferably an aliphatic group or aromatic group. $R_{52}$ is preferably a chlorine atom, aliphatic group or $R_{41}CONH$— group. The suffix d is preferably 1 or 2. $R_{53}$ is preferably an aromatic group.

In the general formula (Cp-7), $R_{52}$ is preferably an $R_{41}CONH$— group. The suffix d is preferably 1. $R_{54}$ is preferably an aliphatic group or aromatic group.

In the general formula (Cp-8), e is preferably 0 or 1. $R_{55}$ is preferably an $R_{41}OCONH$— group, an $R_{41}CONH$— group or an $R_{41}SO_2NH$— group. These substituents may be preferably connected to the 5-position of the naphthol ring.

The timing group represented by T is a group which causes cleavage of its bond to X after cleavage of its bond to Cp by a coupling reaction of a coupler with an oxidation product of an aromatic primary amine developing agent. The timing group T is used for various purposes such as adjusting coupling reactivity, stabilizing couplers and adjusting the timing of release of the X containing moiety. Examples of the timing group T include the following known groups (the marks * and ** indicate the position at which the timing group is connected to Cp and X or Q, respectively):

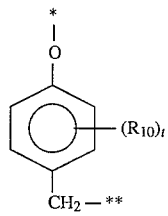

(T-1)

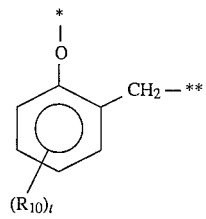

(T-2)

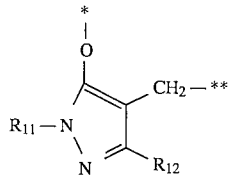

(T-3)

-continued (T-4)

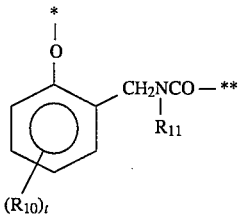

(T-5)

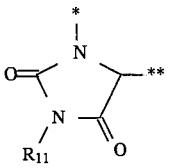

$*-OCH_2-**$ (T-6)

$*-OCO-**$ (T-7)

In these general formulae, $R_{10}$ represents a group capable of substituting to the benzene ring, $R_{11}$ has the same meaning as $R_{41}$, and $R_{12}$ represents a hydrogen atom or substituent. The suffix t represents an integer 0 to 4. Examples of substituents represented by $R_{10}$ and $R_{12}$ include $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N$—$(R_{43})$—, $R_{43}CO$—, $R_{41}COO$—, $R_{41}SO$—, nitro, $R_{43}(R_{44})NCON$—$(R_{45})$—, cyano, $R_{41}OCON(R_{43})$—, $R_{43}OSO_2$—, $R_{43}(R_{44})N$—, $R_{43}(R_{44})NSO_2N(R_{45})$, and

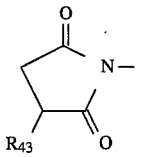

groups. The terms $R_{41}$, $R_{42}$, $R_{43}$, $R_{44}$, and $R_{45}$ are as defined above.

The suffix k represents an integer 0 or 1. In general, k is preferably 0, that is, Cp and X are preferably directly connected to each other.

X is a divalent connecting group which is connected to the $(T)_k$ containing moiety via a N, O or S atom of X. Preferred examples of such a divalent connecting group include —O—, —S—, —OCO—, —OCOO—, —OCOS—, —OCONH—, —$OSO_2$—, —$OSO_2NH$— or a nitrogen containing heterocyclic group which is connected to the $(T)_k$ containing moiety via its nitrogen atom (e.g., groups derived from pyrrolidine, piperidine, morpholine, piperadine, pyrrole, pyrazole, imidazole, 1,2,4-triazole, benzothiazole, succinimido, phthalimido, oxazolidine-2,4-dione, imidazolidine-2,4-dione, 1,2,4-triazolidine- 3,5-dione), and connecting groups obtained by combining these groups with an alkylene group (e.g., 1,4-cyclohexylene), an arylene group (e.g., o-phenylene, p-phenylene), a divalent heterocyclic group (e.g., groups derived from pyridine, thiphene), —CO—, —$SO_2$—, —COO—, —CONH—, —$SO_2NH$—, —$SO_2O$—, —NHCO—, —$NHSO_2$—, —NHCONH—, —$NHSO_2NH$—, —NHCOO — group, etc. X is more preferably represented by the general formula (II):

$$*-X_1-(L-X_2)_m-** \quad (II)$$

wherein * indicates the position at which it is connected to the $(T)_k$ containing moiety; ** indicates the position at which it is connected to the Q containing moiety; $x_1$ represents —O— or —S—; L represents an alkylene group; $X_2$ represents a single bond, —O—, —S—, —CO—, —$SO_2$—, —OCO—, —COO —, —NHCO—, —CONH—, —$SO_2NH$—, —$NHSO_2$—, —$SO_2O$—, —$OSO_2$—, —OCOO—, —OCONH—, —NHCOO—, —NHCONH—, —$NHSO_2NH$—, —OCOS—, —SCOO—, —$OSO_2NH$— or —$NHSO_2O$—; and m represents an integer from 0 to 3. The total number of carbon atoms contained in X is preferably from 0 to 12, more preferably, 0 to 8. X is most preferably —$OCH_2CH_2O$—.

Q represents an arylene group or divalent heterocyclic group. If Q is an arylene group, it may be a condensed ring or it may contain substituents (e.g., halogen atom, hydroxyl, carboxyl, sulfo, nitro, cyano, amino, ammonium, phosphono, phosphino, alkyl, cycloalkyl, aryl, carbonamido, sulfonamido, alkoxy, aryloxy, acyl, sulfonyl, carboxyl, carbamoyl, sulfamoyl). The total number of carbon atoms contained in Q is preferably in the range of 6 to 15, more preferably, 6 to 10. If Q is a divalent heterocyclic group, the heterocyclic group is a 3- to 8-membered, preferably 5- to 7-membered, single or condensed heterocyclic group containing at least one hetero atom selected from N, O, S, P, Se and Te atoms (e.g., groups derived from pyridine, thiophene, furan, pyrrole, pyrazole, imidazole, thiazole, oxazole, benzothiazole, benzoxazole, benzofuran, benzothiophene, 1,3, 4-thiadiazole, indole, quinoline). The heterocyclic group may contain substituents (the same as those contained in the arylene group represented by Q). The number of carbon atoms contained in Q is preferably in the range of 2 to 15, and more preferably, 2 to 10. Q is most preferably a 1,4-phenylene group.

Accordingly, —$(T)_k$—X—Q— is most preferably represented by the following formula:

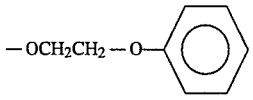

If $R_1$, $R_2$ or $R_3$ in general formula (CI) is an alkyl group, the alkyl group may be either straight-chain or branched or may contain unsaturated bonds or substituents (e.g., a halogen atom, a hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, or sulfonyl group).

If $R_1$, $R_2$ or $R_3$ is a cycloalkyl group, it is a 3- to 8-membered cycloalkyl group which may contain crosslinking groups, unsaturated bonds or substituents (the same substituents as those contained in the alkyl group represented by $R_1$, $R_2$ or $R_3$).

If $R_1$, $R_2$ or $R_3$ is an aryl group, it may be a condensed ring or may contain substituents such as those contained in the alkyl group represented by $R_1$, $R_2$ or $R_3$, an alkyl and a cycloalkyl group.

If $R_1$, $R_2$ or $R_3$ is a heterocyclic group, it is a 3- to 8-membered, preferably 5- to 7-membered, single or condensed heterocyclic group containing at least one hetero atom selected from N, S, O, P, Se and Te atoms (e.g., imidazolyl, thienyl, pyrazolyl, thiazolyl, pyridyl, quinolinyl). The heterocyclic group may contain substituents (the same as those contained in the aryl group represented by $R_1$, $R_2$ or $R_3$).

In general formula (CI), the carboxyl group may be a carboxylate group, the sulfo group may be a sulfonate group, the phosphino group may be a phosphinate group, and the phosphono group may be a phosphonate group. Examples of paired (counter) ions contained in these groups include $Li^+$, $Na^+$, $K^+$ and ammonium.

$R_1$ is preferably a hydrogen atom, a carboxyl group, $C_{1-10}$ alkyl group (e.g., methyl, t-butyl, carbomethyl, 2-sulfomethyl, carboxymethyl, 2-carboxymethyl, 2-hydroxymethyl, benzyl, ethyl, isopropyl) or a $C_{6-12}$ aryl group (e.g., phenyl, 4-methoxyphenyl, 4-sulfophenyl). Particularly preferred among these groups are a hydrogen atom, a methyl group, and a carboxyl group.

$R_2$ is preferably a cyano group, a carboxyl group, a $C_{1-10}$ carbamoyl group, a $C_{0-10}$ sulfamoyl group, a sulfo group, a $C_{1-10}$ alkyl group (e.g., methyl, sulfomethyl), a $C_{1-10}$ sulfonyl group (e.g., methylsulfonyl, phenylsulfonyl), a $C_{1-10}$ carbonamide group (e.g., acetamide, benzamide) or a $C_{1-10}$ sulfonamide group methanesulfonamide, toluenesulfonamide). Particularly preferred among these groups are a cyano group, a carbamoyl group, and a carboxyl group.

$R_3$ is preferably a hydrogen atom, a $C_{1-12}$ alkyl group (e.g., methyl, sulfomethyl, carboxymethyl, 2-sulfomethyl, 2-carboxymethyl, ethyl, n-butyl, benzyl, 4-sulfobenzyl) or a $C_{6-15}$ aryl group (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl). $R_3$ is more preferably a $C_{1-7}$ alkyl group or a $C_{6-10}$ aryl group.

$R_4$ in general formula (CII) is an acyl group represented by the general formula (III) or a sulfonyl group represented by the general formula (IV):

$$R_{11}CO— \quad (III)$$

$$R_{11}SO_2— \quad (IV)$$

In these formulae, $R_{11}$ is an alkyl, cycloalkyl, aryl or heterocyclic groups.

The alkyl group represented by $R_{11}$ may be either straight-chain or branched, or may contain unsaturated bonds or substituents (e.g., halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, sulfonyl).

The cycloalkyl group represented by $R_{11}$ may be a 3- to 8-membered cycloalkyl group or may contain crosslinking groups, unsaturated bonds or substituents (the same as those which can be contained in the alkyl group represented by $R_{11}$).

The aryl group represented by $R_{11}$ may be a condensed ring or may contain substituents (e.g., the same substituents as those which can be contained in the alkyl group represented by $R_{11}$, and, in addition, an alkyl group, and a cycloalkyl group).

The heterocyclic group represented by $R_{11}$ is a 3- to 8-membered, preferably 5- to 7-membered single or condensed heterocyclic group containing at least one hetero atom selected from N, S, O, P, Se and Te atoms (e.g., imidazolyl, thienyl, pyrazolyl, thiazolyl, pyridyl, quinolinyl). The heterocyclic group may contain substituents (the same as those which can be contained in the aryl group represented by $R_{11}$).

The carboxyl substituent may be a carboxylate group, the sulfo substituent may be a sulfonate group, the phosphino substituent may be a phosphinate group, and the phosphono substituent may be a phosphonate group. Examples of paired (counter) ions contained in these groups include $Li^+$, $Na^+$, $K^+$ and ammonium.

$R_{11}$ is preferably a $C_{1-10}$ alkyl group (e.g., methyl, carboxymethyl, sulfoethyl, cyanoethyl), a $C_{5-8}$ cycloalkyl group (e.g., cyclohexyl, 2-carboxycyclohexyl) or a $C_{6-10}$ aryl group (e.g., phenyl, 1-naphthyl, 4-sulfophenyl). Particularly preferred among these groups are a $C_{1-3}$ alkyl group, and a $C_6$ aryl group.

$R_5$ is a substituent group, preferably an electron-donating group, particularly $—NR_{12}R_{13}$ or $—OR_{14}$. The position at which $R_5$ is connected to the benzene ring is preferably the 4-position. $R_{12}$, $R_{13}$ and $R_{14}$ each represents a hydrogen atom, an alkyl group, a cycloalkyl group, an aryl group or a heterocyclic group. $R_{12}$ and $R_{13}$ may together form a ring. The nitrogen-containing heterocyclic group is preferably aliphatic.

The suffix j represents an integer from 0 to 4, preferably 1 or 2, most preferably 1.

The alkyl group represented by $R_9$ or $R_{10}$ may be either straight-chain or branched or may contain unsaturated bonds or substituents (e.g., halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, sulfonyl).

The cycloalkyl group represented by $R_9$ or $R_{10}$ may be a 3- to 8-membered cycloalkyl group or may contain crosslinking groups, unsaturated bonds or substituents (examples of the substituents are the same as those described above as substituents for the alkyl group represented by $R_9$ or $R_{10}$.

The aryl group represented by $R_9$ or $R_{10}$ may be a condensed ring or may contain substituents (e.g., the same as those which can be contained in the alkyl group represented by $R_9$ or $R_{10}$, and in addition alkyl, or cycloalkyl).

The heterocyclic group represented by $R_9$ or $R_{10}$ is a 3- to 8-membered, preferably a 5- to 7-membered heterocyclic group, containing at least one hetero atom selected from N, S, O, P, Se and Te atoms (imidazolyl, thienyl, pyrazolyl, thiazolyl, pyridyl, quinolinyl). The heterocyclic group may contain substituents (the same as those contained in the aryl group represented by $R_9$ or $R_{10}$).

The carboxyl substituent may be a carboxylate group, the sulfo substituent may be a sulfonate group, the phosphino substituent may be a phosphinate group, and the phosphono substituent may be a phosphonate group. Examples of paired (counter) ions in these groups include $Li^+$, $Na^+$, $K^+$ and ammonium $R_9$ is preferably a cyano group, a carboxyl group, a $C_{1-10}$ carbamoyl group, a $C_{2-10}$ alkoxycarbonyl group, a $C_{7-11}$ aryloxycarbonyl group, a $C_{0-10}$ sulfamoyl group, sulfo group, a $C_{1-10}$ alkyl group (e.g., methyl, carboxymethyl, sulfomethyl), a $C_{1-10}$ sulfonyl group (e.g., methylsulfonyl, phenylsulfonyl), a $C_{1-10}$ carbonamido group (e.g., acetamido, benzamido), a sulfonamido group (e.g., methanesulfonamido, toluenesulfonamido), an alkyloxy group (e.g., methoxy, ethoxy) or an aryloxy group (e.g., phenoxy). Particularly preferred among these groups are a cyano group, a carbamoyl group, an alkoxycarbonyl group, and a carboxyl group.

$R_{10}$ is preferably a hydrogen atom, a $C_{1-12}$ alkyl group (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl) or a $C_{6-15}$ aryl group (e.g., phenyl, 4-carboxyphenyl, 3-carboxyphenyl, 2,4-dicarboxyphenyl, 4-sulfophenyl, 3-sulphophenyl, 2,5-disulfophenyl, 2,4-disulfophenyl). $R_{10}$ is more preferably a $C_{1-7}$ alkyl group or $C_{6-10}$ aryl group.

Specific examples of Cp, X, Q,
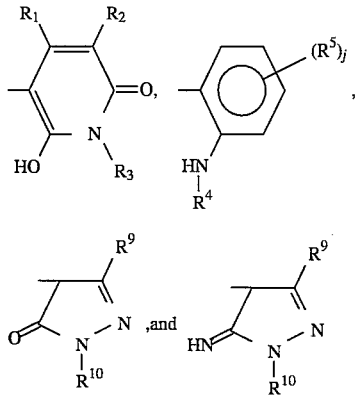
are be set forth below.
Examples of Cp:
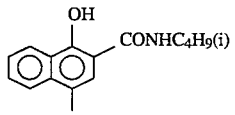
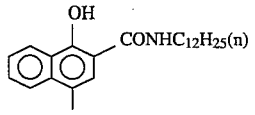
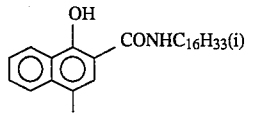
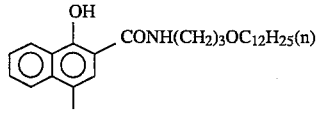
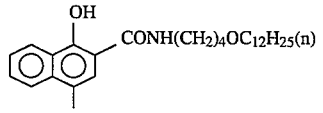
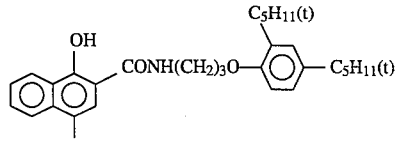
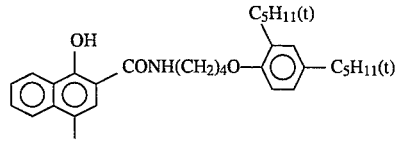
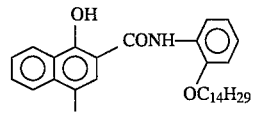
-continued
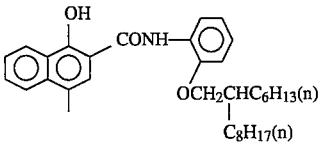
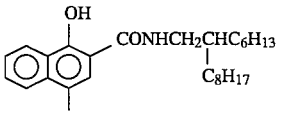
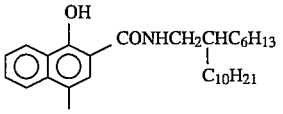
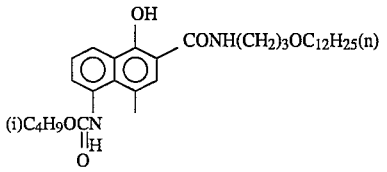
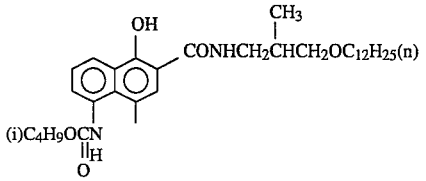
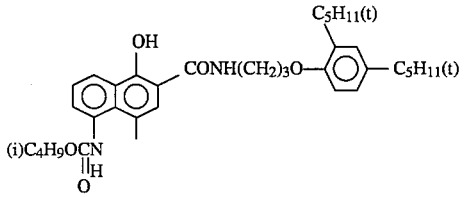
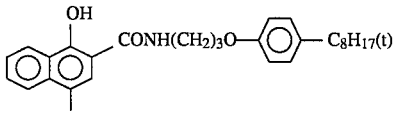
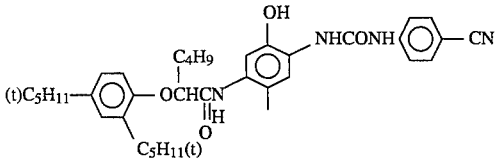
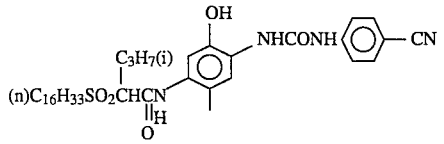
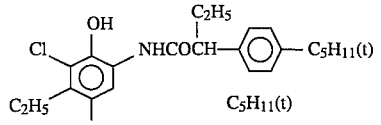

-continued
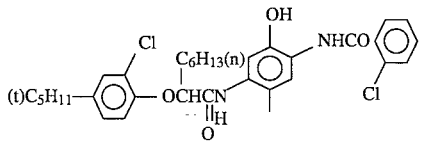
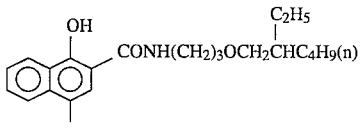
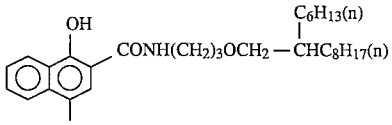
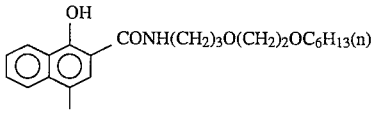
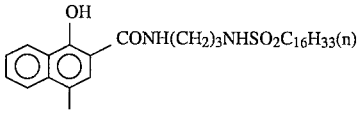
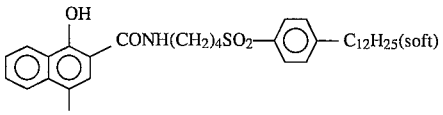
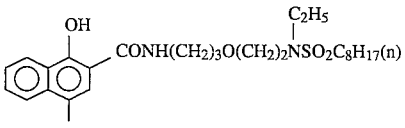
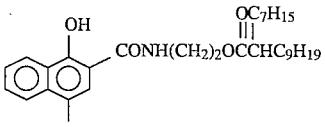
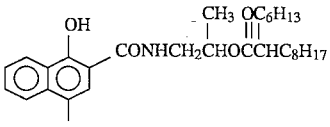
Examples of X:
—O—, —S—, —$OCH_2$—, —$OCH_2CH_2$—, —$OCH_2CH_2O$—, —$OCH_2CH_2CH_2O$—, —$O(CH_2CH_2O)_2$—, —$OCH_2CH_2S$—, —$OCH_2CH_2NHCO$—, —$OCH_2CH_2NHSO_2$—, —$OCH_2CH_2SO_2$—, —$OCH_2CH_2OCO$—, —$OCH_2CH_2CO$—, —$SCH_2CONH$—, —$SCH_2COO$—, —$OCH(CH_3)CONH$—, —$OCH_2CH_2OSO_2$—, —OCO—, —$OCH_2CH(COOH)$—, —$OCH_2CH(COOH)CH_2$—, —$OCH_2CH(COOH)O$—, —$OCH(COOH)CH_2O$—, —$OCH_2CH(COOH)S$—, —$OCH_2CH(SO_3Na)O$—
Examples of Q:
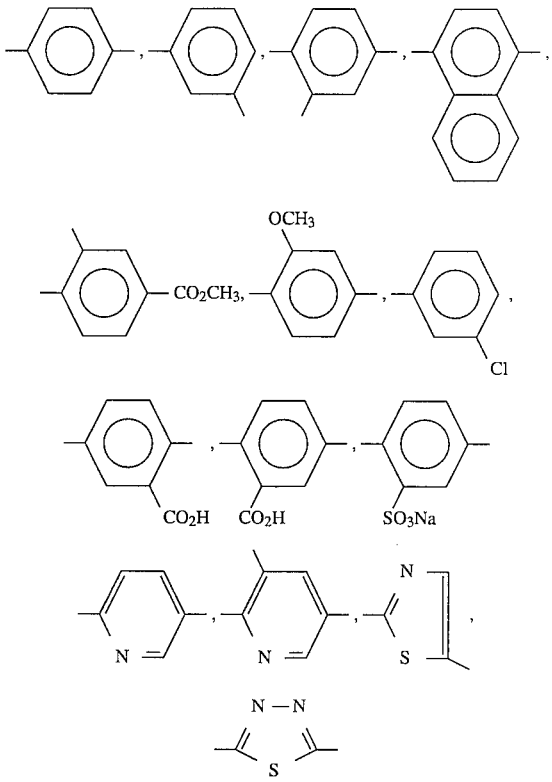
Examples of the group
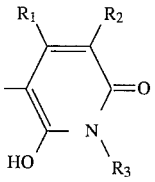
in the formula (CI) are shown below.
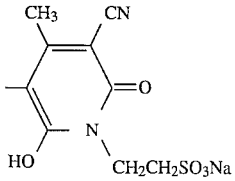
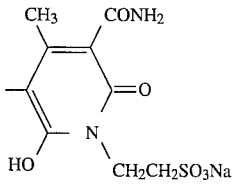
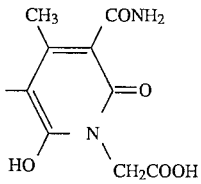

-continued
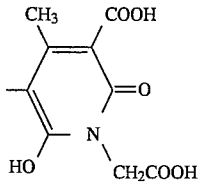
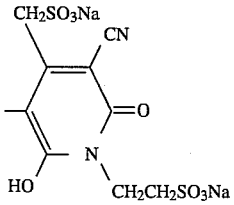
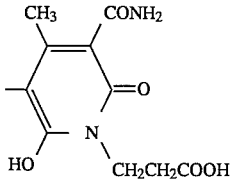
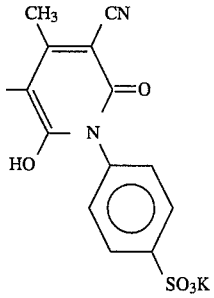
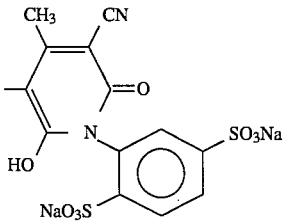
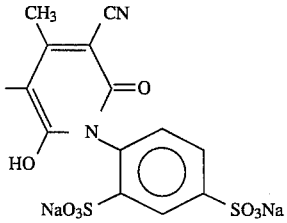
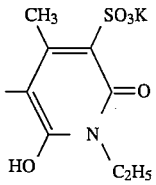
-continued
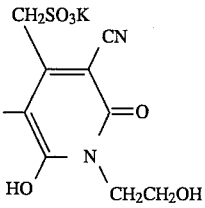
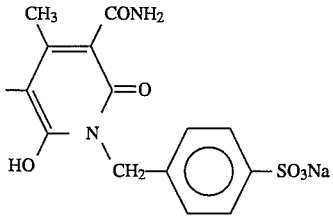
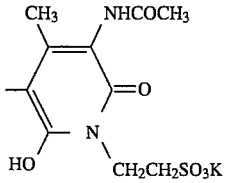
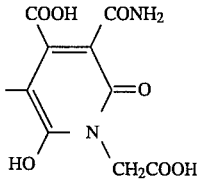
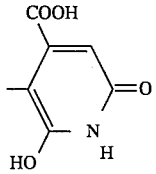
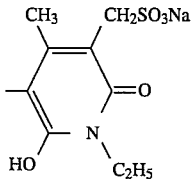
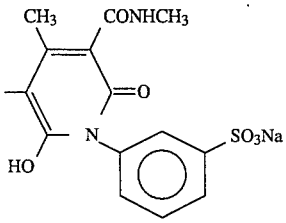
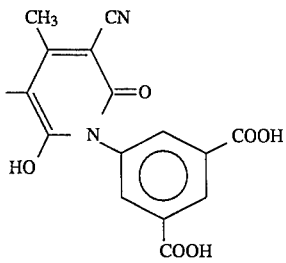

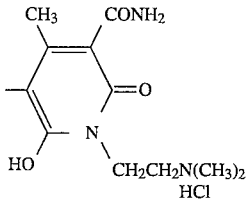
CH3
CONH2
O
N
HO
CH2CH2N(CH3)2
HCl
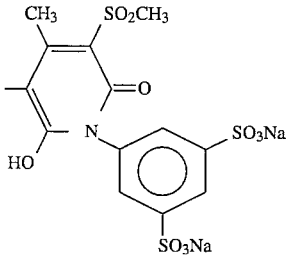
CH3
SO2CH3
O
N
HO
SO3Na
SO3Na
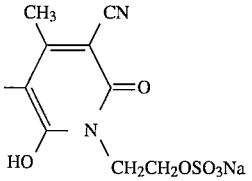
CH3
CN
O
N
HO
CH2CH2OSO3Na
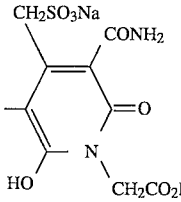
CH2SO3Na
CONH2
O
N
HO
CH2CO2H
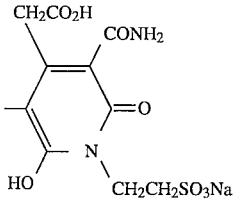
CH2CO2H
CONH2
O
N
HO
CH2CH2SO3Na
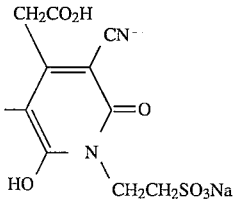
CH2CO2H
CN
O
N
HO
CH2CH2SO3Na
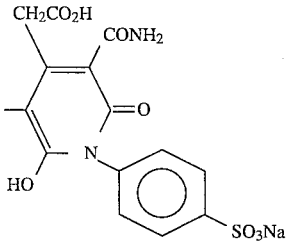
CH2CO2H
CONH2
O
N
HO
SO3Na
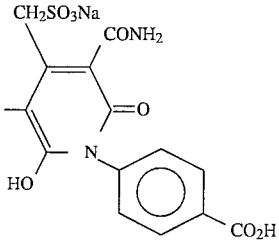
CH2SO3Na
CONH2
O
N
HO
CO2H
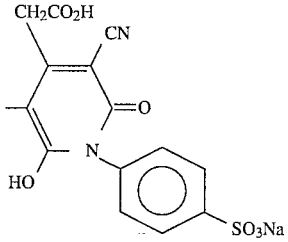
CH2CO2H
CN
O
N
HO
SO3Na
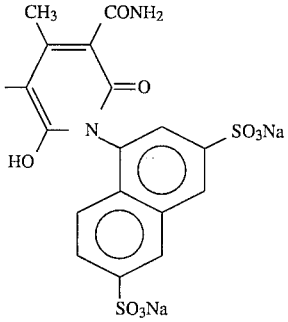
CH3
CONH2
O
N
HO
SO3Na
SO3Na
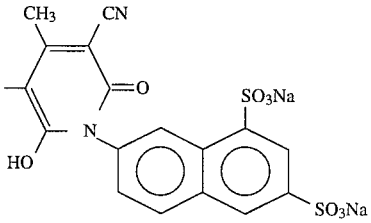
CH3
CN
O
SO3Na
N
HO
SO3Na
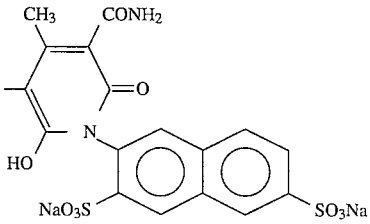
CH3
CONH2
O
N
HO
NaO3S
SO3Na
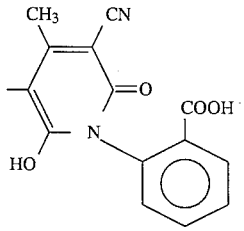
CH3
CN
O
COOH
N
HO -continued
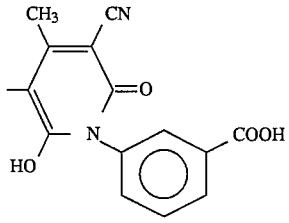
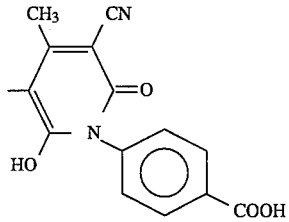
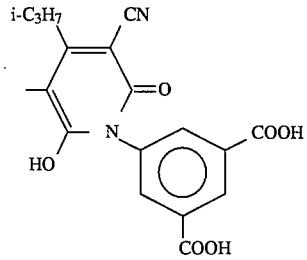
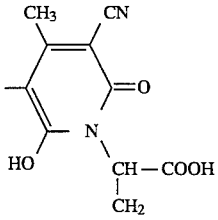
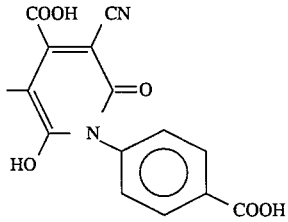
Examples of
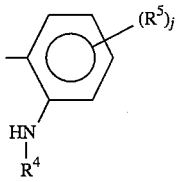
in formula (CII) include:
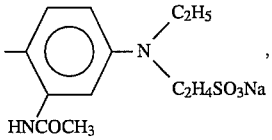
-continued
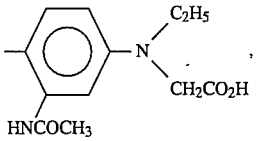
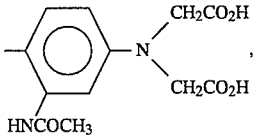
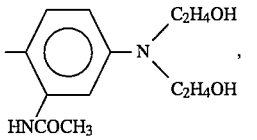
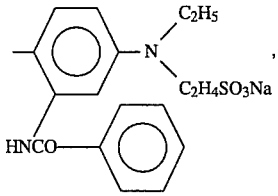
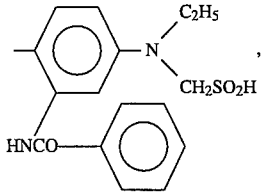
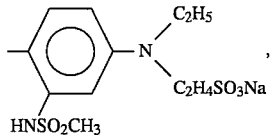
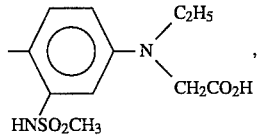
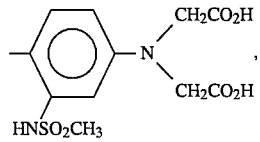
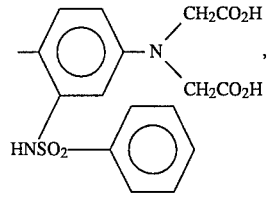
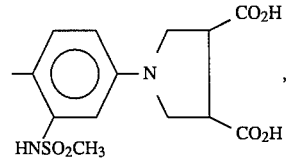

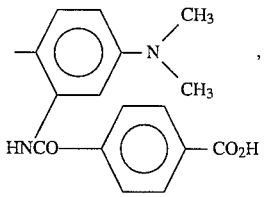
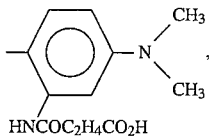
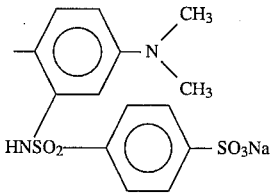
Examples of the group
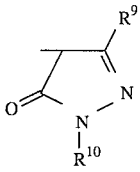
in formula (CIV) include:
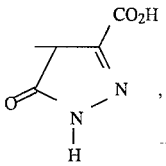
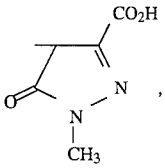
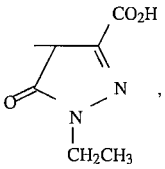
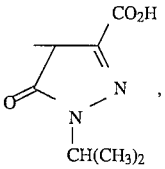
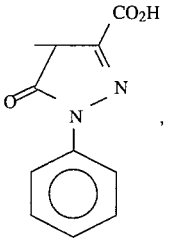
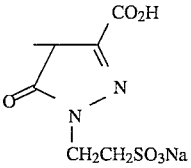
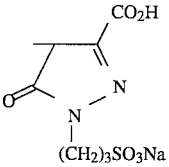
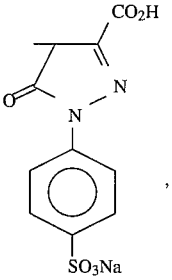
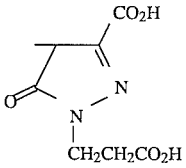
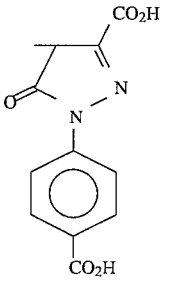
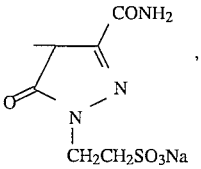

-continued
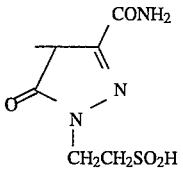
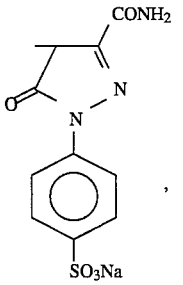
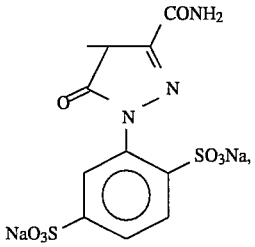
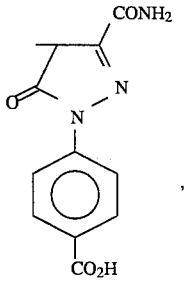
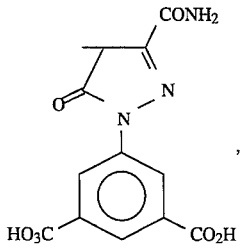
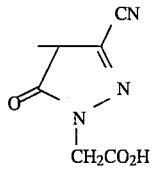
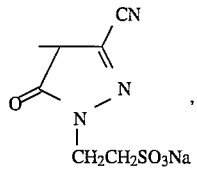
-continued
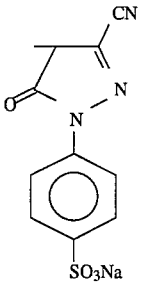
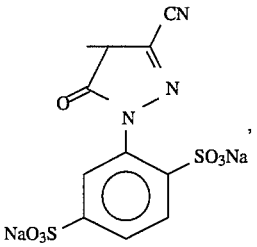
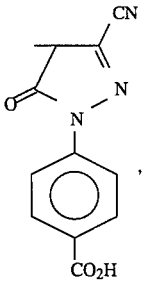
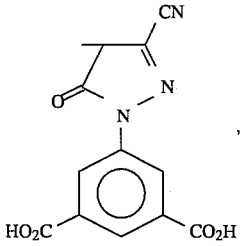
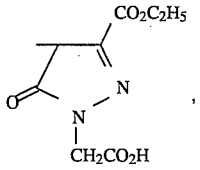
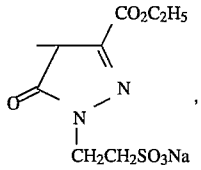

-continued
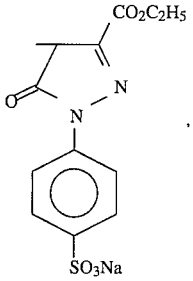
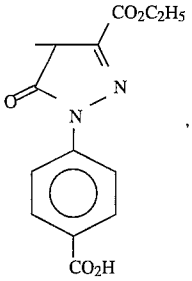
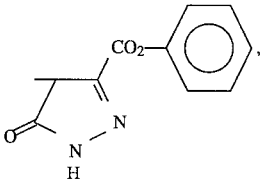
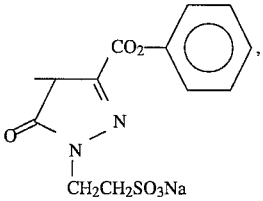
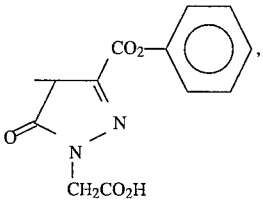
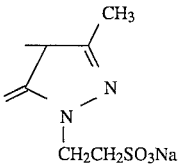
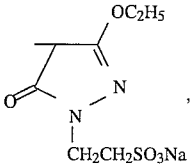
-continued
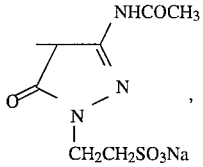
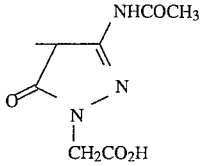
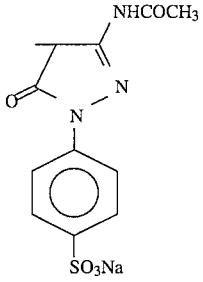
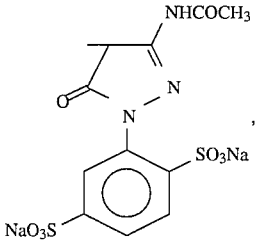
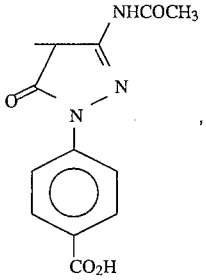
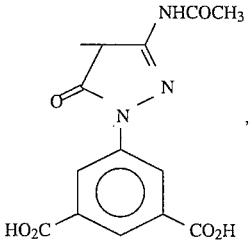
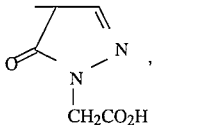

-continued
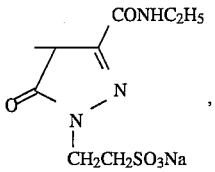
Examples of the group
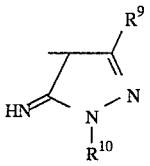
in formula (CIII) include:
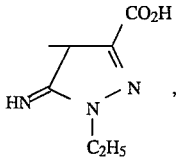
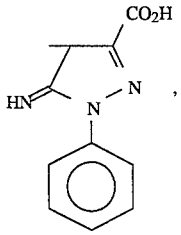
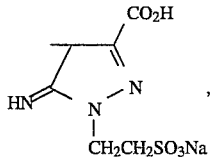
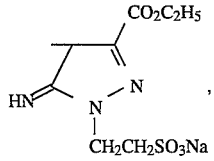
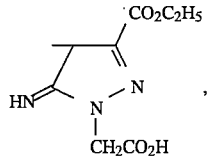
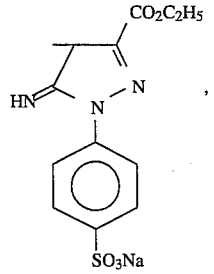
-continued
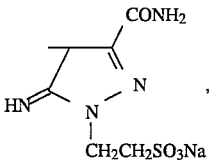
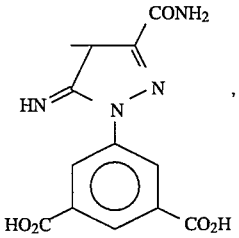
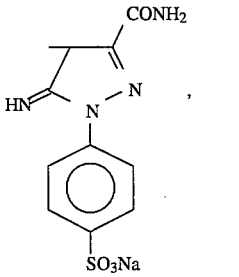
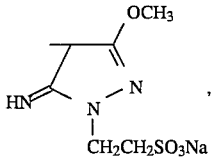
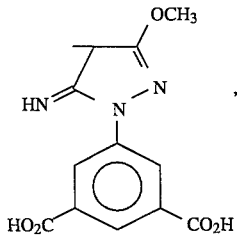
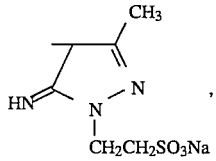
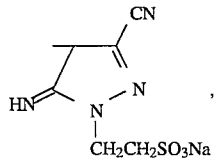
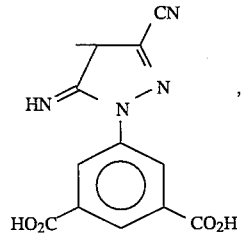

-continued
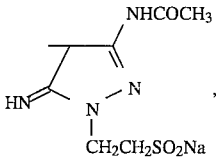
Examples of the yellow-colored couplers of the present invention will be set forth below:
(YC-1)
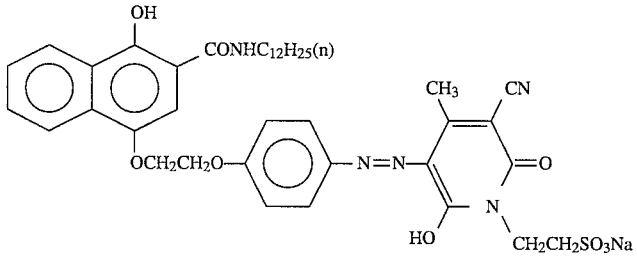
(YC-2)
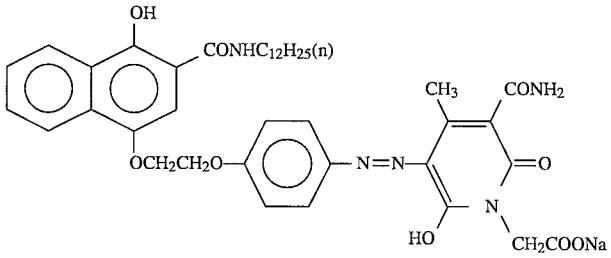
(YC-3)
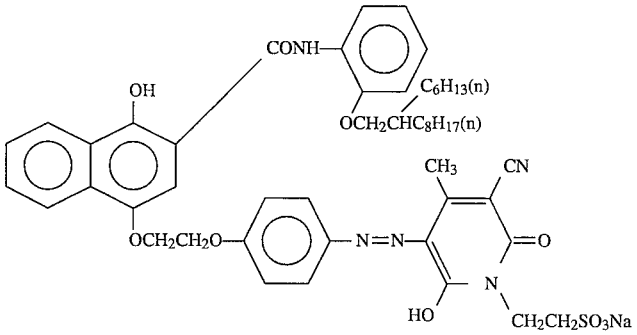
(YC-4)
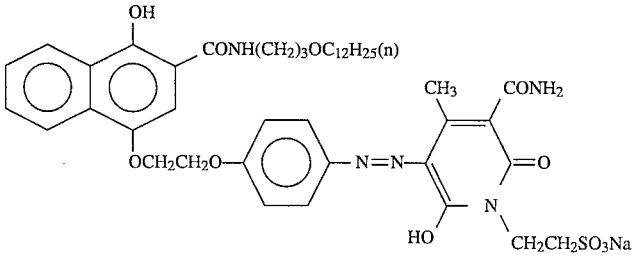
(YC-5)
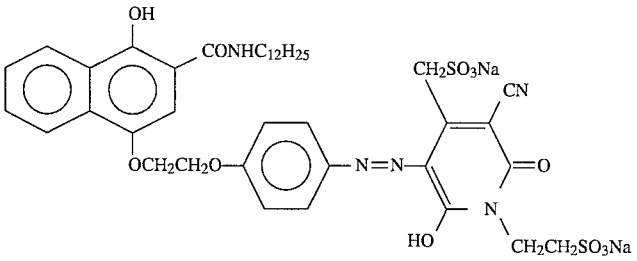

-continued
(YC-6)
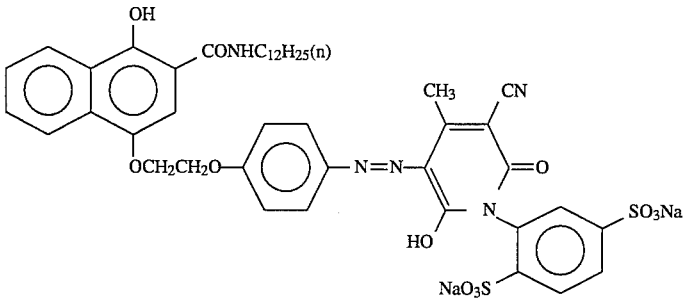
(YC-7)
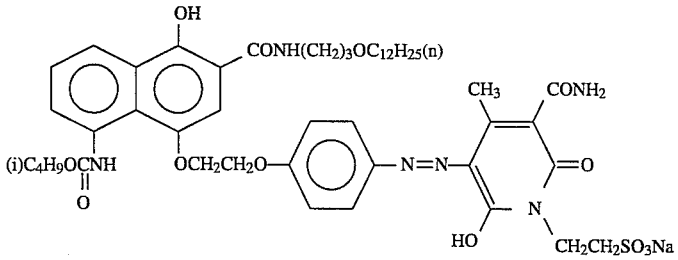
(YC-8)
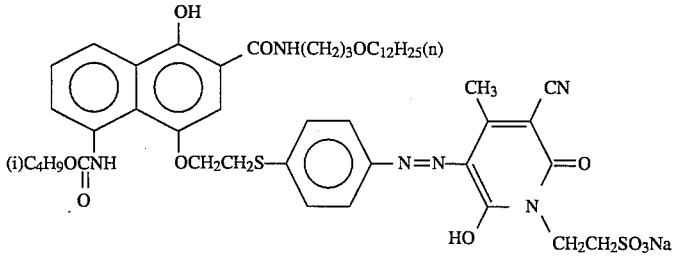
(YC-9)
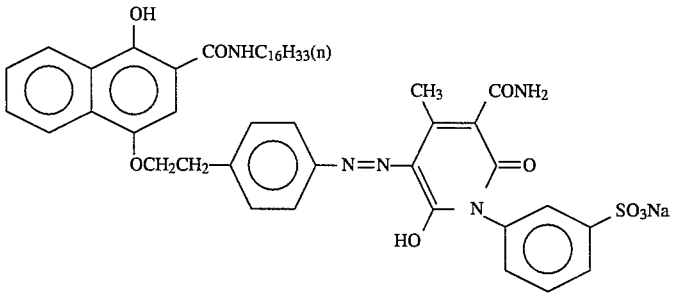
(YC-10)
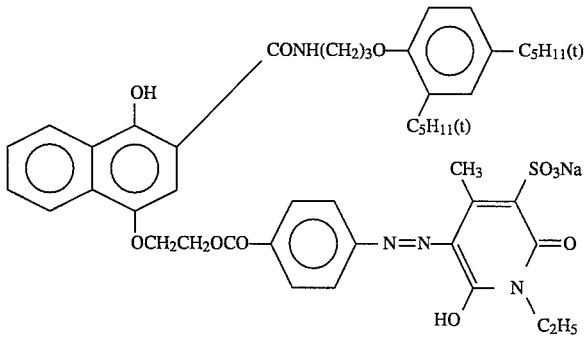

-continued
(YC-11)
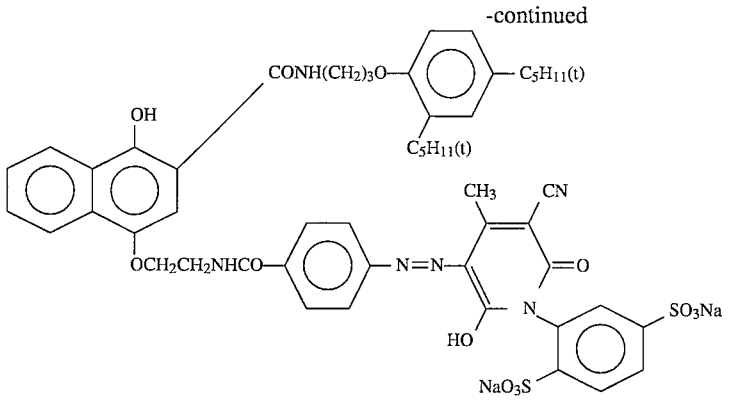
(YC-12)
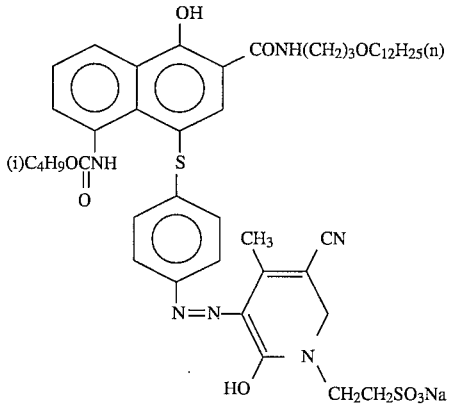
(YC-13)
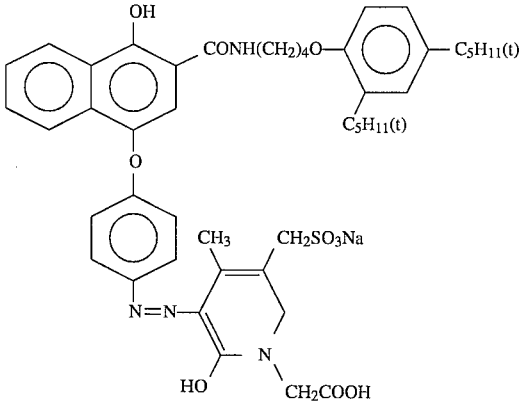
(YC-14)
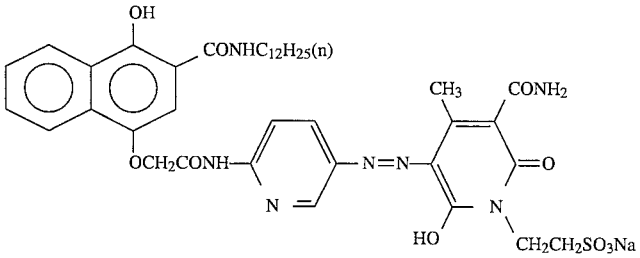
(YC-15)
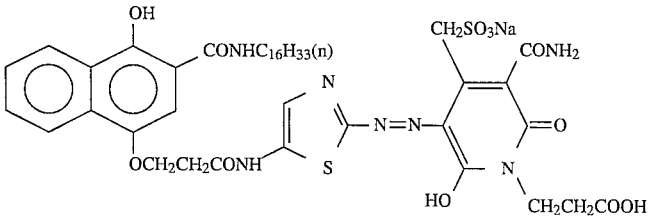

-continued
(YC-16)
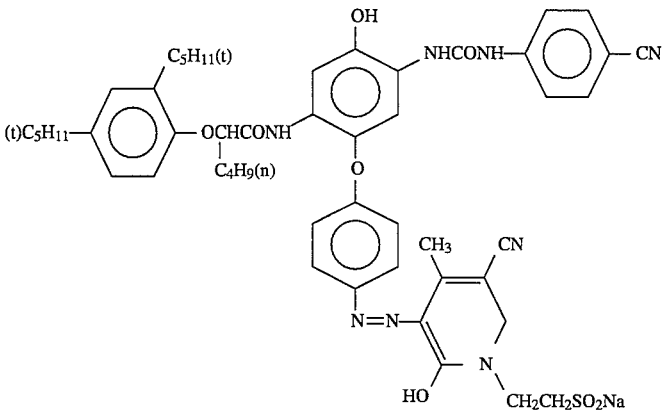
(YC-17)
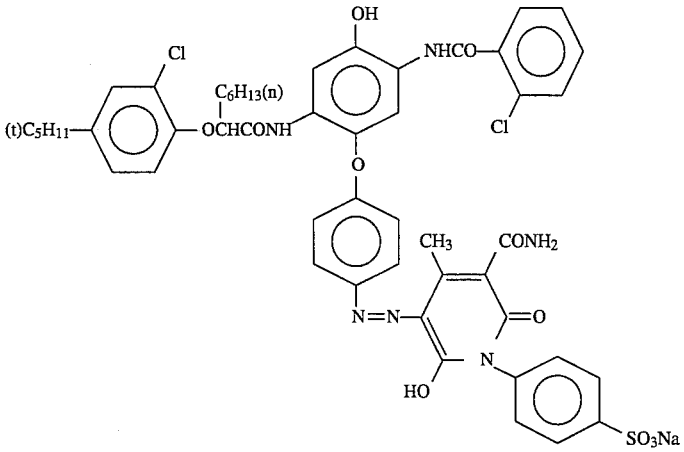
+R2
(YC-18)
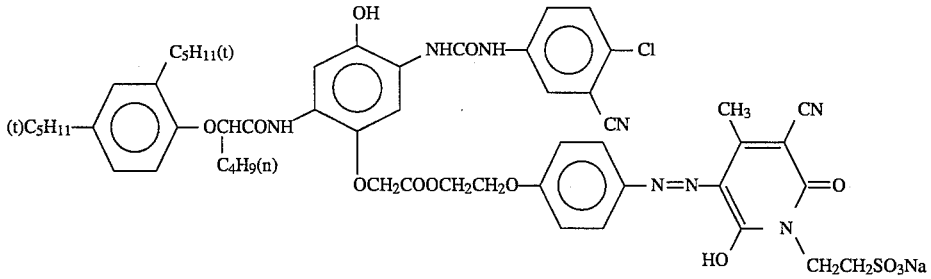
(YC-19)
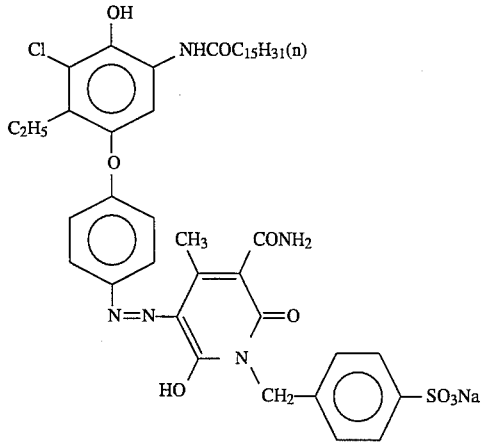

-continued
(YC-20)
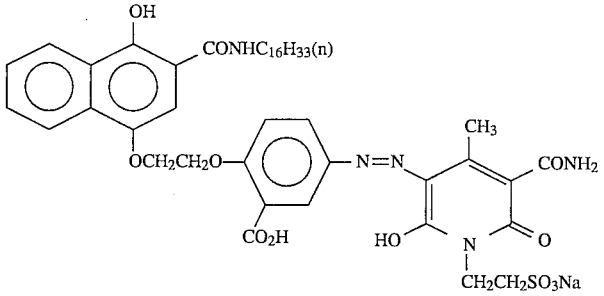
(YC-21)
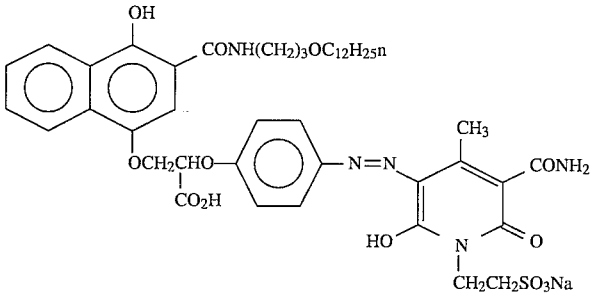
(YC-22)
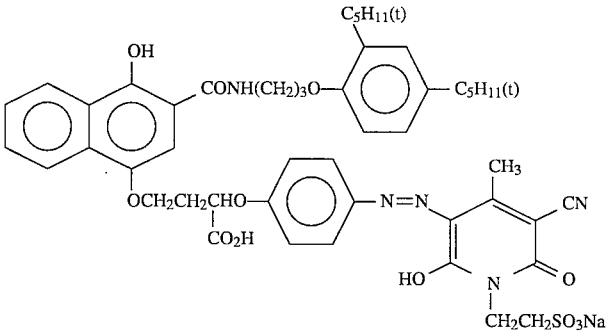
(YC-23)
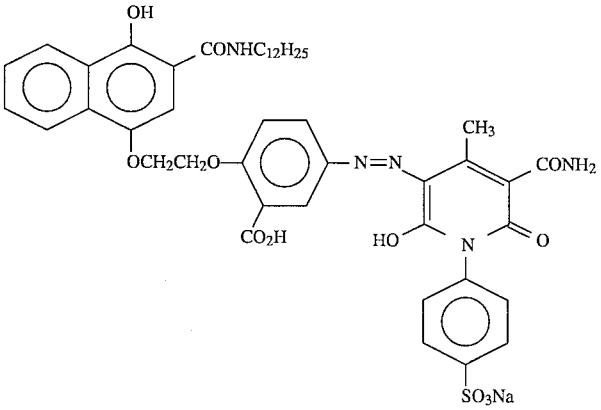
(YC-24)
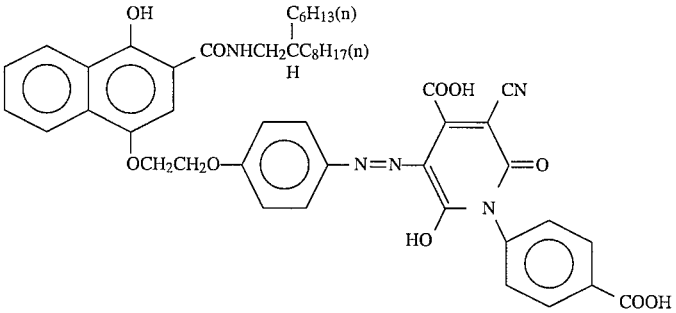

-continued
(YC-25)
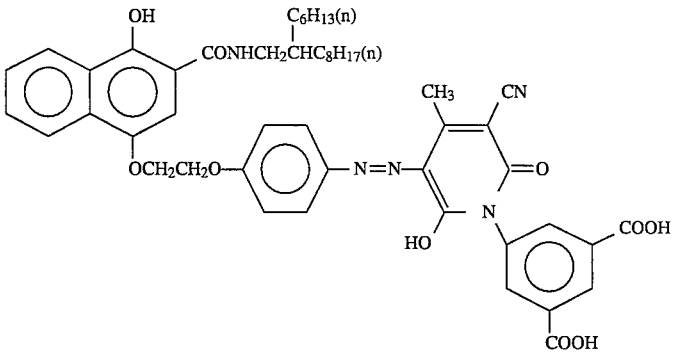
(YC-26)
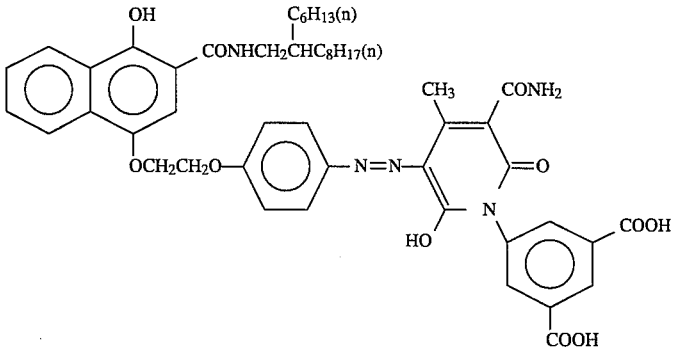
(YC-27)
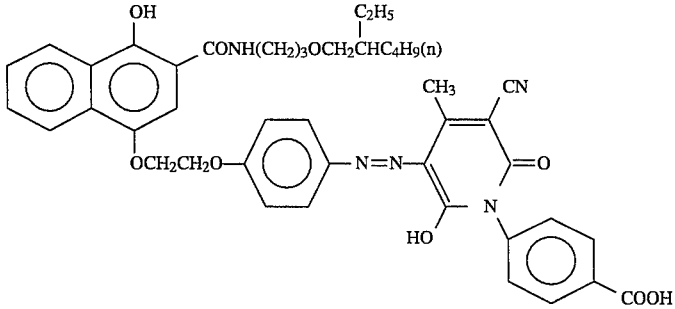
(YC-28)
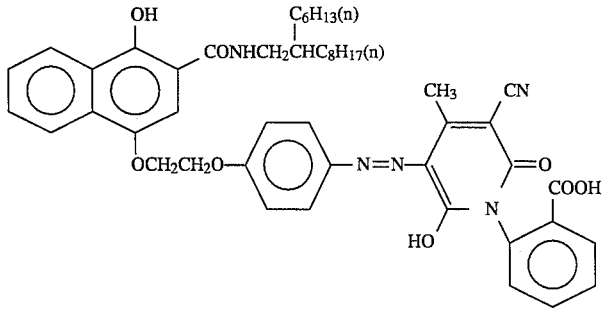
(YC-29)
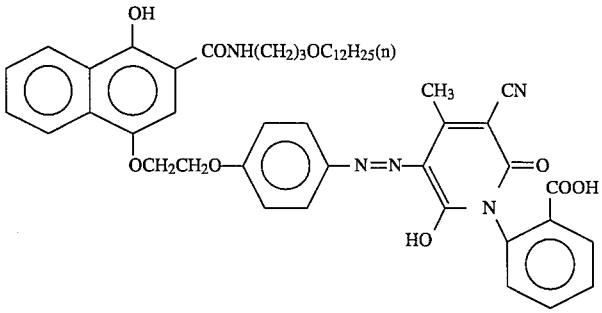

-continued
(YC-30)
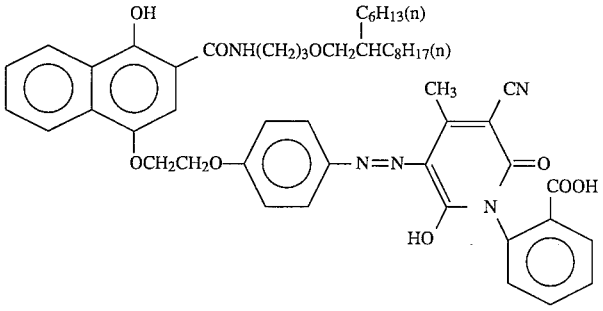
(YC-31)
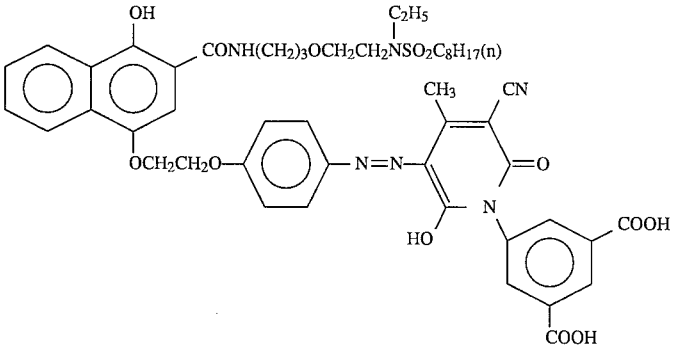
+R2
(YC-32)
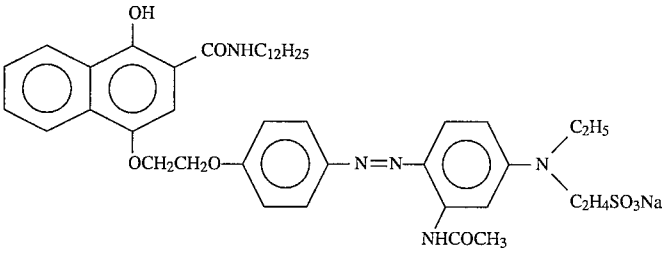
(YC-33)
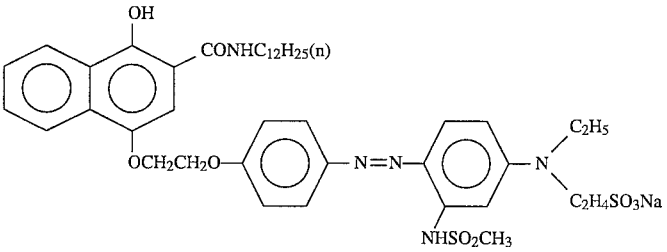
(YC-34)
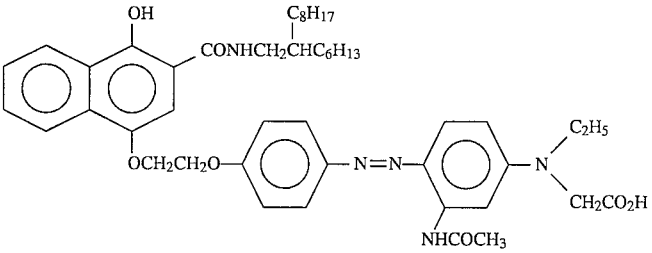

-continued
(YC-35)
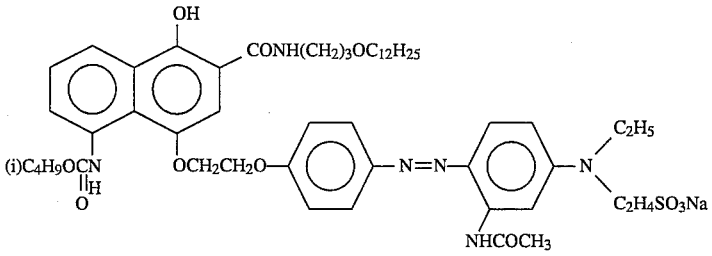
(YC-36)
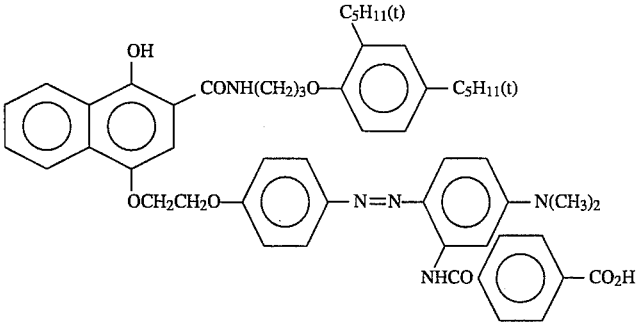
(YC-37)
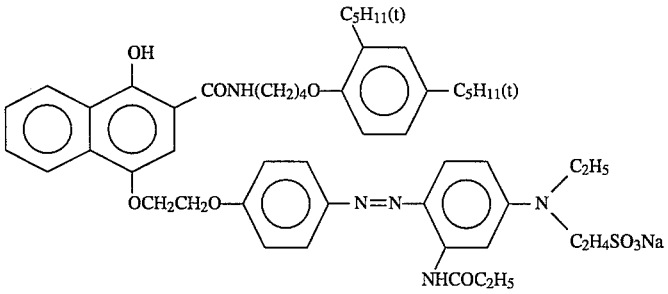
(YC-38)
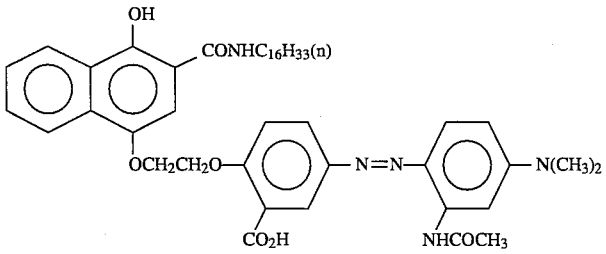
(YC-39)
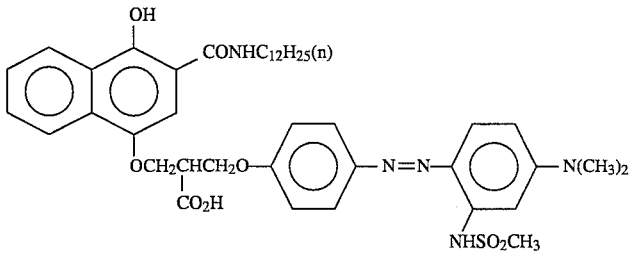

-continued
(YC-40)
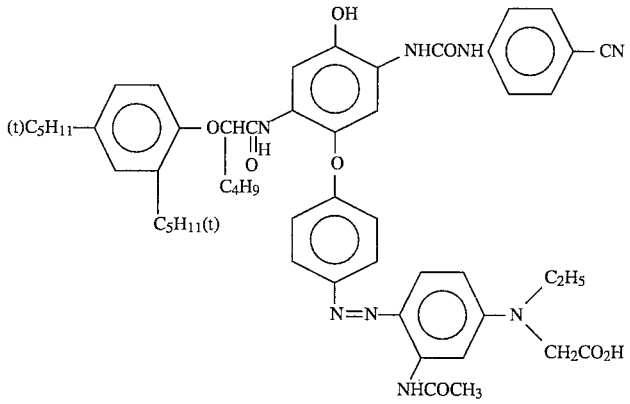
(YC-41)
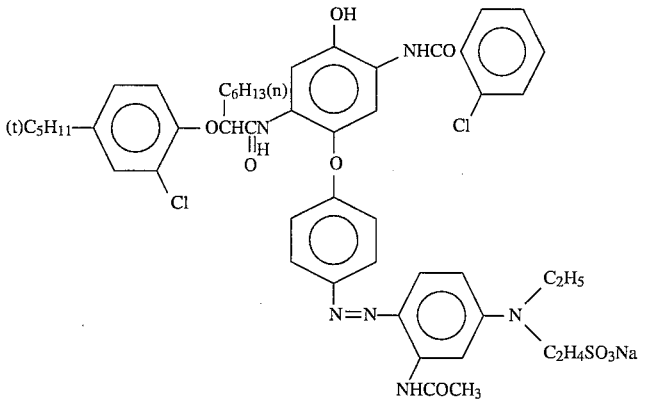
(YC-42)
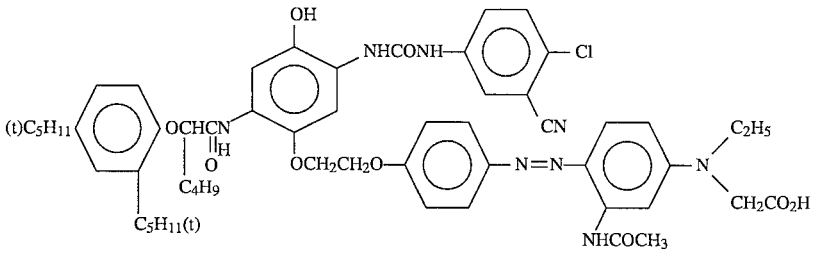
(YC-43)
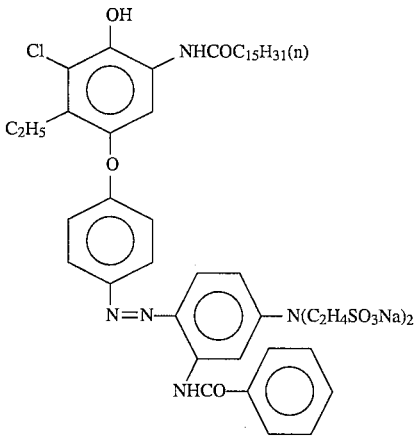

-continued
(YC-44)
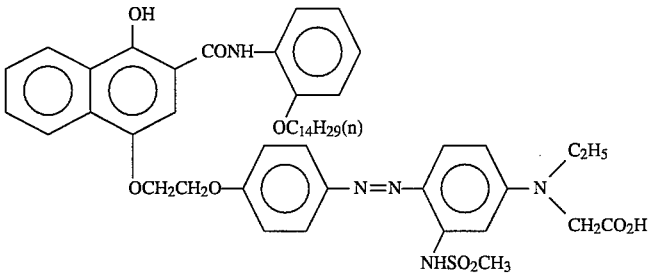
(YC-45)
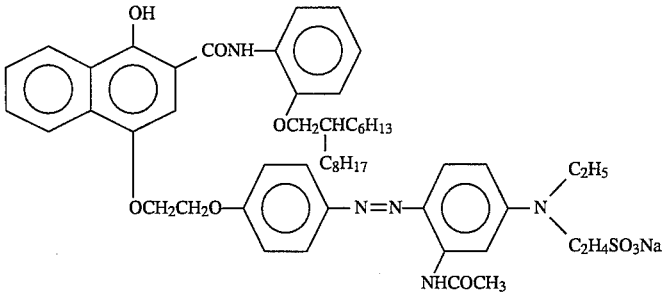
(YC-46)
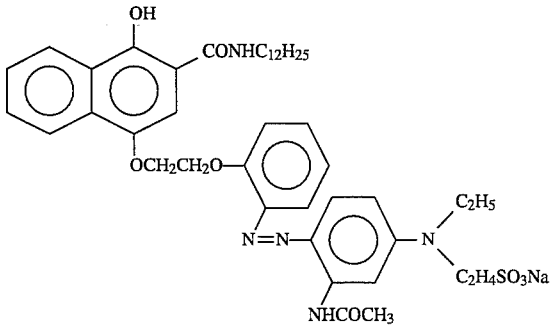
(YC-47)
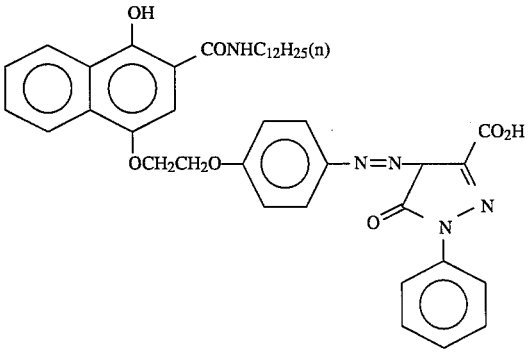
(YC-48)
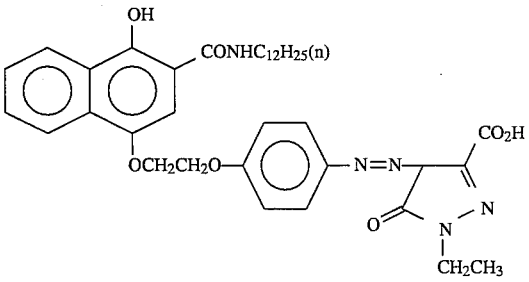
+R2

-continued
(YC-49)
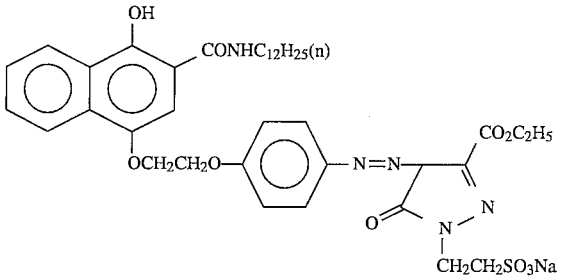
(YC-50)
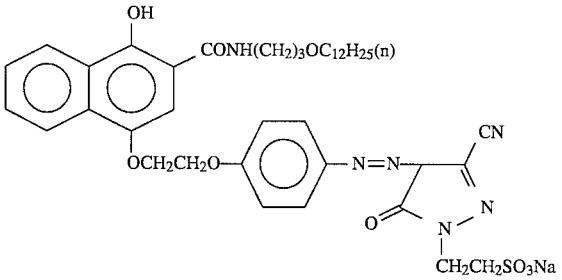
(YC-51)
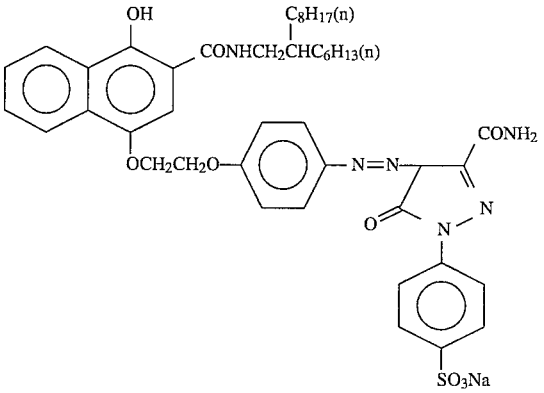
(YC-52)
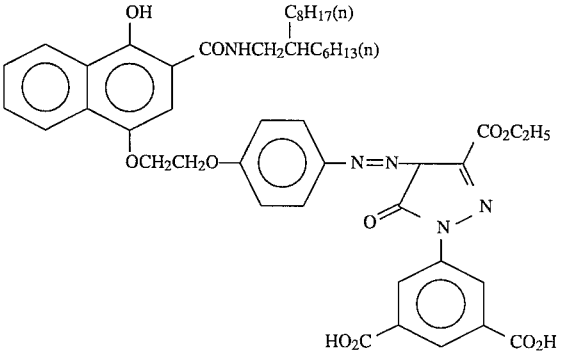
(YC-53)
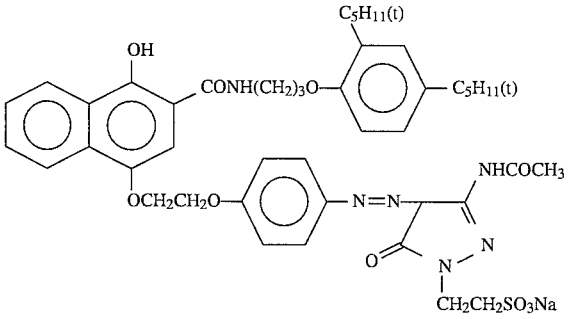

-continued
(YC-54)
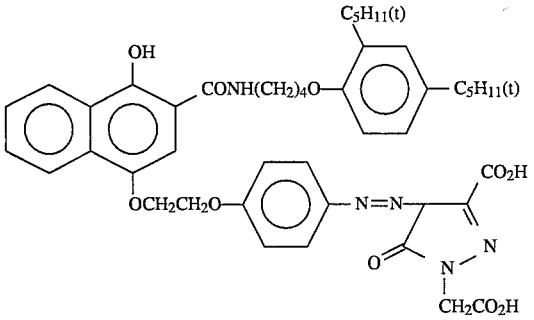
(YC-55)
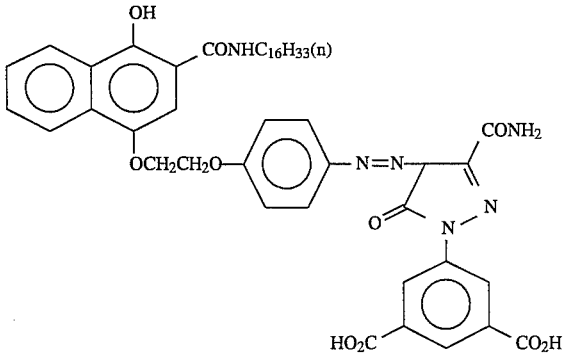
(YC-56)
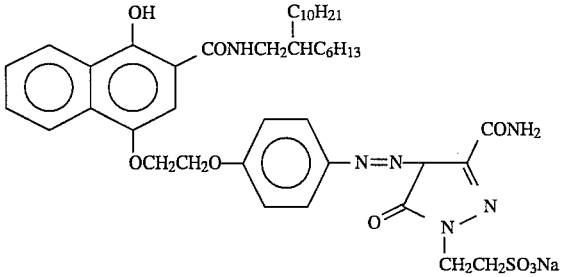
(YC-57)
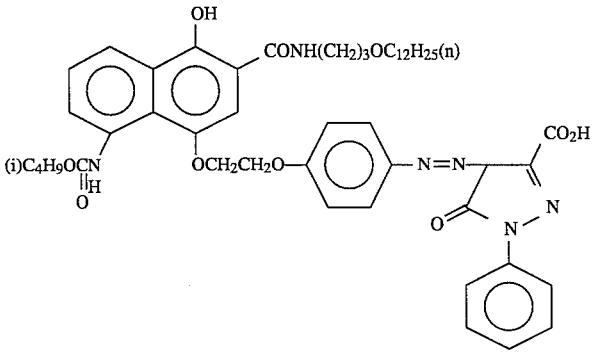

-continued
(YC-58)
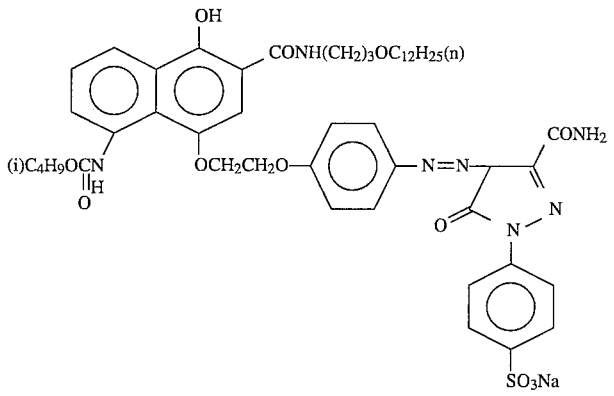
(YC-59)
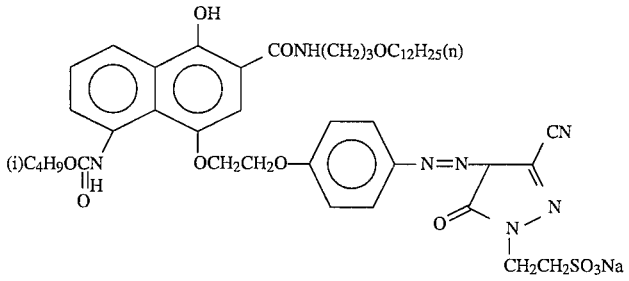
(YC-60)
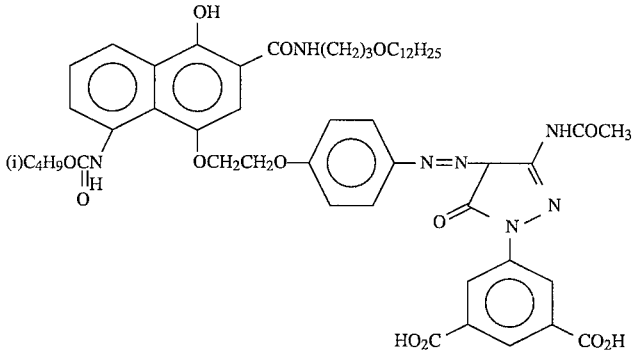
(YC-61)
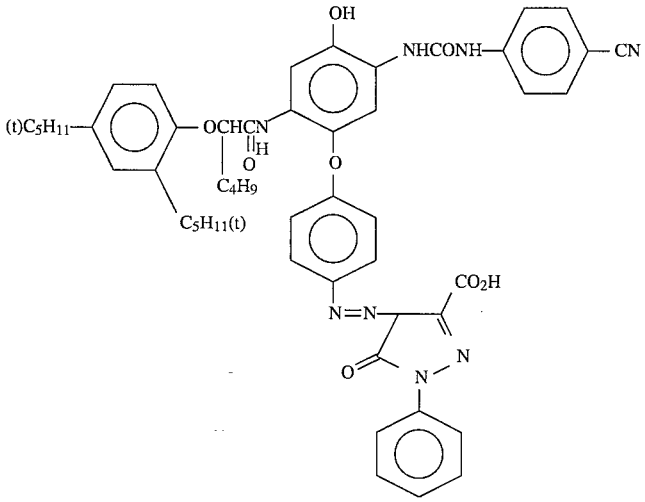

-continued
(YC-62)
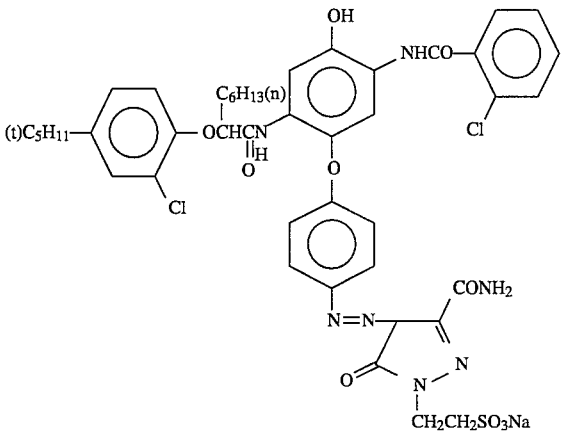
+R2
(YC-63)
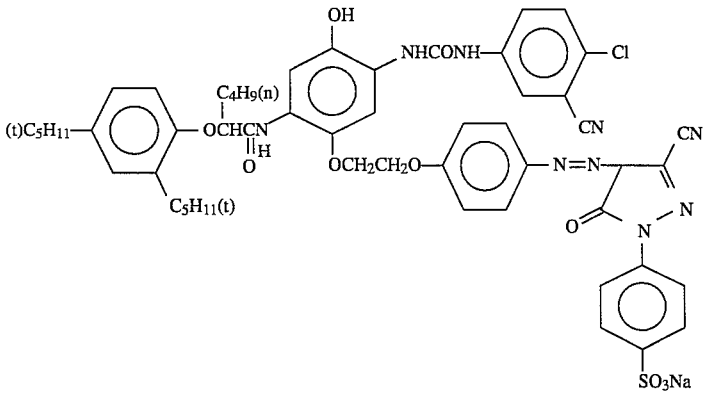
(YC-64)
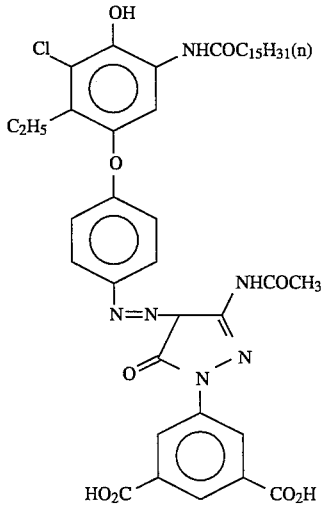

-continued
(YC-65)
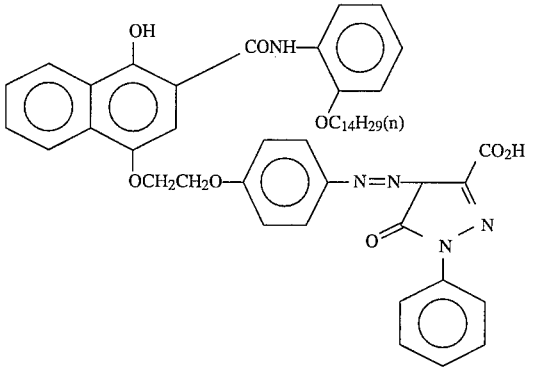
(YC-66)
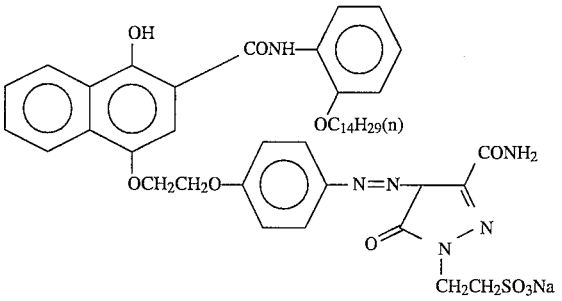
(YC-67)
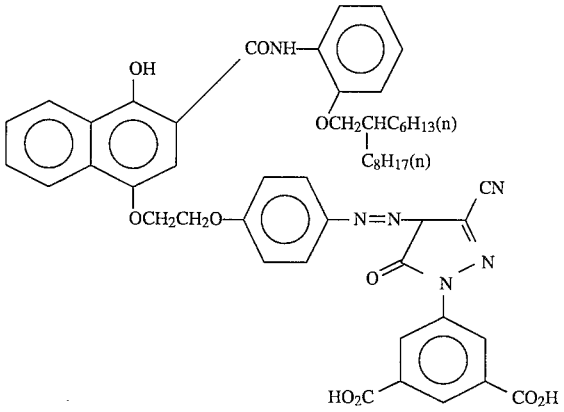
(YC-68)
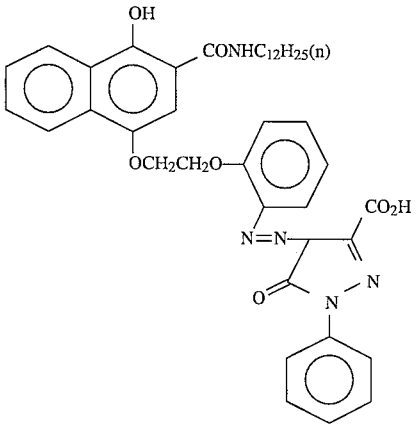

-continued
(YC-69)
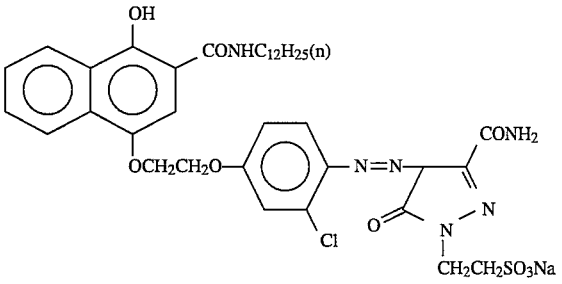
(YC-70)
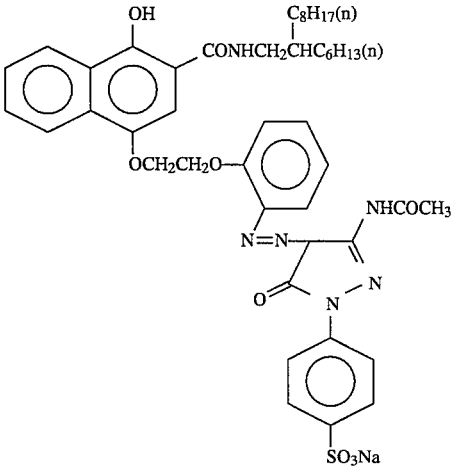
(YC-71)
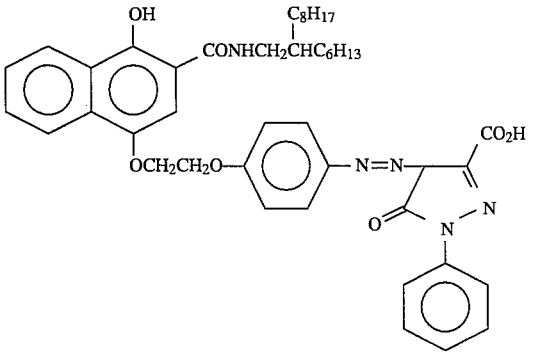
(YC-72)
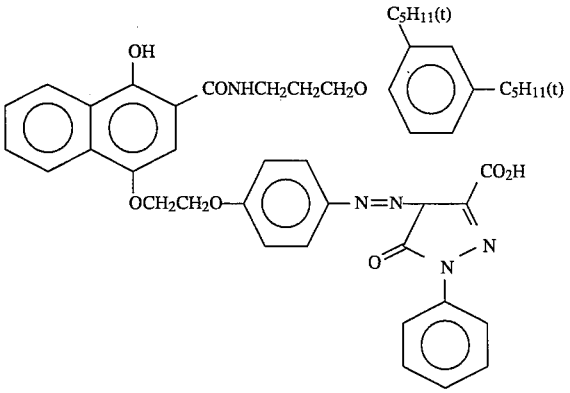

-continued
(YC-73)
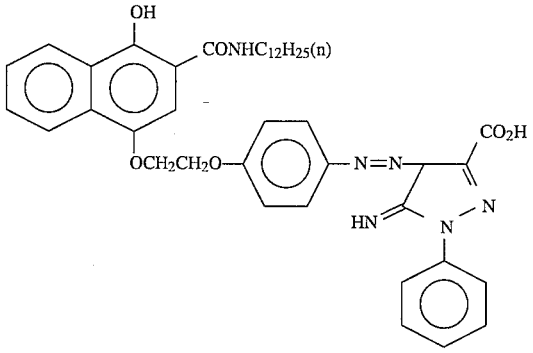
(YC-74)
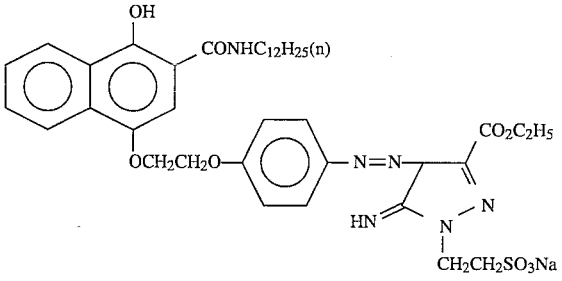
(YC-75)
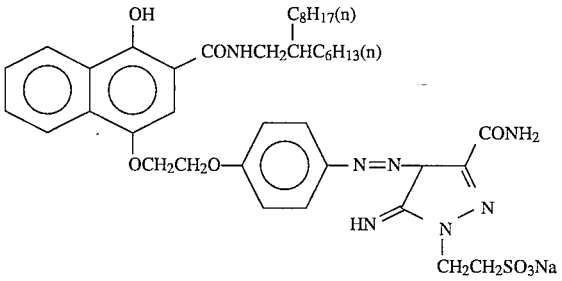
(YC-76)
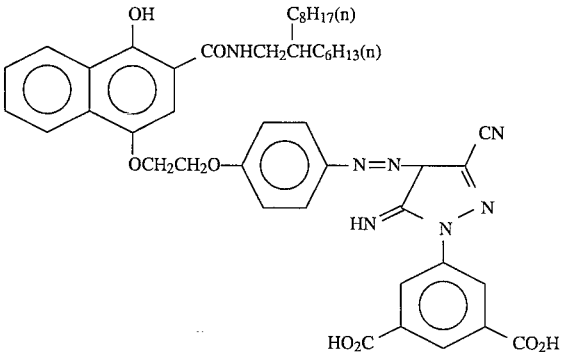
+R2
(YC-77)
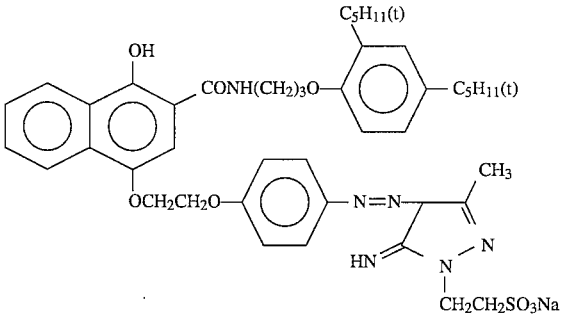

-continued
(YC-78)
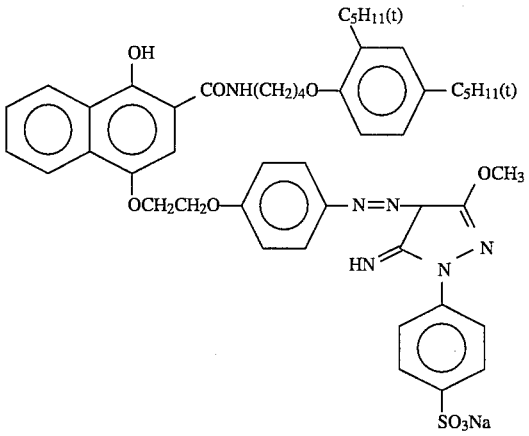
(YC-79)
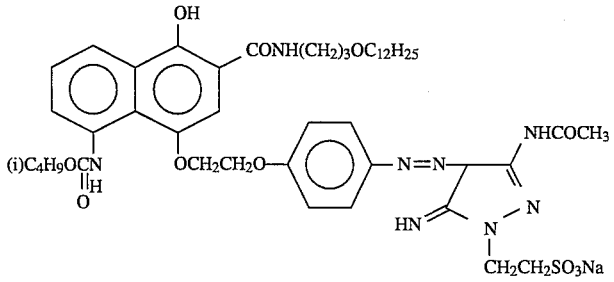
(YC-80)
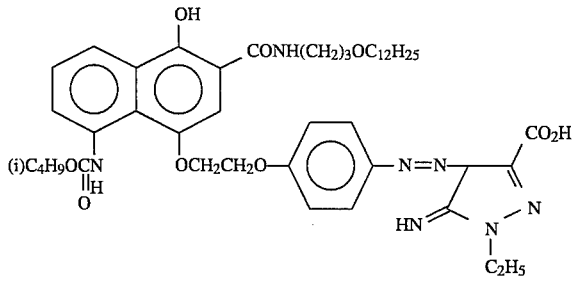
(YC-81)
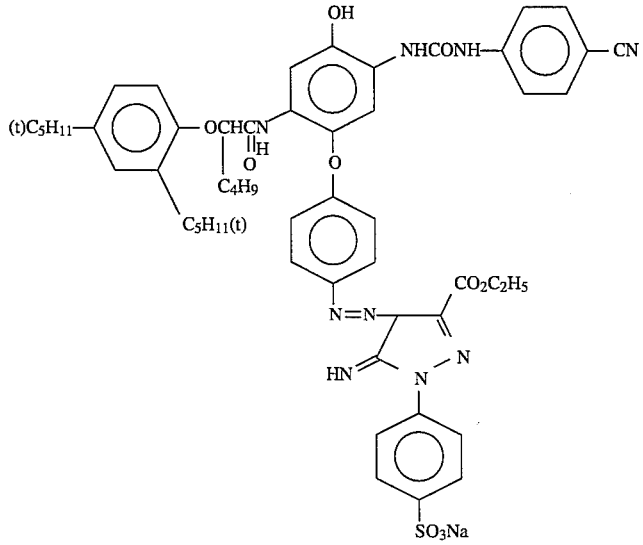

-continued
(YC-82)
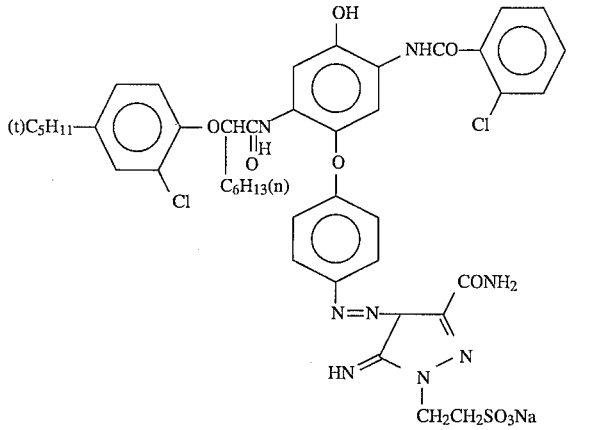
(YC-83)
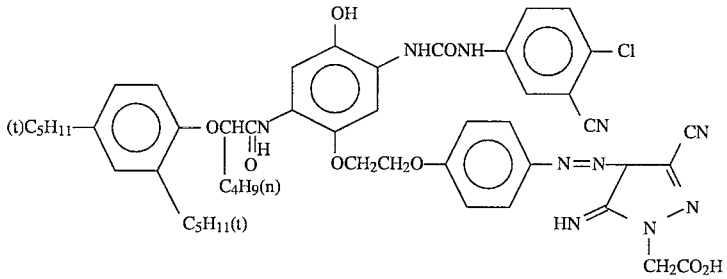
(YC-84)
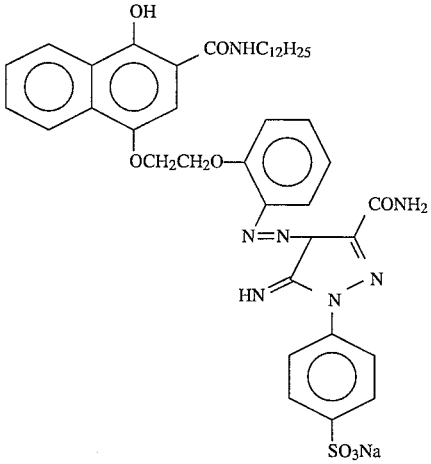
(YC-85)
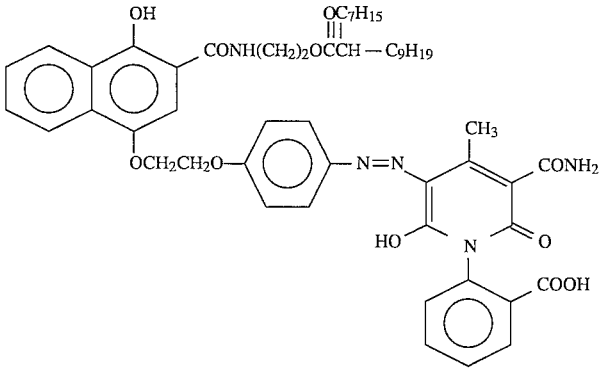

-continued
(YC-86)
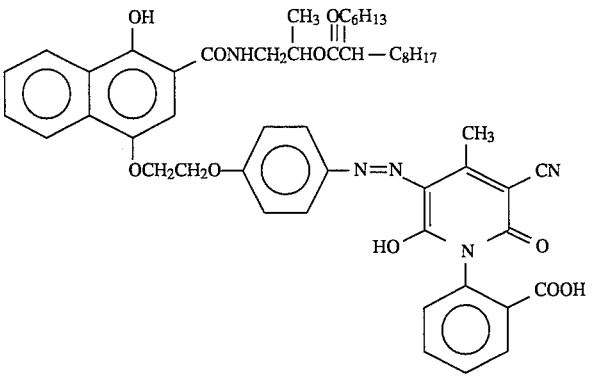
(YC-87)
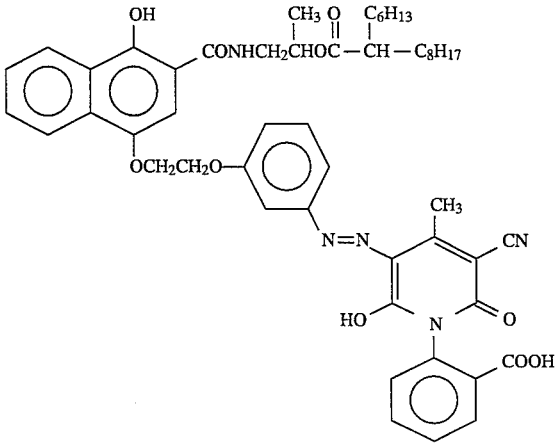
(YC-88)
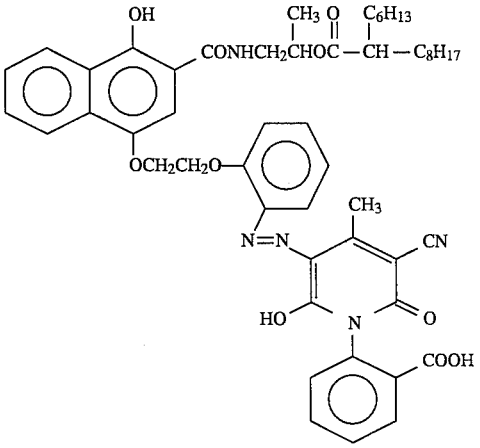
(YC-89)
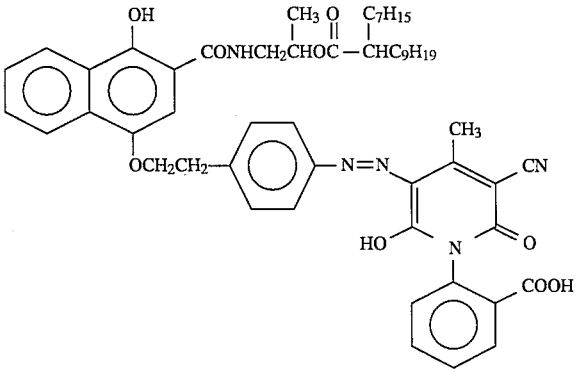

-continued

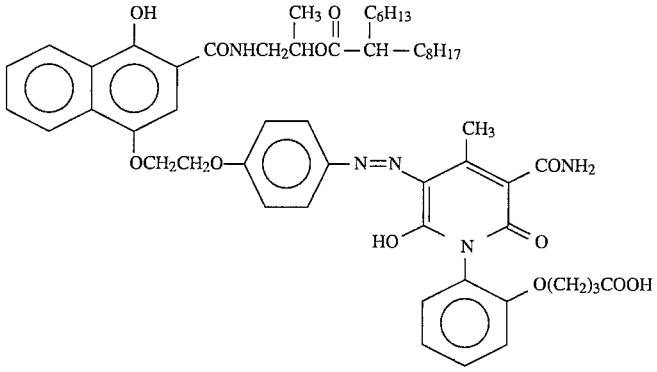

(YC-90)

The synthesis of the yellow-colored coupler of the present invention represented by the general formula (CI) can be normally accomplished by a diazo coupling reaction of a 6-hydroxy-2-pyridone with an aromatic diazonium salt or a heterocyclic diazonium salt having a coupler structure.

The synthesis of the former reaction component, i.e., the 6-hydroxy-2-pyridone, can be accomplished by any suitable method as disclosed in Klinsberg, (ed.) *Heterocyclic Compounds—Pyridine and Its Derivatives— Part III*, Interscience, (1962); *Journal of the American Chemical Society*, 1943, Vol. 65, page 449; *Journal of the Chemical Technology & Biotechnology*, 1986, Vol. 36, page 410; *Tetrahedron*, 1966, Vol. 22, page 445; JP-B-61-52827 (the term 37 JP-B" as used herein means an "examined Japanese patent publication"); West German Patents 2,162,612, 2,349,709, and 2,902,486; and U.S. Pat. No. 3,763,170.

The synthesis of the latter reaction component, i.e., the diazonium salt, can be accomplished by any suitable method as disclosed in U.S. Pat. Nos. 4,004,929, and 4,138,258, and JP-A-61-72244 and JP-A-61-273543.

The diazo coupling reaction of the 6-hydroxy-2-pyridone with the diazonium salt can be effected in a solvent such as methanol, ethanol, methyl cellosolve, acetic acid, N,N-dimethylformamide, N,N-dimethylacetamide, tetrahydrofuran, dioxane, water, or a mixture thereof. The base to be used in the reaction may be sodium acetate, potassium acetate, sodium carbonate, potassium carbonate, sodium hydrogencaronate, sodium hydroxide, potassium hydroxide, pyridine, triethylamine, tetramethylurea, tetramethyl guanidine or the like. The reaction temperature is normally in the range of −78° C. to 60° C., preferably −20° C. to 30° C.

Examples of the synthesis of yellow-colored couplers of the present invention will be set forth below.

SYNTHESIS EXAMPLE 1

Synthesis of Exemplary Coupler (YC-1)

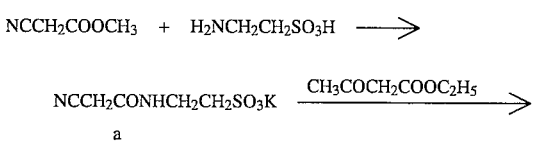

-continued

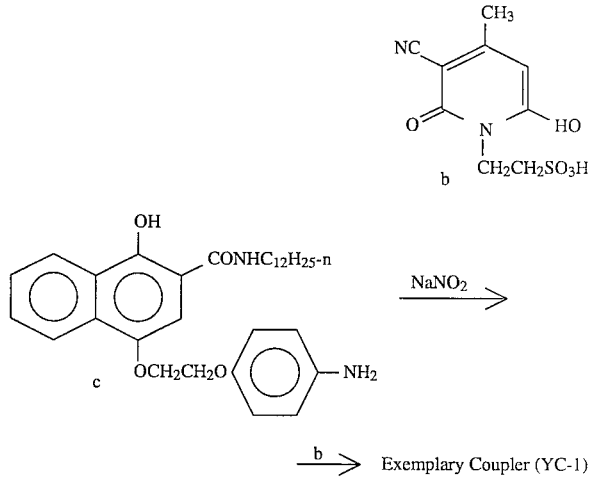

Synthesis of Compound a 500 ml of methanol was added to 125.2 g of taurine and 66 g of potassium hydroxide. The mixture was heated with stirring. 110 g of methyl cyanoacetate was added dropwise to the material over a period of about 1 hour. The material was heated under reflux for 5 hours, and then allowed to stand overnight. The resulting crystal was filtered off, washed with ethanol, and then dried to obtain 202.6 g of Compound a in a crystal form.

Synthesis of Compound b 11.5 ml of water was added to 11.5 g of Compound a and 3.5 g of potassium carbonate. 7.8 g of ethyl acetate was then added dropwise to the mixture under heating with stirring over a steam bath. The system was further stirred for 7 hours. After the system was allowed to cool, 9.2 ml of concentrated hydrochloric acid was added thereto with stirring to effect crystallization. The resulting crystal was filtered off, washed with methanol, and then dried to obtain 10.4 g of Compound b in a crystal form.

Synthesis of Exemplary Compound (YC-1)

10.1 g of Compound c prepared by the synthesis method described in U.S. Pat. No. 4,138,258 was dissolved in 60 ml of N,N-dimethylformamide and 60 ml of methyl cellosolve. 4.3 ml of concentrated hydrochloric acid was added to the solution under cooling with ice. A solution of 1.84 g of sodium nitrite in 5 ml of water was added dropwise to the system to prepare a solution of diazonium. 60 ml of methyl cellosolve and 20 ml of water were added to 7.8 g of Compound b and 8.2 g of sodium acetate. The diazonium solution was then added dropwise to the mixture with stirring under cooling with ice.

After the dropwise addition, the mixture was stirred further for 1 hour under ice-cooling, and then at room temperature for 2 hours. The resulting crystal was filtered off, washed with water, and then dried. The crystal was then dispersed in 500 ml of methanol. The dispersion was heated under reflux for 1 hour, and then allowed to cool. The crystal was filtered off, washed with methanol, and then dried to obtain 13.6 g of Exemplary Compound (YC-1) in the form of reddish crystal.

The melting point of the compound was 269° to 272° C. (decomposition). The structure of the compound was confirmed by $^1$H-NMR spectrum, mass spectrum and elementary analysis. The compound exhibited-a maximum absorption wavelength of 457.7 nm and a molecular extinction coefficient of 41,300 in methanol. Thus, the compound exhibited excellent spectral absorption characteristics as a yellow-colored coupler.

SYNTHESIS EXAMPLE 2

Synthesis of Exemplary Coupler (YC-3)

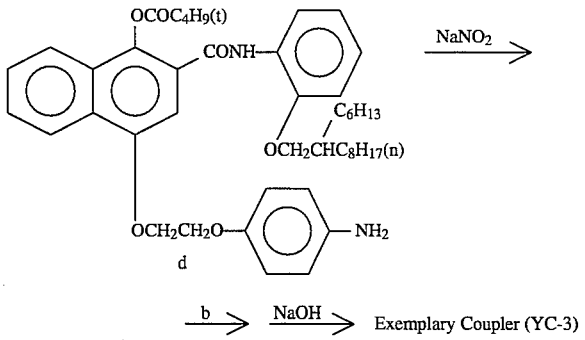

19.2 g of Compound d prepared by the synthesis method as described in JP-A-62-85242 was dissolved in 75 ml of N,N-dimethylformamide and 75 ml of methyl cellosolve. 5.6 ml of concentrated hydrochloric acid was added to the solution with stirring under cooling with ice. A solution of 2.5 g of sodium nitrite in 5 ml of water was added dropwise to the system. After the completion of the dropwise addition, the system was further stirred for 1 hour under ice-cooling and then for 1 hour at room temperature to prepare a diazonium solution.

75 ml of methyl cellosolve and 26 ml of water were added to 10.1 g of Compound b (prepared as in Synthesis Example 1) and 10.7 g of sodium acetate. The diazonium solution was then added to the system with stirring under cooling with ice. After the dropwise addition was completed, the system was further stirred for 1 hour under ice-cooling and then for 2 hours at room temperature. The resulting crystal was filtered off. The crystal was then dispersed in 200 ml of methanol. A solution of 2.2 g of sodium hydroxide in 10 ml of water was added dropwise to the dispersion. The material was stirred for 3 hours. The system was neutralized with concentrated hydrochloric acid. The resulting crystal was washed with water and then with methanol, and then dried. The resulting crude crystal was purified with heat methanol in the same manner as in Synthesis Example 1 to obtain 14.8 g of Exemplary Coupler (YC-3). The melting point of the compound was 246° to 251° C. (decomposition). The structure of the compound was confirmed by $^1$H-NMR spectrum, mass spectrum and elementary analysis. The compound exhibited a maximum absorption wavelength of 457.6 nm and a molecular extinction coefficient of 42,700 in methanol. Thus, the compound exhibited excellent spectral absorption characteristics as a yellow-colored coupler.

SYNTHESIS EXAMPLE 3

Synthesis of Exemplary Coupler (YC-30)

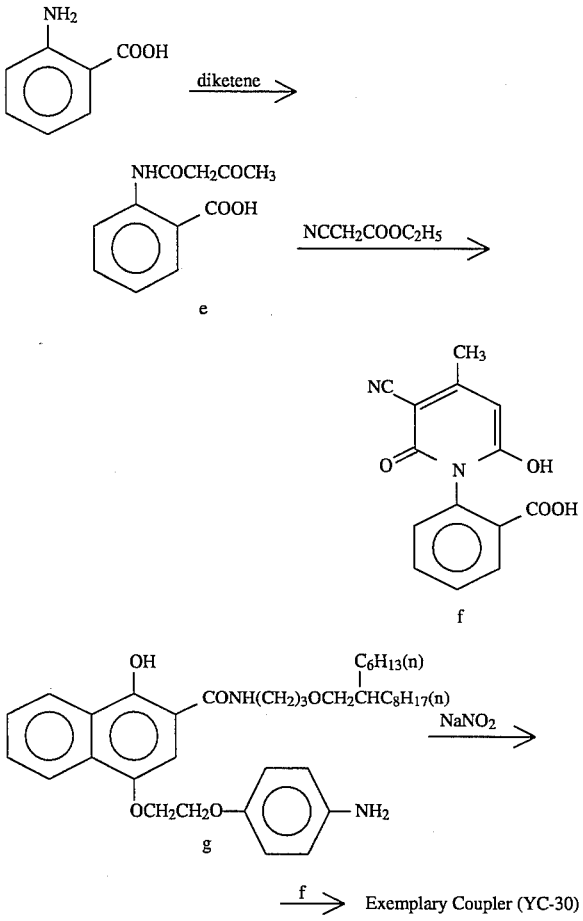

Synthesis of Compound e 137.1 g of anthranilic acid was added to 600 ml of acetonitrile. The mixture was heated with stirring. 92.5 g of diketene was added dropwise to the material over about 1 hour. The material was heated under reflux for 1 hour, and then cooled to room temperature. The resulting crystal was filtered off, washed with acetonitrile, and then dried to obtain 200.5 g of Compound e in a crystal form.

Synthesis of Compound f 199.1 g of Compound e, 89.2 g of ethyl cyanoacetate, and 344 g of 28% sodium methoxide were added to 0.9 l of methanol. The reaction mixture was allowed to undergo reaction in an autoclave at a temperature of 120° C. for 8 hours. After being allowed to stand overnight, the reaction mixture was then concentrated under reduced pressure. 700 ml of water was added to the system. 230 ml of concentrated hydrochloric acid was added to the system so that the system was acidified. The resulting crystal was withdrawn by filtration. The resulting crude crystal was washed with a mixture of ethyl acetate and acetonitrile at an elevated temperature to obtain 152 g of Compound f.

Synthesis of Exemplary Coupler (YC-30)

13.0 g of Compound g prepared by the synthesis method as described in U.S. Pat. No. 4,138,258 was dissolved in 40 ml of N,N-dimethylformamide. 4.5 ml of concentrated hydrochloric acid was added to the solution under cooling with ice. A solution of 1.48 g of sodium nitrite in 5 ml of water was added dropwise to the system to prepare a solution of diazonium. 20 ml of N,N-dimethylformamide and 15 ml of water were added to 6.0 g of Compound f and 8 g of sodium acetate. The diazonium solution was added dropwise to the system with stirring under cooling with ice. After the completion of the dropwise addition, the system was further stirred at room temperature for 30 minutes. The system was acidified with hydrochloric acid. The system was extracted with ethyl acetate, washed with water, and then concentrated under reduced pressure. The concentrate was recrystallized from a mixture of ethyl acetate and methanol to obtain 13 g of Exemplary Coupler (YC-30) in the form of a yellow crystal. The melting point of the coupler was 154° to 156° C. The structure of the compound was confirmed by $^1$H-NMR spectrum, mass spectrum and elementary analysis. The compound exhibited a maximum absorption wavelength of 458.2 nm and a molecular extinction coefficient of 42,800 in methanol. Thus, the compound exhibited excellent spectral absorption characteristics as a yellow-colored coupler.

SYNTHESIS EXAMPLE 4

Synthesis of Exemplary Coupler (YC-86)

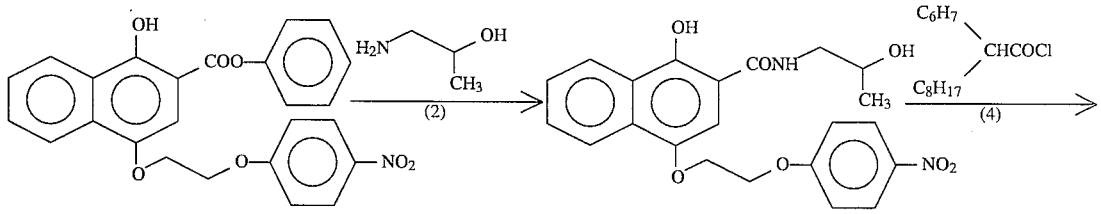

-continued

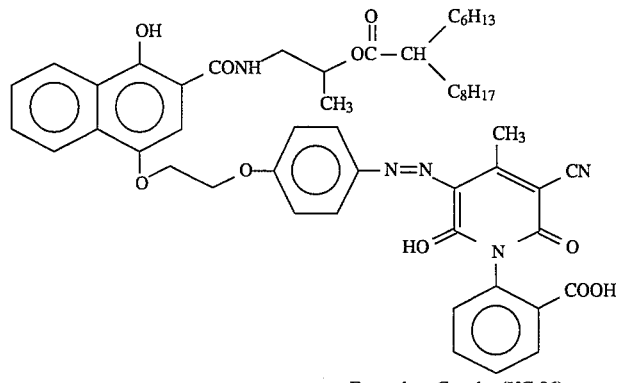

Exemplary Coupler (YC-86)

(1) Synthesis of Compound (3)

445.5 g of phenylester Compound (1) and 90.1 g of isopropanolamine (2) were heated in 600 ml of acetonitrile under reflux for 2 hours. After the system was cooled with water, the resulting crystal was filtered off, and then dried to obtain 342 g of Compound (3). (melting point (mp.) 162°–165° C.).

(2) Synthesis of Compound (5)

341 g of hydroxyl Compound (3) and 231 g of 2-hexyldecanoyl chloride were heated in 880 ml of acetonitrile under reflux for 2 hours. After the system was cooled with water, the resulting crystal was filtered off, and then dried to obtain 437 g of nitro Compound (5)(mp. 97°–100° C.).

(3) Synthesis of Compound (6)

370 g of nitro Compound (5), 6 g of 10% Pd-C catalyst, and 1 l of ethyl acetate were charged into an autoclave. The material was then hydrogenated at a temperature of 50° C. for 3 hours. After the completion of reduction, the catalyst was filtered off, and the filtrate was then concentrated under reduced pressure to obtain a residue which was then crystallized from n-hexane. The crystal was filtered off, and then dried to obtain 327 g of amine Compound (6)(mp. 95°–97° C.).

(4) Synthesis of Exemplary Coupler YC-86

20.8 g of amine Compound (6) was dissolved in 60 l of dimethylformamide. 7.6 ml of concentrated hydrochloric acid was added to the solution. An aqueous solution of 2.7 g of sodium nitrite in 10 ml of water was added dropwise to the system in 20 minutes. The system was further stirred for 30 minutes to prepare a diazo solution.

On the other hand, 9.7 g of pyridone Compound (7) and 13 g of sodium acetate were dissolved in a mixture of 30 ml of water and 30 ml of dimethylformamide at an elevated temperature. The system was then cooled with water. The diazo solution was gradually added to the system with stirring at a temperature of 10° C. or lower. The system was further stirred for 15 minutes. The system was then extracted with ethyl acetate. The system was washed with water three times. The organic phase was concentrated under reduced pressure. The residue was crystallized from methanol-ethylacetate. The resulting crystal was filtered off, and dried to obtain 21.2 g of Exemplary Coupler YC-86 (mp. 117°–119° C.).

SYNTHESIS EXAMPLE 5

Synthesis of Exemplary Coupler (YC-32)

The compound (YC-32) is prepared by the following reaction process.

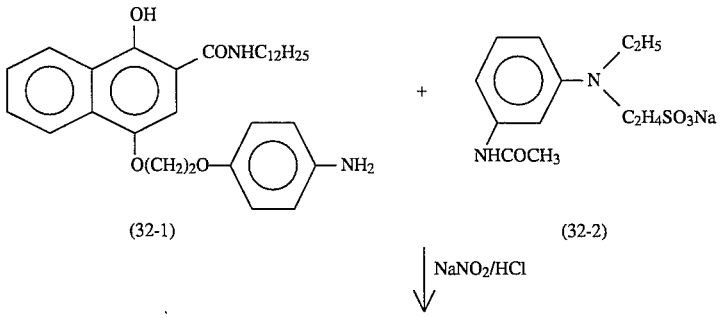

-continued

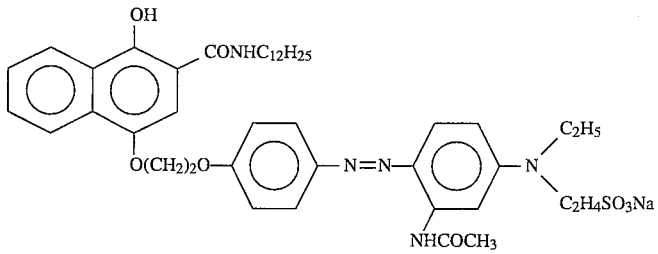

(YC-32)

Into a mixture solution of 30 ml of N,N-dimethylformamide and 50 ml of methylcellosolve, was dissolved 9.1 g of a compound (32-1) and cooled to 5° C. After an addition of 4 ml of hydrochloric acid solution to the solution, 4 ml of an aqueous solution containing 1.28 g of sodium nitrite was added dropwise thereto under stirring. Under the temperature of about 5° C., the reaction was continued for 20 minutes.

6.30 g of the compound (32-2) and 12 g of sodium acetate were dissolved into a mixture of 20 ml of methylcellosolve and 10 ml of water, and cooled to 10° C. To the solution thus obtained, the diazonium salt solution obtained according to the previous processes was added dropwise. After dropwise addition, the mixture was stirred for 10 minutes, and 300 ml of water was added over about 20 minutes. The precipitated crystal was recovered by filtration to obtain 11.3 g of (YC-32).

SYNTHESIS EXAMPLE 6

Synthesis of Exemplary Coupler (YC-47)

Compound (YC-47) is prepared by the following reaction process.

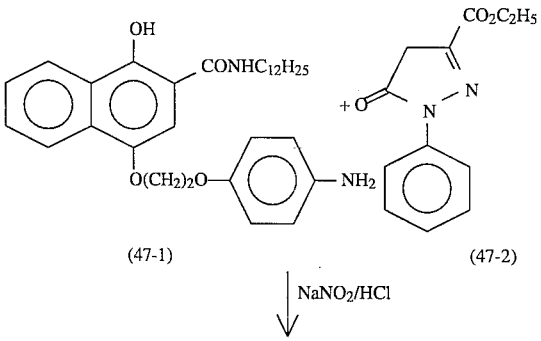

-continued

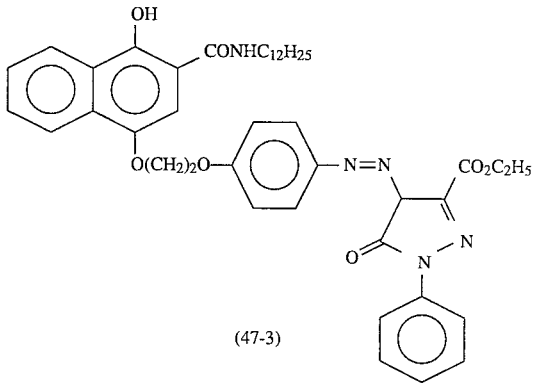

(47-3)

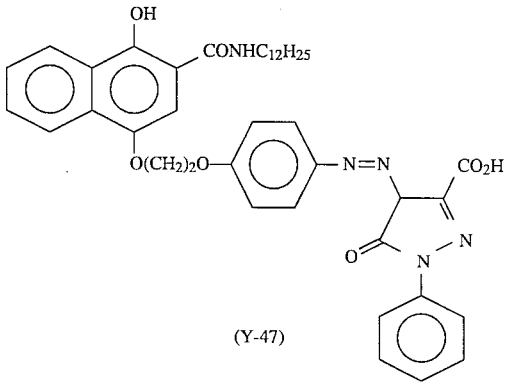

(Y-47)

Into a mixture solution of 150 ml of N,N-dimethylformamide and 90 ml of methylcellosolve, was dissolved 30.4 g of a compound (47-1) and was added 13 ml of hydrochloric acid. The solution thus obtained was cooled to 10° C. 15 ml of an aqueous solution containing 4.3 g of sodium nitrite was added dropwise thereto under stirring, over 30 minutes. Under the temperature of 10° C., the solution was stirred for 20 minutes. (Diazonium salt solution)

13.9 g of the compound (47-2) and 24.6 g of sodium acetate were dissolved into a mixture of 60 ml of methylcellosolve and 30 ml of water, and cooled to 10° C. To the solution thus obtained, the diazonium salt solution obtained in the above process was added dropwise over 1 hour. After dropwise addition, stirring finished to deposit oily precipitation. Supernatant liquid is removed by a decantation, and then 300 ml of acetonitrile was added to the residue and stirred. The precipitated crystal was filtered to obtain 26.2 g of the compound (47-3).

7 g of sodium hydroxide was dissolved in a mixture of 80 ml of water and 80 ml of methanol. 26.2 g of (47-3) was dissolved thereto and heated 45° C. with stirring.

After 15 minutes, the compound (47-3) was dissolved and then continued the reaction for 1 hour. After cooling to the room temperature, a mixture of 16.5 ml of hydrochloric acid and 50 ml of water was added dropwise. After 30 minutes stirring, precipitated crystal was filtered to obtain 25.0 g of the compound (YC-47).

The synthesis of yellow-colored cyan couplers represented by the general formulae (CII) to (CIV) can be accomplished by any suitable method as described in JP-B-58-6939, JP-A-1-197563, and those described for the method for synthesis of couplers of the general formula (CI) in the above cited patents.

In the present invention, yellow-colored cyan couplers as disclosed in the above cited JP-A-61-221748 and JP-A-1-319744 and yellow-colored cyan couplers represented by the general formulae (CI) to (CIV) can be used. The couplers represented by the general formulae (CI) to (CIV) are better than those described in the above cited JP-A-61-221748 and JP-A-1-319744 in view of their coupling activity and molecular extinction coefficient. Among the general formulae (CI) to (CIV), the couplers of general formulae (CI) and (CII) are better than those of general formulae (CIII) and (CIV). The yellow colored cyan couplers represented by the general formula (CI) are most preferable.

The yellow colored cyan coupler is preferably incorporated in a light-sensitive silver halide emulsion layer or in an adjacent layer thereto, particularly a red-sensitive emulsion layer, in a light-sensitive material. The total amount of the yellow-colored cyan coupler to be incorporated in the light-sensitive material can be from 0.005 to 0.30 g/m$^2$, preferably 0.02 to 0.20 g/m$^2$, more preferably 0.03 to 0.15 g/m$^2$.

The incorporation of the yellow-colored cyan coupler can be accomplished in the same manner as conventional couplers as described hereinafter.

The compound capable of releasing a bleaching accelerator or a precursor thereof on reaction with an oxidation product of an aromatic primary amine developing agent (hereinafter simply referred to as a bleaching accelerator-releasing compound) which can be used in the present invention is explained in detail below.

The bleaching accelerator-releasing compounds to be used preferably include those represented by formula (I):

$$A—(L_2)_p—Z \qquad (I)$$

wherein A represents a group whose bond to $(L_2)_p$—Z is cleaved on reacting with an oxidation product of a developing agent; $L_2$ represents a timing group or a group whose bond to Z is cleaved on reacting with an oxidation product of a developing agent; p represents 0 or an integer of from 1 to 3; where p is 2 or more, the plural $L_2$ groups may be the same or different; and Z represents a group which manifests a bleaching accelerating effect on the cleaving of its bond to A— $(L_2)_p$.

Of the compounds of formula (I), those represented by formula (I') are more preferred:

$$A—(L_{21})_a—(L_{22})_b—Z \qquad (I')$$

wherein A represents a group whose bond to $(L_{21})_a$—$(L_{22})_b$— Z is cleaved on reacting with an oxidation product of a developing agent; $L_{21}$ represents a timing group or a group whose bond to $(L_{22})_b$—Z is cleaved on reacting with an oxidation product of a developing agent; $L_{22}$ represents a timing group or a group whose bond to Z is cleaved on reacting with an oxidation product of a developing agent; Z represents a group which manifests a bleaching accelerating effect on the cleaving of its bond to A—$(L_{21})_a$—$(L_{22})_b$; and a and b each represents 0 or 1.

In formulae (I) and (I'), the group represented by A includes a coupler group and a redox group.

The coupler group represented by A includes various known groups, for example, of yellow couplers (e.g., open-chain ketomethylene couplers), magenta couplers (e.g., 5-pyrazolone couplers, pyrazoloimidazole couplers, pyrazolotriazole couplers), cyan couplers (e.g., phenol couplers, naphthol couplers), and colorless couplers (e.g., indanone couplers, acetonephenone couplers). Groups derived from heterocyclic couplers described in U.S. Pat. Nos. 4,315,070, 4,183,752, 3,961,959, and 4,171,223 may also be used.

Of these coupler groups as A, those represented by formulae (Cp-11) to (Cp-20) shown below are preferred because of their high rate of coupling.

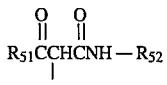
(Cp-11)

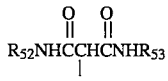
(Cp-12)

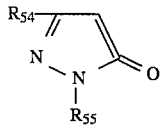
(Cp-13)

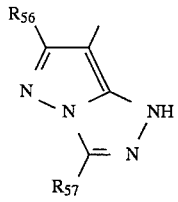
(Cp-14)

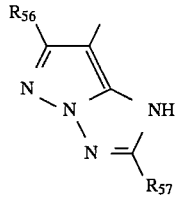
(Cp-15)

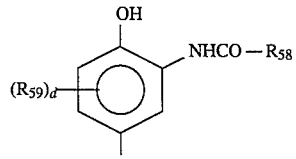
(Cp-16)

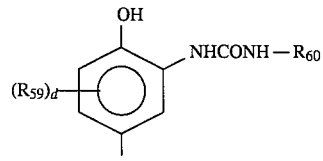
(Cp-17)

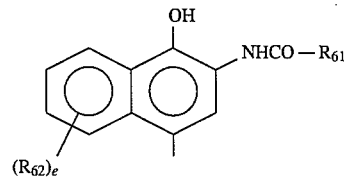
(Cp-18)

-continued (Cp-19)

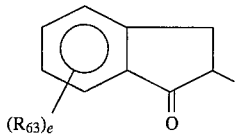

(Cp-20)

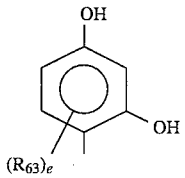

wherein the free bond extending from the coupling position indicates the position where the coupling releasable group is bonded.

In formulae (Cp-11 to 20), where $R_{51}$, $R_{52}$, $R_{53}$, $R_{54}$, $R_{55}$, $R_{56}$, $R_{57}$, $R_{58}$,$R_{59}$, $R_{60}$, $R_{61}$, $R_{62}$, or $R_{63}$ contains a nondiffusing group which provides the compound with immobility in a hydrophilic colloidal layer, each of these groups $R_{51}$ to $R_{63}$ is selected so that its total number of carbon atoms may be from 8 to 40, and preferably from 10 to 30. Otherwise, the total number of carbon atoms is preferably not more than 15. In polymer type couplers inclusive of dimers and telomers, any of these groups represents a divalent group for linking a repeating unit, etc. This being the case, the total number of carbon atoms may be out side the above-recited range.

In the following definitions of $R_{51}$ to $R_{63}$, d, and e, $R_{41}$ represents an aliphatic group, an aromatic group, or a heterocyclic group; $R_{42}$ represents an aromatic group or a heterocyclic group; and $R_{43}$, $R_{44}$, and $R_{45}$ each represents a hydrogen atom, an aliphatic group, an aromatic group, or a heterocyclic group.

$R_{51}$ has the same meaning as $R_{41}$. $R_{52}$ and $R_{53}$ each have the same meaning as $R_{42}$. $R_{54}$ has the same meaning as $R_{41}$ or represents $R_{41}CON(R_{43})$—, $(R_{41})(R_{43})N$—, $R_{41}SO_2N(R_{43})$—, $R_{41}S$—, $R_{43}O$—, $(R_{43})(R_{45})NCON(R_{44})$—, or N≡C—. $R_{55}$ has the same meaning as $R_{41}$. $R_{56}$ and $R_{57}$ each have the same meaning as $R_{43}$ or represents $R_{41}S$—, $R_{43}O$—, $R_{41}CON(R_{43})$—, or $R_{41}SO_2N(R_{43})$—. $R_{58}$ has the same meaning as $R_{41}$. $R_{59}$ has the same meaning as $R_{41}$ or represents $R_{41}CON(R_{43})$—, $R_{41}OCON(R_{43})$—, $R_{41}SO_2N(R_{43})$—, $(R_{43})(R_{44})NCON$—$(R_{45})$—, $R_{41}O$—, $R_{41}S$—, a halogen atom, or $(R_{41})(R_{43})N$—. d represents 0 or an integer of from 1 to 3. Where d is 2 or more, the plural $R_{59}$ groups may be the same or different, or each of them may represent a divalent group and be connected together to form a cyclic structure. Typical examples of such a cyclic structure are:

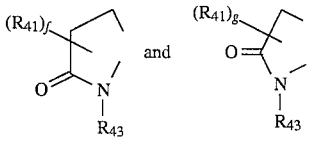

wherein f represents 0 or an integer of from 1 to 4; and g represents 0 or an integer of 1 or 2.

$R_{60}$ has the same meaning as $R_{41}$. $R_{61}$ has the same meaning as $R_{41}$. $R_{62}$ has the same meaning as $R_{41}$ or represents $R_{41}CONH$—, $R_{41}OCONH$—, $R_{41}SO_2NH$—, $(R_{43})(R_{44})NCON$—$(R_{45})$—, $(R_{43})(R_{44})NSO_2N(R_{45})$—, $R_{43}O$—, $R_{41}S$—, a halogen atom, or $(R_{41})(R_{43})N$—. $R_{63}$ has the same meaning as $R_{41}$ or represents $(R_{43})(R_{44})NCON(R_{45})$—, $(R_{43})(R_{44})NCO$—, $R_{41}SO_2N$—$(R_{44})$—, $(R_{43})(R_{44})NSO_2$—, $R_{41}SO_2$—, $R_{43}OCO$—, $R_{43}O$—$SO_2$—, a halogen atom, a nitro group, a cyano group, or $R_{43}CO$—. e represents 0 or an integer of from 1 to 4. Where e is 2 or more, the plural $R_{62}$ or $R_{63}$ groups may be the same or different.

The expression "aliphatic group" as used above means a saturated or unsaturated, acyclic or cyclic, straight chain or branched, substituted or unsubstituted aliphatic hydrocarbon group having from 1 to 32, and preferably from 1 to 22, carbon atoms. Typical examples of the aliphatic group are methyl, ethyl, propyl, isopropyl, butyl, t-butyl, i-butyl, t-amyl, hexyl, cyclohexyl, 2-ethylhexyl, octyl, 1,1,3,3-tetramethylbutyl, decyl, dodecyl, hexadecyl and octadecyl groups.

The expression "aromatic group" as used above means an aromatic group having from 6 to 20 carbon atoms, and preferably a substituted or unsubstituted phenyl group or a substituted or unsubstituted naphthyl group.

The expression "heterocyclic group" as used above means a substituted or unsubstituted heterocyclic group having from 1 to 20, and preferably from 1 to 7, carbon atoms, containing a hetero atom selected from a nitrogen atom, an oxygen atom, and a sulfur atom, and preferably consisting of 3 to 8 members. Typical examples of such a heterocyclic group are 2-pyridyl, 2-thienyl, 2-furyl, 1-imidazolyl, 1-indolyl, phthalimido, 1,3,4-thiadiazol-2-yl, 2-quinolyl, 2,4-dioxo-1,3-imidazolidin- 5-yl, 2,4-dioxo-1,3-imidazolidin-3-yl, succinimido, 1,2,4-triazol-2-yl, and 1-pyrazolyl groups.

Where these aliphatic hydrocarbon groups, aromatic groups, and heterocyclic groups have a substituent, typical substituents include a halogen atom, $R_{47}O$—, $R_{46}S$—, $R_{47}CON(R_{48})$—, $(R_{47})(R_{48})NCO$—, $R_{46}OCON$ $(R_{47})$—, $R_{46}SO_2N(R_{47})$—, $(R_{47})(R_{48})NSO_2$—, $R_{46}SO_2$—, $R_{47}OCO$—, $(R_{47})(R_{48})NCON(R_{49})$—, $R_{46}$, a group of formula:

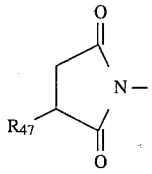

$R_{46}COO$—, $R_{47}OSO_2$—, a cyano group, and a nitro group; wherein $R_{46}$ represents an aliphatic group, an aromatic group, or a heterocyclic group; and $R_{47}$, $R_{48}$, and $R_{49}$ each represents an aliphatic group, an aromatic group, a heterocyclic group, or a hydrogen atom (the expressions "aliphatic group", "aromatic group" and "heterocyclic group" having the same meanings as defined above).

$R_{51}$ preferably represents an aliphatic group or an aromatic group. $R_{52}$, $R_{53}$, and $R_{55}$ each preferably represents an aromatic group. $R_{54}$ preferably represents $R_{41}CONH$— or $(R_{41})(R_{43})N$—. $R_{56}$ and $R_{57}$ each preferably represents an aliphatic group, $R_{41}O$—, or $R_{41}S$—. $R_{58}$ preferably represents an aliphatic group or an aromatic group.

In formula (Cp-16), $R_{59}$ preferably represents a chlorine atom, an aliphatic group, or $R_{41}CONH$—; d preferably represents 1 or 2; and $R_{60}$ preferably represents an aromatic group.

In formula (Cp-17), $R_{59}$ is preferably $R_{41}CONH$—; d is preferably 1; and $R_{61}$ is preferably an aliphatic group or an aromatic group.

In formula (Cp-18), e is preferably 0 or 1; and $R_{62}$ is preferably $R_{41}OCONH$—, $R_{41}CONH$—, or $R_{41}SO_2NH$—, which is preferably at the 5-position of the naphthol ring.

In formula (Cp-19), $R_{63}$ is preferably $R_{41}CONH$—, $R_{41}SO_2NH$—, $(R_{41})(R_{43})NSO_2$—, $R_{41}SO2$—, $(R_{41})(R_{43})NCO$—, a nitro group, or a cyano group.

In formula (Cp-20), $R_{63}$ is preferably $(R_{43})_2NCO$—, $R_{43}CCO$—, or $R_{43}CO$—.

$R_{51}$ typically includes t-butyl, 4-methoxyphenyl, phenyl, 3-{2(2,4-di-t-amylphenoxy)butanamido}phenyl, and methyl groups. $R_{52}$ and $R_{53}$ typically include 2-chloro-5-dodecyloxycarbonylphenyl, 2-chloro-5-hexadecylsulfonamidophenyl, 2-chloro-5-tetradecaneamidophenyl, 2-chloro-5-{4-(2,4-di-t-amylphenyl)butanamido}phenyl, 2-chloro-5-{2-(2,4-di-t-amylphenoxy)butanamido}phenyl, 2-methoxyphenyl, 2-methoxy-5-tetradecyloxycarbonylphenyl, 2-chloro-5-(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl, and 2-ethoxyphenyl groups.

$R_{54}$ typically includes 3-{2-(2,4-di-t-amylphenoxy)butanamido}benzamido, 3-{4-(2,4-di-t-amylphenoxy)butanamido}benzamido, 2-chloro-5-tetradecaneamidoanilino, 5-(2,4-di-t-amylphenoxyacetamido)benzamido, 2-chloro-5-dodecenylsuccinimidoanilino, 2-chloro-5-(2-(3-t-butyl-4-hydroxyphenoxy)tetradecaneamido}-anilino, 2,2-dimethylpropanamido, 2-(3-pentadecylphenoxy)butanamido, pyrrolidino, and N,N-dibutylamino groups.

$R_{55}$ preferably includes 2,4,6-trichlorophenyl, 2-chlorophenyl, 2,5-dichlorophenyl, 2,3-dichlorophenyl, 2,6-dichloro-4-methoxyphenyl, 4-{2- (2,4-di-t-amylphenoxy)butanamido} phenyl, and 2,6-dichloro-4-methanesulfonylphenyl groups.

$R_{56}$ typically includes methyl, ethyl, isopropyl, methoxy, ethoxy, methylthio, ethylthio, 3-phenylureido, and 3- (2,4-di-t-amylphenoxy) propyl groups.

$R_{57}$ typically includes 3- (2,4-di-t-amylphenoxy)propyl, 3-[4-{2-[4-(4-hydroxyphenylsulfonyl)phenoxy] tetradecaneamido}phenyl]propyl, methoxy, methylthio, ethylthio, methyl, 1-methyl-2- (2-octyloxy-5-[2-octyloxy- 5-(1,1,3,3-tetramethylbutyl) phenylsulfonamido]-phenylsulfonamido]ethyl, 3-{4-(4-dodecyloxyphenylsulfonamido)phenyl}propyl, 1,1-dimethyl-2-(2-octyloxy-5-( 1,1,3,3-tetramethylbutyl)phenylsulfonamido)ethyl, and dodecylthio groups.

$R_{58}$ typically include 2-chlorophenyl, pentafluorophenyl, heptafluoropropyl, 1-(2,4-di-t-amylphenoxy)propyl, 3-(2,4-di-t-amylphenoxy)propyl, 2,4-di-t-amylmethyl, and furyl groups.

$R_{59}$ typically includes a chlorine atom, and methyl, ethyl, propyl, butyl, isopropyl, 2-(2,4-di-t-amylphenoxy)butanamido, 2-(2,4-di-t-amylphenoxy)hexanamido, 2-(2,4-di-t-octylphenoxy)octanamido, 2-(2-chlorophenoxy)tetradecaneamido, 2-{4-(4-hydroxyphenylsulfonyl)phenoxy}tetradecaneamido, and 2-{2-(2,4-di-t-amylphenoxyacetamido)phenoxy} butanamido groups.

$R_{60}$ typically includes 4-cyanophenyl, 2-cyanophenyl, 4-butylsulfonylphenyl, 4-propylsulfonylphenyl, 4-chloro-3-cyanophenyl, 4-ethoxycarbonylphenyl, and 3,4-dichlorophenyl groups.

$R_{61}$ typically includes dodecyl, hexadecyl, cyclohexyl, 3-(2,4-di-t-amylphenoxy) propyl, 4-(2,4-di-t-amylphenoxy) butyl, 3-dodecyloxypropyl, t-butyl, 2-methoxy- 5-dodecyloxycarbonylphenyl, and 1-naphthyl groups.

$R_{62}$ typically includes isobutyloxycarbonylamino, ethoxycarbonylamino, phenylsulfonylamino, methanesulfonamido, benzamido, trifluoroacetamido, 3-phenylureido, butoxycarbonylamino, and acetamido groups.

$R_{63}$ typically includes 2,4-di-t-amylphenoxyacetamido, 2-(2,4-di-t-amylphenoxy)butanamido, hexadecylsulfonamido, N-methyl-N-octadecylsulfamoyl, N,N-dioctylsulfamoyl, 4-t-octylbenzoyl, and dodecyloxycarbonyl groups, a chlorine atom, and nitro, cyano, N-{4-(2,4-di-t-amylphenoxy)butyl}carbamoyl, N-3-(2,4-di-t-amylphenoxy)propylsulfamoyl, methanesulfonyl, and hexadecylsulfonyl groups.

In formula (I) or (I'), the redox group represented by A is specifically represented by formula (II):

$$A_1—P—(X_2=Y)_n—Q_2—A_2 \quad \text{(II)}$$

wherein P and $Q_2$ each represents an oxygen atom or a substituted or unsubstituted imino group; at least one of n $X_2$ and n Y represents a methine group having $—(L_{21})_a—(L_{22})_b—Z$ as a substituent, with the other $X_2$ and Y each representing a substituted or unsubstituted methine group or a nitrogen atom; n represents an integer of from 1 to 3; where n is 2 or more, the plural X or Y groups may be the same or different; $A_1$ and $A_2$ each represents a hydrogen atom or a group removable with an alkali (hereinafter referred to as a precursor group); or any two of P, $X_2$, Y, $Q_2$, $A_1$, and $A_2$ each represents a divalent group which together form a cyclic structure (e.g., $(X_2=Y)_n$ forms a benzene ring, a pyridine ring, etc.).

The imino group represented by P or $Q_2$ is preferably an imino group substituted with a sulfonyl group or an acyl group represented by formula (N-1) or (N-2), respectively:

$$\begin{array}{l} * —N— ** \\ \quad\;\; | \\ \quad\;\; SO_2—G \end{array} \quad \text{(N-1)}$$

$$\begin{array}{l} * —N— ** \\ \quad\;\; | \\ \quad\;\; CO—G \end{array} \quad \text{(N-2)}$$

wherein * indicates the position for bonding to $A_1$ or A2; ** indicates the position for bonding to one of the free bonds of $—(X_2=Y)_n—$; G preferably represents a straight chain or branched, acyclic or cyclic, saturated or unsaturated, substituted or unsubstituted aliphatic group having from 1 to 32 carbon atoms, and preferably from 1 to 22 carbon atoms (e.g., methyl, ethyl, benzyl, phenoxybutyl, isopropyl), a substituted or unsubstituted aromatic group having from 6 to 10 carbon atoms (e.g., phenyl, 4-methylphenyl, 1-naphthyl, 4-dodecyloxyphenyl), or a 4- to 7-membered heterocyclic group containing a hetero atom selected from N, O and S atoms (e.g., 2-pyridyl, 1-phenyl-4-imidazolyl, 2-furyl, benzothienyl).

In formula (II), P and $Q_2$ each preferably represents an oxygen atom or a substituted imino group of formula (N-1).

The precursor group represented by $A_1$ or $A_2$ which is removed by alkali preferably includes a hydrolyzable group, e.g., an acyl group, an alkoxycarbonyl group, an aryloxycarbonyl group, a carbamoyl group, or a sulfonyl group; a precursor group of the type utilizing a reverse Michael reaction as described in U.S. Pat. No. 4,009,029; a precursor group of the type utilizing, as an intramolecular nucleophilic group, an anion generated after ring cleavage as described in U.S. Pat. No. 4,310,612; a precursor group which induces a split reaction through electron transfer of an anion via a conjugated system as described in U.S. Pat. Nos. 3,674,478, 3,932,480, and 3,993,661; a precursor group which induces a cleavage reaction through electron transfer of an anion generated after ring cleavage as described in U.S. Pat. No. 4,335,200, and a precursor group which utilizes an imidomethyl group as described in U.S. Pat. Nos. 4,363,865 and 4,410,618.

Of the groups of formula (II), those are preferred wherein P is an oxygen atom, and $A_2$ is a hydrogen atom. The groups in which $X_2$ and Y each represents a substituted or unsubstituted methine group are particularly preferred, with the previously noted proviso that at least one of the n $X_2$ and n Y groups represents a methine group substituted with $—(L_{21})_a—(L22)_b—Z$.

Particularly preferred of the groups of formula (II) are those represented by formula (III) or (IV):

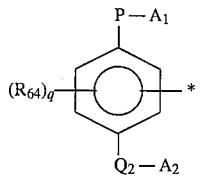

(III)

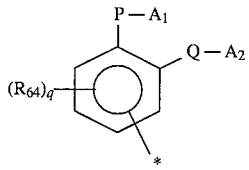

(IV)

wherein * indicates the position at which $—(L_{21})_a—(L_{22})_b—Z$ of formula (II) is bonded; P, $Q_2$, $A_1$, and $A_2$ are as defined above; $R_{64}$ represents a substituent; q represents 0 or an integer of from 1 to 3; where q is 2 or more, the plural $R_{64}$ groups may be the same or different, or where two $R_{64}$ groups are on carbon atoms adjacent to each other, they each represent a divalent group and are connected together to form a cyclic structure condensed to the benzene ring.

The condensed benzene ring formed by $R_{64}$ includes naphthalene, benzonorbornane, chroman, indole, benzothiophene, quinoline, benzofuran, 2,3-dihydrobenzofuran, indane, and indene rings, each of which may have a substituent. Examples of preferred substituents on the condensed benzene ring and examples of preferred $R_{64}$ (in the case where plural $R_{64}$ groups do not form a condensed ring) are $R_{41}$—, a halogen atom, $R_{43}O$—, $R_{43}S$—, $(R_{43})(R_{44})NCO$—, $R_{43}OOC$—, $R_{41}SO_2$—, $(R_{43})(R_{44})NSO_2$—, $R_{43}CON(R_{43})$—, $R_{41}SO_2N(R_{43})$—, $R_{43}CO$—, $R_{41}COO$—, $(R_{43})(R_{44})NCON(R_{45})$—, a cyano group, and

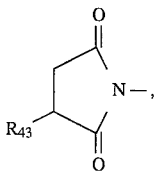

wherein $R_{41}$, $R_{43}$, $R_{44}$ and $R_{45}$ are as defined above.

Typical examples of $R_{64}$ are methyl, ethyl, t-butyl, methoxy, methylthio, dodecylthio, 3-(2,4-di-t-amylphenoxy)propylthio, N-3-(2,4-di-t-amylphenoxy)propylcarbamoyl, N-methyl-N-octadecyloxycarbamoyl, methoxycarbonyl, dodecyloxycarbonyl, propylcarbamoyl, hydroxyl, and N,N-dioctylcarbamoyl groups. Examples of the cyclic structure formed by two $R_{64}$ groups include

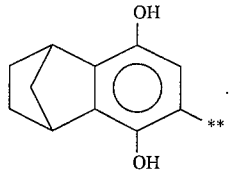

In formulae (III) and (IV), P and $Q_2$ each preferably represents an oxygen atom, and $A_1$ and $A_2$ each preferably represents a hydrogen atom.

In formula (I'), the groups represented by $L_{21}$ and $L_{22}$ may or may not be used, and preferably are not used. These groups are appropriately selected according to the purpose. The timing group as represented by $L_{21}$ or $L_{22}$ includes the following known linking groups. (1) Group utilizing cleavage reaction of hemiacetal:

Reference can be made to U.S. Pat. No. 4,146,396, JP-A-60-249148, and JP-A-60-249149. Groups of this type are represented by formula (T-11), in which * indicates the position for bonding to the left-hand side of formula (I'), and ** indicates the position for bonding to the right-hand side of formula (I'):

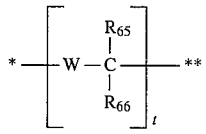

(T-11)

wherein W represents an oxygen atom, a sulfur atom, or $—N(R_{67})—$, wherein $R_{67}$ represents a substituent; $R_{65}$ and $R_{66}$ each represents a hydrogen atom or a substituent; and t represents 1 or 2; where t is 2, the two groups $—W—C(R_{65})(R_{66})—$ may be the same or different.

In formula (T-11), typical examples of the substituent represented by $R_{65}$, $R_{66}$ and $R_{67}$ are $R_{69}$, $R_{69}CO$—, $R_{69}SO_2$—, $(R_{69})(R_{70})NCO$—, and $(R_{69})(R_{70})NSO_2$—, wherein $R_{69}$ has the same meaning as $R_{41}$; and $R_{70}$ has the same meaning as $R_{43}$. $R_{65}$, $R_{66}$, and $R_{67}$ may each represent a divalent group and in this case be connected together to form a cyclic structure. Typical examples of the timing group of formula (T-11) are shown below.

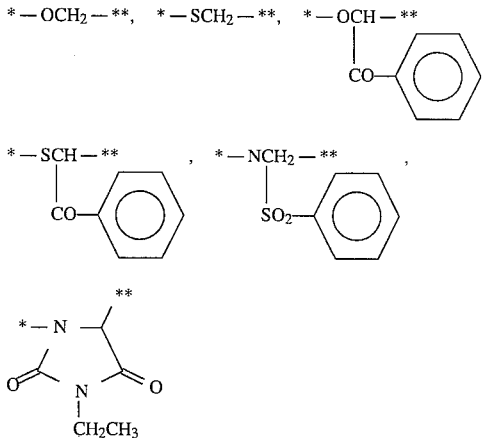

(2) Group inducing cleavage reaction by utilizing intramolecular nucleophilic substitution reaction:

Timing groups described in U.S. Pat. No. 4,248,962 are among this type of timing group. These groups can be represented by formula (T-12):

*—Nu—Link—E—** (T-12)

wherein * indicates the position for bonding to the left-hand side of formula (I');  indicates the position for bonding to the right-hand side of formula (I'); Nu represents a nucleophilic group having, e.g., an oxygen atom or a sulfur atom as a nucleophilic species; E represents an electrophilic group which splits the bond at the position  on receipt of a nucleophilic attack from Nu; and Link represents a linking group which structurally connects Nu to E so as to allow them to undergo the intramolecular nucleophilic substitution reaction. Specific examples of the timing group represented by formula (T-12) are shown below.

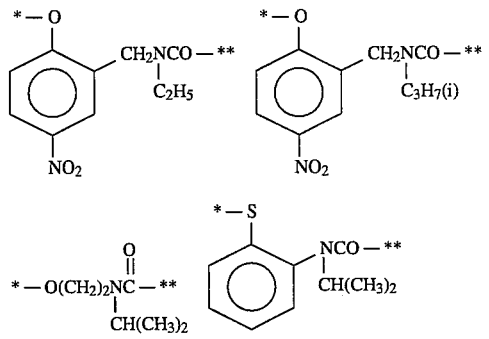

(3) Groups inducing cleavage reaction by utilizing electron transfer reaction along conjugated system:

Reference can be made to, e.g., U.S. Pat. Nos. 4,409,323 and 4,421,845. Groups of this type can be represented by formula (T-13):

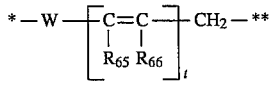

(T-13)

wherein *, **, W, $R_{65}$, $R_{66}$, and t are as defined above.

Specific examples of the timing groups of formula (T-13) are shown below.

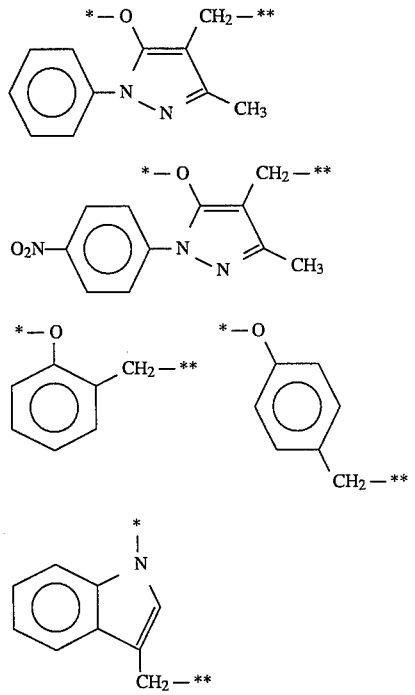

(4) Groups utilizing cleavage reaction by hydrolysis of ester:

Reference can be made, e.g., to West German Patent (OLS) No. 2,626,315. Examples of the groups of this type are those represented by formula (T-14) and (T-15) shown below, wherein * and ** have the same meaning as explained for formula (T-11).

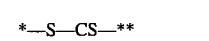

(T-14)

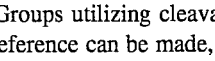

(T-15)

(5) Groups utilizing cleavage reaction of iminoketal:

Reference can be made, e.g., to U.S. Pat. No. 4,546,073. Groups of this type can be represented by formula (T-16):

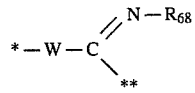

(T-16)

wherein * and ** have the same meanings as explained for formula (T-11); and $R_{68}$ has the same meaning as $R_{67}$.

Specific examples of the timing group of formula (T-16) are shown below.

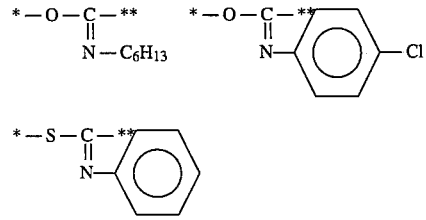

In formula (I'), where $L_{21}$ represents a group which, after being released from A, reacts with an oxidation product of a developing agent to cleave $(L_{22})_b$—Z, such a group includes a group which becomes a coupler or a redox group after release from A. Likewise, where $L_{22}$ represents a group which, after being released from A—$(L_{21})_a$, reacts with an oxidation product of a developing agent to cleave Z, such a group includes a group which becomes a coupler or a redox group after release from A—$(L_{21})_a$.

The group which becomes a coupler is, in case of a phenol coupler, a group bonded to A— or A—$(L_{21})_a$— at the oxygen atom of a hydroxyl group from which a hydrogen atom is removed; or, in case of a 5-pyrazolone coupler, a group bonded to A— or A—$(L_{21})_a$— at the oxygen atom of a hydroxyl group of a 5-hydroxypyrazole tautomer from which a hydrogen atom is removed. In these examples, it is not until the group is released from A— or A—$(L_{21})_a$— that it becomes a phenol coupler or a 5-pyrazolone coupler. The group carries $(L_{22})_b$—Z or Z at the coupling position thereof.

Where $L_{21}$ and $L_{22}$ represents a group which becomes a coupler, such a group preferably includes those represented by formulae (V), (VI), (VII) and (VIII), wherein * indicates the position bonding to the left-hand side of formula (I'), and ** indicates the position bonding to the right-hand side of formula (I'):

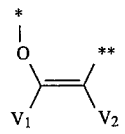

(V)

-continued (VI)

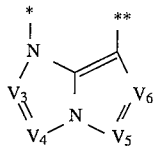

(VII)

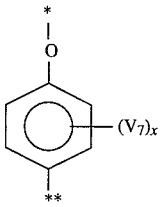

(VIII)

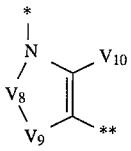

wherein $V_1$ and $V_2$ each represents a substituent, or they each represent a divalent group and are connected together with the moiety below: to form a 5- to 8-membered ring.

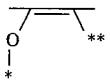

$V_3$, $V_4$, $V_5$, and $V_6$ each represents a nitrogen atom or a substituted or unsubstituted methine group; $V_7$ represents a substituent; x represents 0 or an integer of from 1 to 4; where x is 2 or more, the plural $V_7$ groups may be the same or different, or two $V_7$ groups may be connected together to form a cyclic structure; $V_8$ represents —CO—, —$SO_2$—, an oxygen atom, or a substituted imino group; $V_9$ represents a non-metal atomic group which is necessary to form a 5- to 8-membered ring together with the moiety:

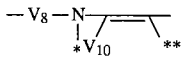

and $V_{10}$ represents a hydrogen atom or a substituent.

In the following explanation of $V_1$ to $V_{10}$, $R_{71}$ and $R_{72}$ each represents an aliphatic group, an aromatic group, or a heterocyclic group; and $R_{73}$, $R_{74}$, and $R_{75}$ each represents a hydrogen atom, an aliphatic group, an aromatic group, or a heterocyclic group (wherein the aliphatic group, aromatic group, and heterocyclic group have the same meanings as defined with respect to $R_{41}$, provided that each of them has not more than 10 carbon atoms).

$V_1$ preferably represents $R_{71}$. $V_2$ preferably represents $R_{72}$, $R_{72}CO$—, $(R_{73})(R_{74})NCO$—, $R_{72}SO_2$—, $R_{72}S$—, $R_{72}O$—, or $R_{73}SO_2N(R_{74})$—. The ring formed by $V_1$ and $V_2$ includes indene, indole, pyrazole, and benzothiophene rings.

The substituted methine group as represented by $V_3$, $V_4$, $V_5$, or $V_6$ is preferably a methine group substituted with $R_{71}$, $R_{73}O$—, $R_{71}S$—, or $R_{71}CONH$—.

$V_7$ preferably represents a halogen atom, $R_{71}$, $R_{71}CONH$—, $R_{71}SO_2NH$—, $R_{73}O$—, $R_{71}S$—, $(R_{73})(R_{74})NCO$—, $(R_{73})(R_{74})NCON(R_{75})$—, $R_{71}CO$—, or $R_{73}OOC$—. The cyclic structure formed by plural $V_7$ groups includes naphthalene, quinoline, oxindol, benzodiazepin-2, 4-dione, benzimidazol- 2-one, and benzothiophene rings.

The substituted imino group represented by $V_8$ is preferably $R_{73}N$=.

The cyclic structure formed by $V_9$ together with the moiety:

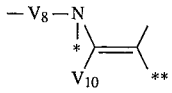

includes an indole ring, an imidazolinone ring, a 1,2,5-thiadiazoline- 1,1-dioxide ring, a 3-pyrazolin-5-one ring, a 3-isooxazolin-5-one ring, and a ring of formula:

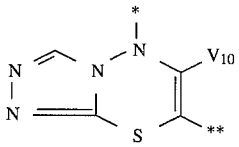

$V_{10}$ preferably represents $R_{73}$, $R_{73}O$—, $(R_{73})(R_{74})$—N—, $R_{71}CON(R_{73})$—, or $R_{71}S$—.

Typical examples of the group represented by formula (V) are shown below.

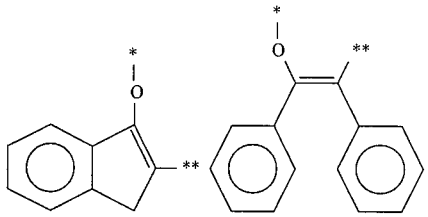

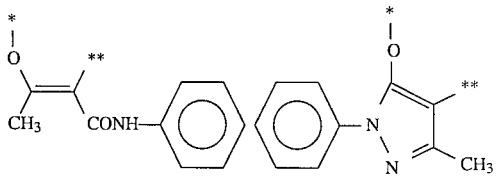

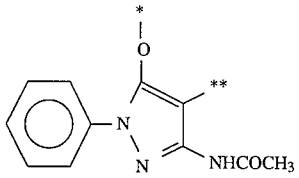

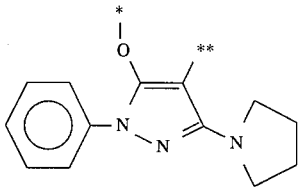

Typical examples of the group represented by formula (VI) are shown below.

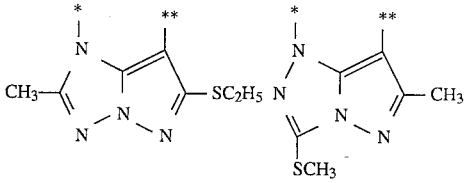

-continued

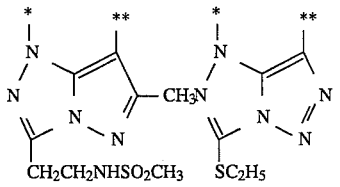

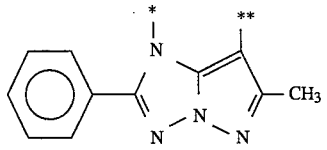

Typical examples of the group represented by formula (VII) are shown below.

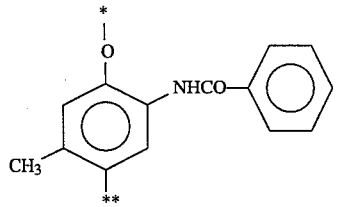

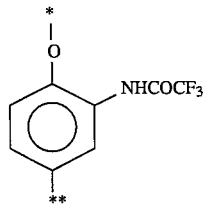

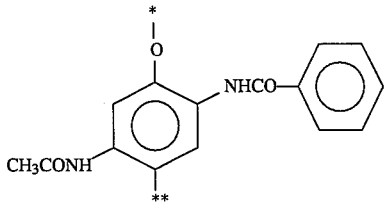

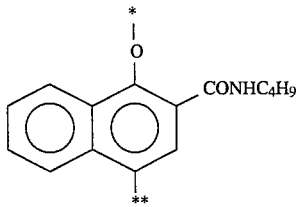

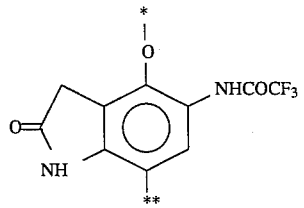

Typical examples of the group represented by formula (VIII) are shown below.

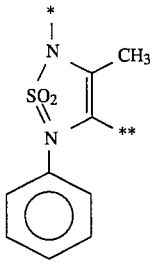

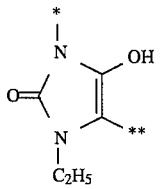

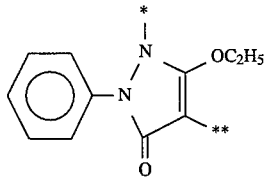

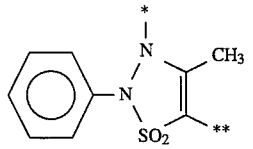

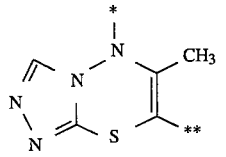

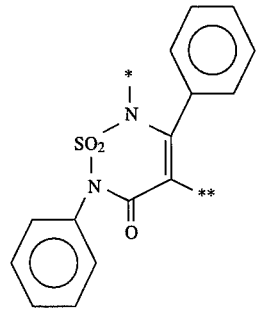

In formula (I'), where $L_{21}$ and $L_{22}$ represents a group which becomes a redox group, such a group preferably includes those represented by formula (IX):

$$*—P'—(X_2'=Y)_{n'}—Q_2—A_2' \quad \text{(IX)}$$

wherein * indicates the position for bonding to the left-hand side of formula (I'); $A_2'$, P', $Q_2'$, and n' have the same meanings as $A_2$, P, $Q_2$, and n, respectively, as explained for formula (II); at least one of the n'—$X_2'$ groups and n'—Y' groups represents a methine group substituted with —($L_{22}$)—Z or Z, with the other $X_2'$ and Y' representing a substituted or unsubstituted methine group or a nitrogen atom; any two of $A_2'$, P', $Q_2'$, $X_2'$, and Y' may each represent a divalent group and be taken together to form a cyclic structure (e.g., a benzene ring, a pyridine ring).

In formula (IX), P' preferably represents an oxygen atom, and $Q_2'$ preferably represents an oxygen atom or a substituted imino group represented by formula (N'–1) or (N'–2) shown below, wherein * represents the position for bonding to $(X_2'=Y'0)_{n'}$, and ** represents the position for bonding to $A_2'$:

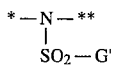

(N'-1)

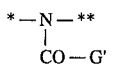

(N'-2)

wherein G' has the same meaning as G of formulae (N–1) and (N–2).

$Q_2'$ more preferably represents an oxygen atom or the group of formula (N'–1).

Of the groups represented by formula (IX), particularly preferred are those represented by formulae (X) and (XI):

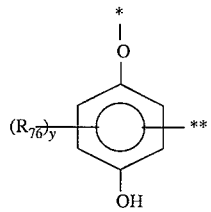

(X)

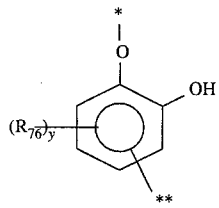

(XI)

wherein * indicates the position for bonding to the moiety at the left of $L_{21}$ or $L_{22}$ in formula (I'); ** indicates the position for bonding to the right-hand side of formula (I'); $R_{76}$ has the same meaning as $R_{64}$ in formula (III) or (IV); and y represents 0 or an integer of from 1 to 3; where y is two or more, the plural $R_{76}$ groups may be the same or different, or two $R_{76}$ groups may be taken together to form a cyclic structure.

$R_{76}$ preferably represents an alkoxy group (e.g., methoxy, ethoxy), an acylamino group (e.g., acetamido, benzamido), a sulfonamido group (e.g., methanesulfonamido, benzenesulfonamido), an alkylthio group (e.g., methylthio, ethylthio), a carbamoyl group (e.g., N-propylcarbamoyl, N-t-butylcarbamoyl, N-i-propylcarbamoyl), an alkoxycarbonyl group (e.g., methoxycarbonyl, propoxycarbonyl), an aliphatic group (e.g., methyl, t-butyl), a halogen atom (e.g., fluoro, chloro), a sulfamoyl group (e.g., N-propylsulfamoyl, sulfamoyl), an acyl group (e.g., acetyl, benzoyl), a hydroxyl group, or a carboxyl group. The cyclic structure formed by two $R_{76}$ groups typically includes:

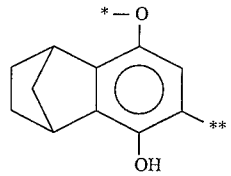

wherein * and ** have the same meanings as in formula (XI).

In formula (I'), the group represented by Z includes known bleaching accelerators groups, such as those from various mercapto compounds as described in U.S. Pat. No. 3,893,858, British Patent 1138842, and JP-A-141623; compounds having a disulfide linkage as described JP-A-53-95630; in thiazolidine derivatives as described JP-B-53-9854; in isothiourea derivatives as described JP-A-53-94927;in thiourea derivatives as described in JP-B-45-8506 and JP-B-49-26586; thioamide compounds as described in JP-A-49-42349; dithiocarbamic acid salts as described in JP-A-55-26506; and arylenediamine compounds as described in U.S. Pat. No. 4,552,834. These compounds are preferably bonded to $A—(L_{21})_a—(L_{22})_b—$ in formula (I') at the hetero atom thereof which is capable of substitution.

Of these groups as Z, more preferred are those represented by formulae (XII), (XIII), and (XIV):

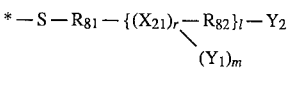

(XII)

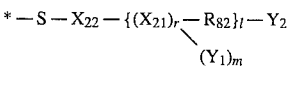

(XIII)

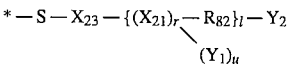

(XIV)

wherein * indicates the position for bonding to $A—(L_{21})_a—(L22)_b—$; $R_{81}$ represents an aliphatic group having from 1 to 8 carbon atoms, and preferably from 1 to 5 carbon atoms; $R_{82}$ has the same meaning as $R_{81}$ or represents a divalent aromatic group having from 6 to 10 carbon atoms, or a 3- to 8-membered, and preferably 5- or 6-membered divalent heterocyclic group; $X_{21}$ represents —O—, —S—, —COO—, $—SO_2—$, $—N(R_{83})—$, $—N(R_{83})—CO—$, $—N(R_{83})—SO_2—$, —S—CO—, —CO—, $—N(R_{83})—COO—$, $—N=(R_{83})—$, $—N(R_{83})CO—N(R_{84})—$, or $—N(R_{83})SO_2N(R_{84})—$; $X_{22}$ represents an aromatic group having from 6 to 10 carbon atoms; $X_{23}$ represents a 3- to 8-membered, and preferably 5- or 6-membered heterocyclic group containing, in its ring, at least one carbon atom at which it is bonded to S; $Y_1$ represents a carboxyl group or a salt thereof, a sulfo group or a salt thereof, a hydroxyl group, a phospho group or a salt thereof, an amino group (which may be substituted with an aliphatic group having from 1 to 4 carbon atoms), $—NHSO_2—R_{85}$, or $—SO_2NH—R_{85}$ (wherein, the term "salt" as used herein means a sodium salt, a potassium salt, an ammonium salt, etc.); $Y_2$ has the same meaning as $Y_1$ or represents a hydrogen atom; r represents 0 or 1; l represents 0 or an integer of from 1 to 4; m represents an integer of from 1 to 4; u represents 0 or an integer of from 1 to 4; provided that m- or u-$Y_1$ is(are) bonded to $R_{81}—\{(X_{21})_r—R_{82}\}_l$ of formula (XII), $X_{22}—\{(X_{21})_r—R_{82}\}_l$ of formula (XIII), or $X_{23}—\{(X_{21})_r—R_{82}\}_l$ of formula (XIV) at the respective position(s) capable of substitution; where m or u is 2 or more, the plural $Y_1$ groups may be the same or different; where l is 2 or more, the plural groups $(X_{21})_r—R_{82}$ may be the same or different; $R_{83}$, $R_{84}$, and $R_{85}$ each represents a hydrogen atom or an aliphatic group having from 1 to 8 carbon atoms, and preferably from 1 to 5 carbon atoms.

The aliphatic group represented by $R_{81}$, $R_{82}$, $R_{83}$, $R_{84}$, or $R_{85}$ is an acyclic or cyclic, straight chain or branched, saturated or unsaturated, substituted or, preferably, unsubstituted aliphatic group. Substituents for the substituted aliphatic group include a halogen atom, an alkoxy group (e.g., methoxy, ethoxy), and an alkylthio group (e.g., methylthio, ethylthio).

The aromatic group represented by $X_{22}$ or $R_{82}$ may have a substituent, such as those described above for the substituted aliphatic group.

The heterocyclic group as represented by $X_{23}$ or $R_{82}$ is a saturated or unsaturated, substituted or unsubstituted heterocyclic group containing an oxygen atom, a sulfur atom, or a nitrogen atom as a hetero atom. Examples of such a heterocyclic group include a pyridine ring, an imidazole ring, a piperidine ring, an oxirane ring, a sulfolane ring, an imidazolidine ring, a thiazepin ring, and a pyrazole ring. Examples of substituents thereof are the same as described for the substituted aliphatic group.

Specific examples of the group represented by formula (XII) are shown below. $-SCH_2CH_2COOH$, $-SCH_2COOH$, $-SCH_2CH_2N(CH_3)_2$, $-SCH_2CH(OH)CH_2OH$, $-SCH_2CH_2NH_2$, $-SCH_2CH(NH_2)COOH$, $-S(CH_2)_2COCH_2OH$, $-SCH_2CH_2NHCOCH_3$, $-S(CH_2)_4COOH$, $-SCH(CH_3)COOH$, $-SCH_2CONHCH_2COOH$, $-SCH_2CH_2OCH_2COOH$, $-SCH_2COOCH_2CH_2OH$, $-SCH_2CH_2OCH_2CH_2OCH_2CH_2OH$, $-SCH_2CH(OH)CH_3$, $-SCH_2CH_2SCH_2COOH$, $-SCH_2CH_2CH_2COOH$,

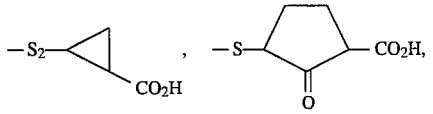

Specific examples of the group represented by formula (XIII) are shown below.

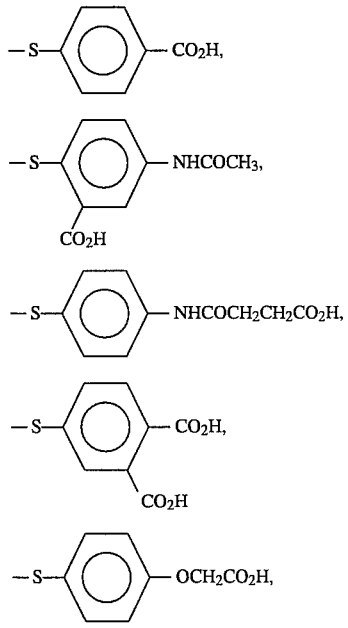

Specific examples of the group represented by formula (XIV) are shown below.

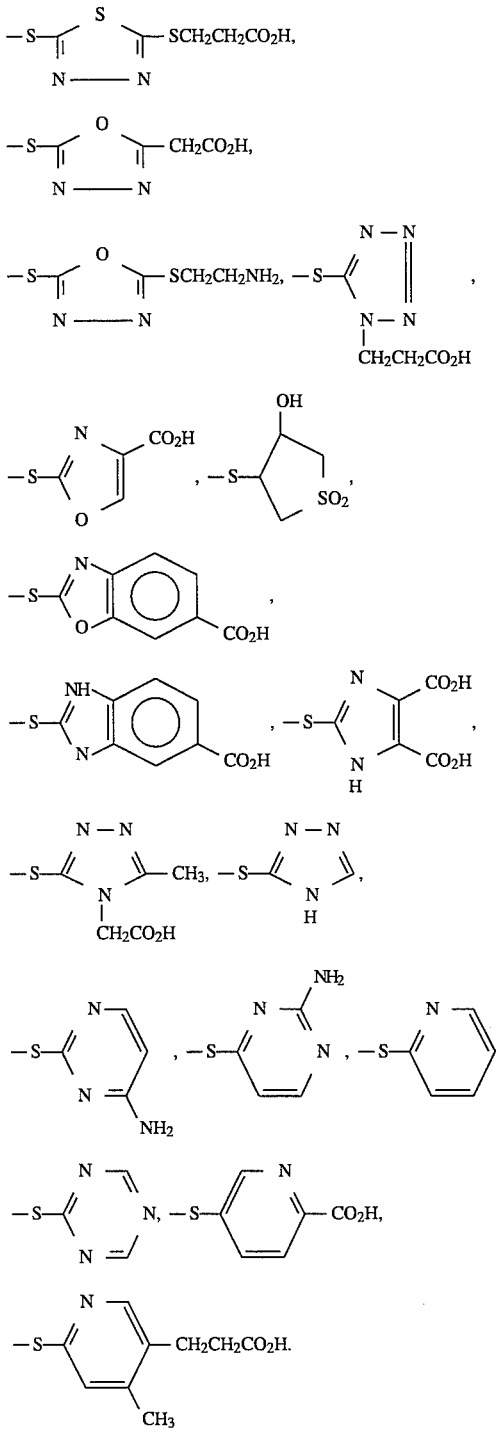

The compounds represented by formula (I') embrace polymers thereof, inclusive of dimers and telomers. For example, polymers include polymers comprising a repeating unit represented by formula (XVI) shown below which is derived from a monomer represented by formula (XV) shown below, and copolymers obtained from the monomer of formula (XV) and one or more non-color-forming comonomers containing at least one ethylene group incapable of coupling with an oxidation product of an aromatic primary amine developing agent. Two or more monomers of formula (XV) may be polymerized.

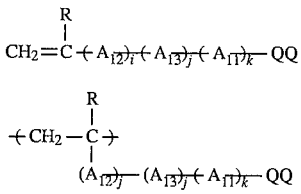

(XV)

(XVI)

wherein R represents a hydrogen atom, a lower alkyl group having from 1 to 4 carbon atoms, or a chlorine atom; $A_{11}$ represents —CONH—, —NHCONH—, —NHCOO—, —COO—, —$SO_2$—, —CO—, —NHCO——$SO_2$NH—, —NH$SO_2$—, —OCO—, —OCONH—, —NH—, or —O—; $A_{12}$ represents —CONH—or —COO—; $A_{13}$ represents a substituted or unsubstituted, straight chain or branched alkylene group having from 1 to 10 carbon atoms (e.g., methylene, methylmethylene, dimethylmethylene, dimethylene, trimethylene, tetramethylene, pentamethylene, hexamethylene, decylmethylene), an aralkylene group (e.g., benzylidene), or a substituted or unsubstituted arylene group (e.g., phenylene, naphthylene); QQ represents a residue of a compound represented by formula (I');

$$A—(L_{21})_a—(L_{22})_b—Z \qquad (I')$$

with proviso that QQ may be bonded to at any position of selected from A, $L_{21}$ and $L_{22}$, except for the group of Z. In the formula (I'), as previously discussed, A represents a group whose bond to $(L_{21})_a$—$(L_{22})_b$—Z is cleaved on reacting with an oxidation product of a developing agent, in more detail, represents a coupler residue or redox group; $L_{21}$ represents a timing group or a group whose bond to $(L_{22})_b$—Z is cleaved on reacting with an oxidation product of a developing agent; $L_{22}$ represents a timing group or a group whose bond to Z is cleaved on reacting with an oxidation product of a developing agent; Z represents a group which manifests a bleaching accelerating effect on the cleaving of its bond to A—$(L_{21})_a$—$(L_{22})_b$; and a and b each represents 0 or 1; and i, j, and k each represents 0 or 1, provided that i, j, and k do not simultaneously represent 0.

Substituents for the alkylene, aralkylene or arylene group as represented by $A_{13}$ include an aryl group (e.g., phenyl), a nitro group, a hydroxyl group, a cyano group, a sulfo group, an alkoxy group (e.g., methoxy), an aryloxy group (e.g., phenoxy), an acyloxy group (e.g., acetoxy), an acylamino (e.g., acetylamino), a sulfonamido group (e.g., methanesulfonamido), a sulfamoyl group (e.g., methylsulfamoyl), a halogen atom (e.g., fluorine, chlorine, bromine), a carboxyl group, a carbamoyl group (e.g., methylcarbamoyl), an alkoxycarbonyl group (e.g., methoxycarbamoyl), and a sulfonyl group (e.g., methylsulfonyl). Where there are two or more substituents, they may be the same or different.

The non-color-forming ethylenically unsaturated comonomer which is incapable of coupling with an oxidation product of an aromatic primary amine developing agent includes acrylic acid, α-chloroacrylic acid, α-alkylacrylic acids, and esters and amides of these acrylic acids, methylenebisacrylamide, vinyl esters, acrylonitrile, aromatic vinyl compounds, maleic acid derivatives, and vinylpyridine compounds. These comonomers may be used in combinations of two or more thereof.

The compounds of formula (I') include those in which any two of A, $L_{21}$, $L_{22}$, and Z have a bond other than that shown in formula (I'). The moiety connected with the second bond represented by the group other than formula (I') shows advantages as a bleaching accelerator or a compound capable of releasing a precursor of the bleaching accelerator during development, even though said second bond is not cleaved different from that the A, $L_{21}$, $L_{22}$ or Z in the compound of formula (I') is cleaved on development. Examples of the second bond are shown below.

A—$L_{21}$—$(L_{22})_b$—Z, A—$L_{21}$—$L_{22}$—Z, A—$(L_{21})_a$—$L_{22}$—Z

Among the above-described bleaching accelerator-releasing compounds, particularly preferred are those represented by formula (XVII):

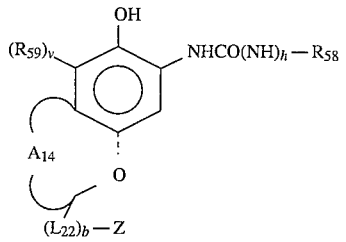

(XVII)

wherein $L_{22}$, b, Z, $R_{58}$, and $R_{59}$ are as defined above; h and each represents 0 or 1; and $A_{14}$ represents a divalent organic group for forming a 5- to 8-membered ring (e.g., —O—CH=, —O—C($C_{10}H_{21}$)=, —NHCOCH=, —NH-COC—($C_7H_{15}$)=, and —S—CH=).

Specific examples of the bleaching accelerator-releasing compounds which can be used in the present invention are shown below for illustrative purposes only but not for limitation.

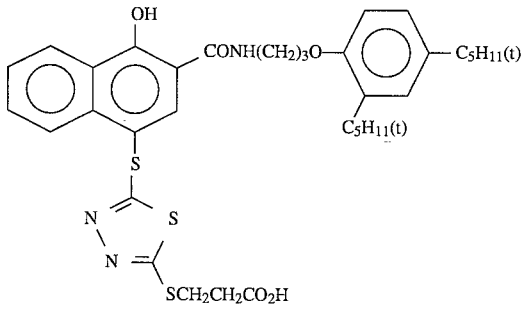

(1)

-continued
(2)
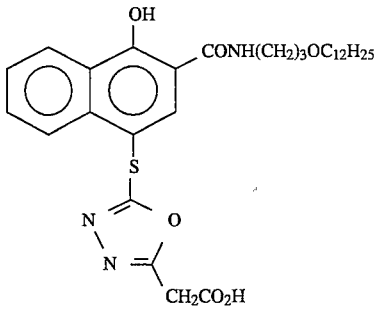
(3)
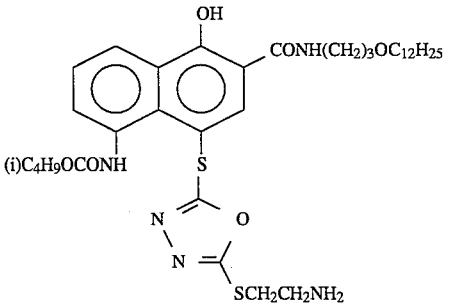
(4)
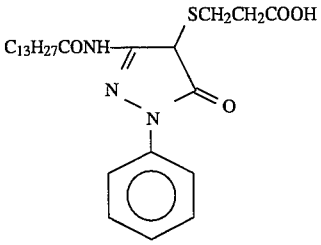
(5)
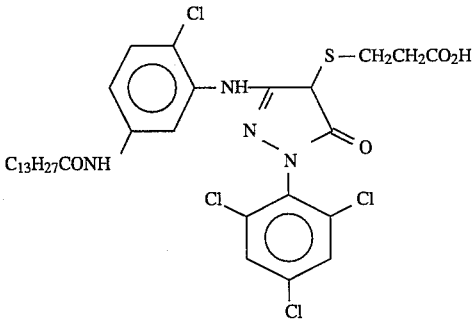
(6)
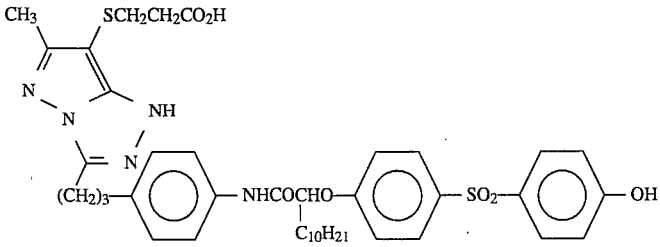

-continued
(7)
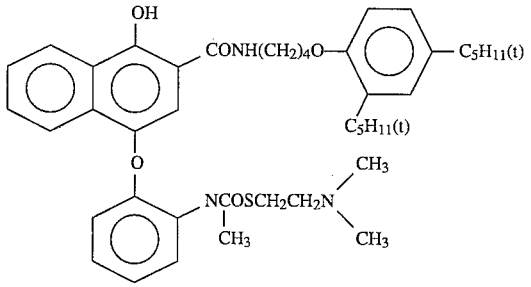
(8)
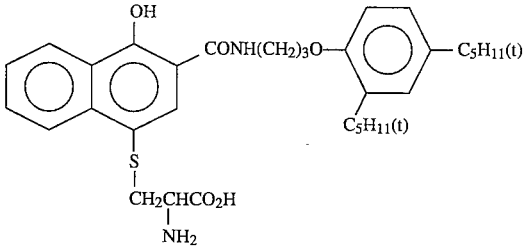
(9)
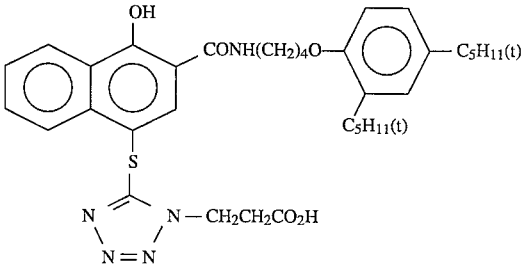
(10)
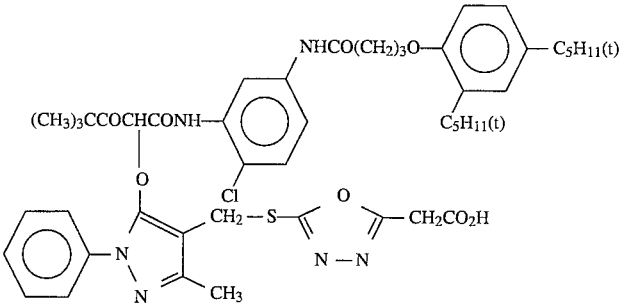
(11)
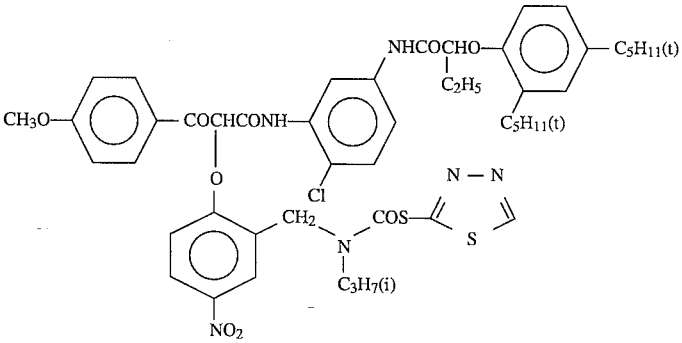

-continued
(12)
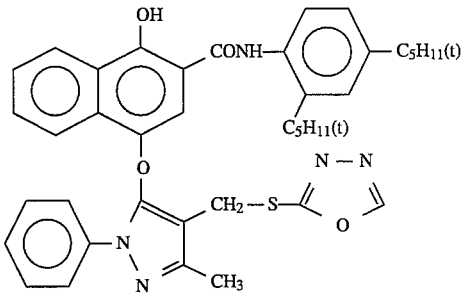
(13)
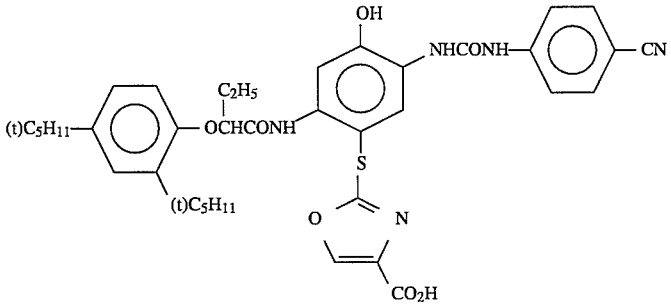
(14)
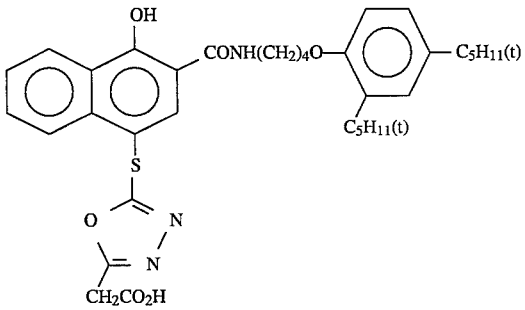
(15)
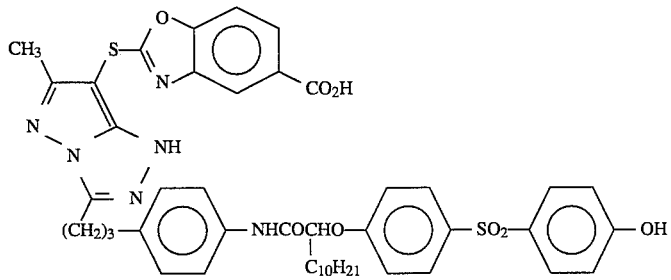
(16)
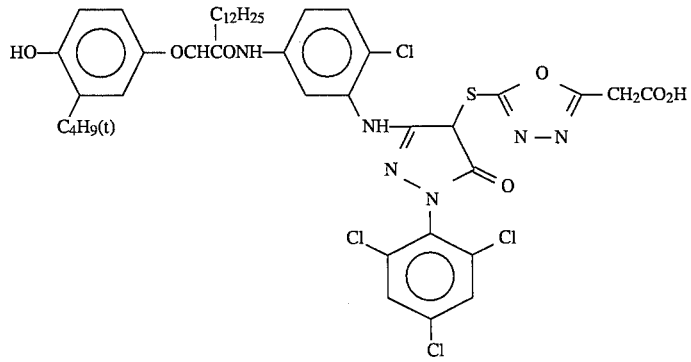

-continued
(17)
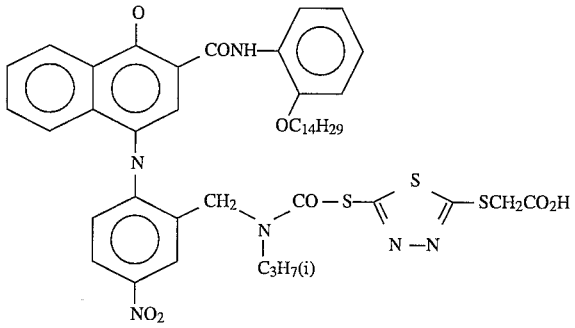
(18)
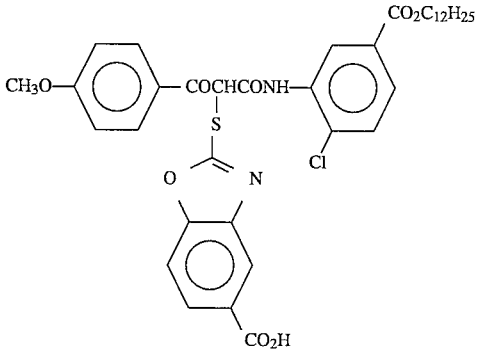
(19)
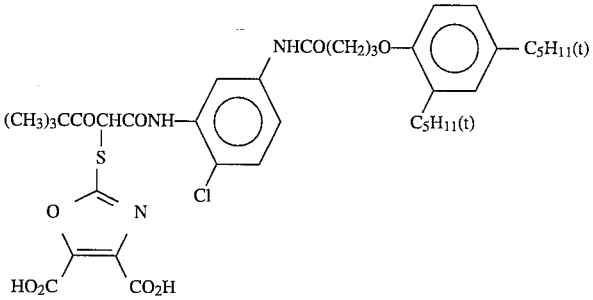
(20)
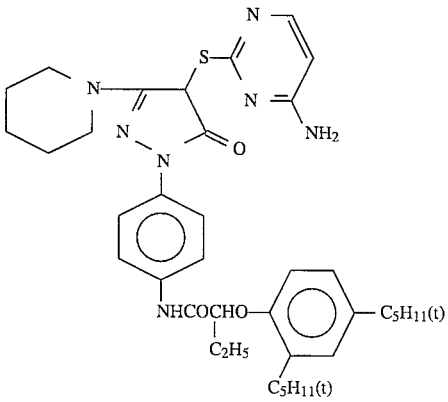
(21)
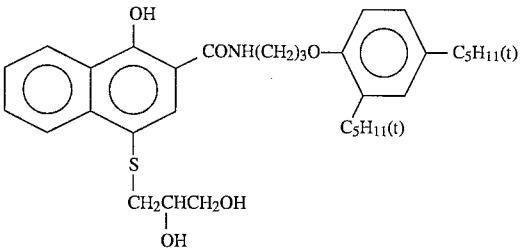

-continued
(22)
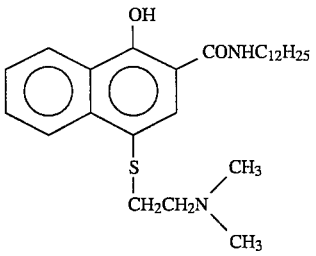
(23)
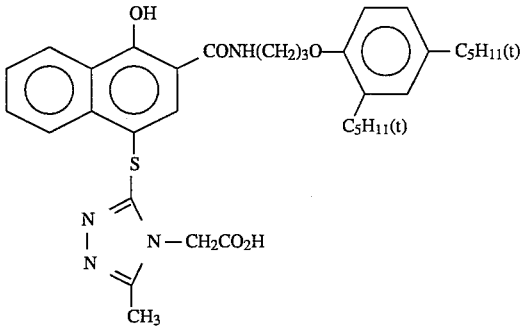
(24)
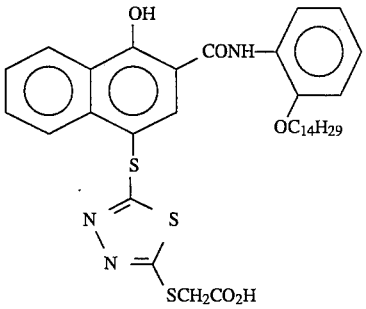
(25)
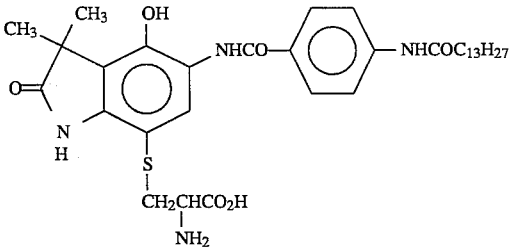
(26)
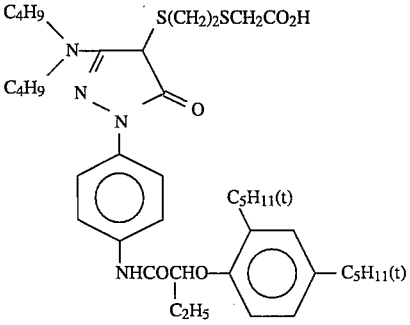

-continued
(27)
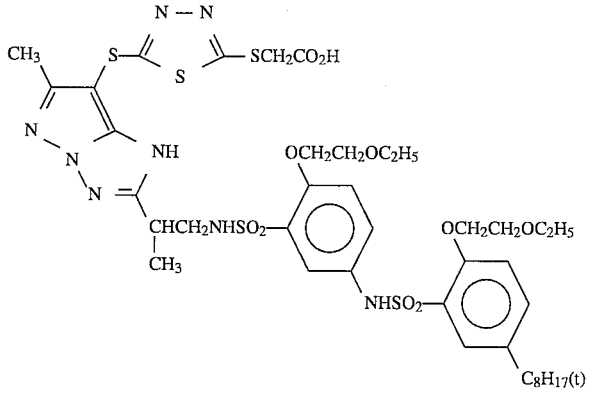
(28)
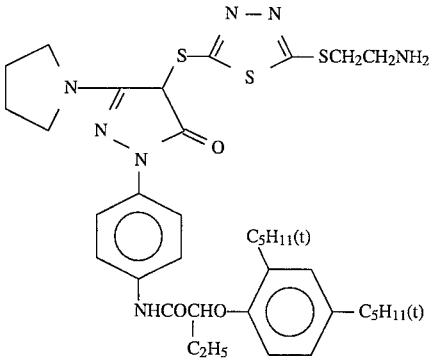
(29)
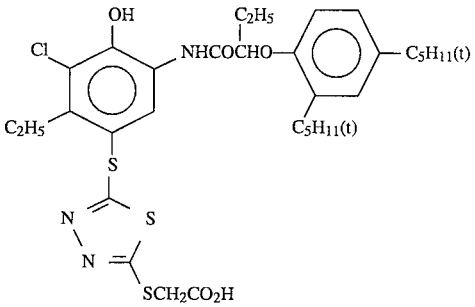
(30)
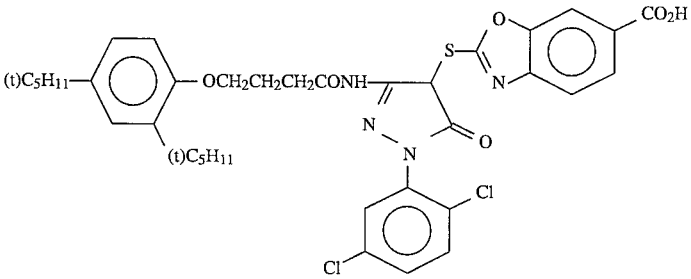
(31)
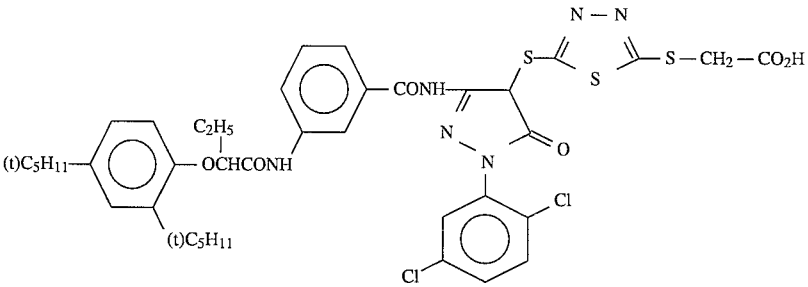

-continued
(32)
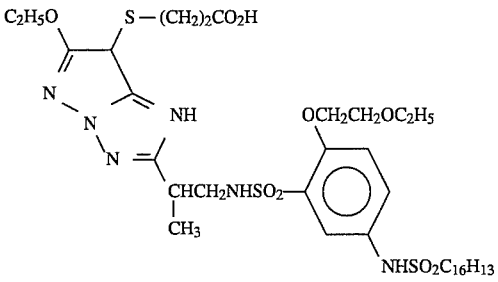
(33)
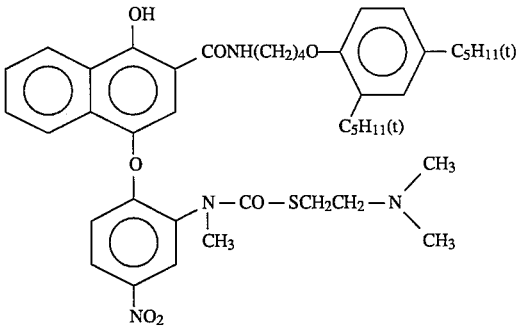
(34)
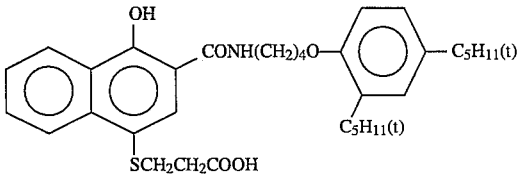
+R2
(35)
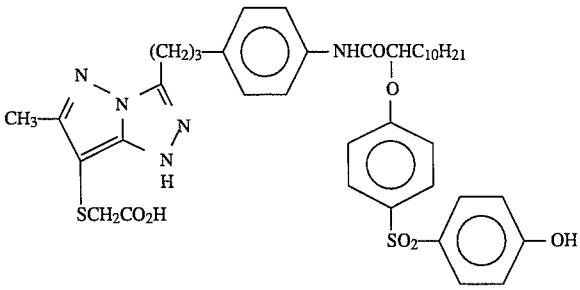
(36)
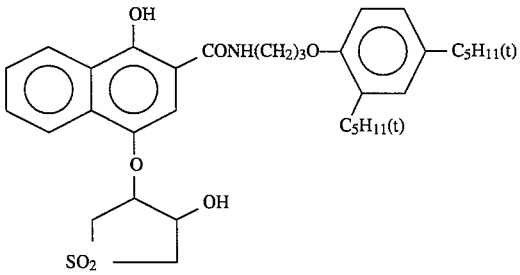
(37)
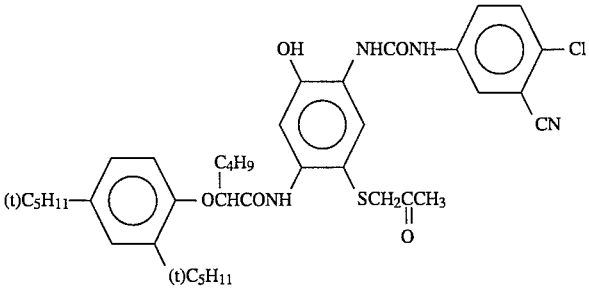

-continued
(38)
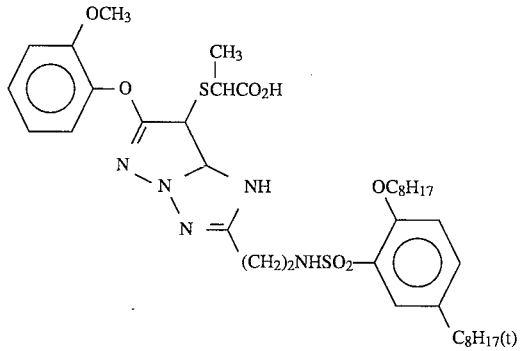
(39)
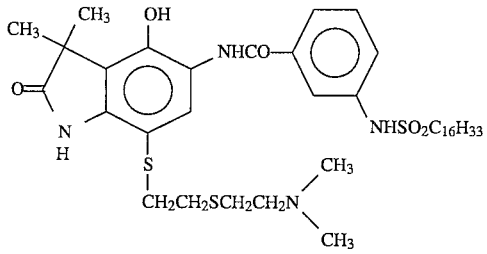
(40)
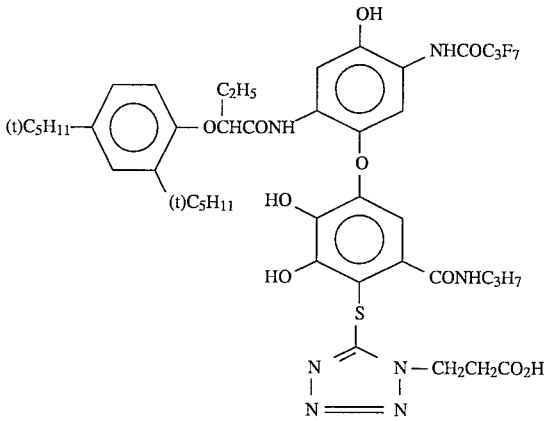
(41)
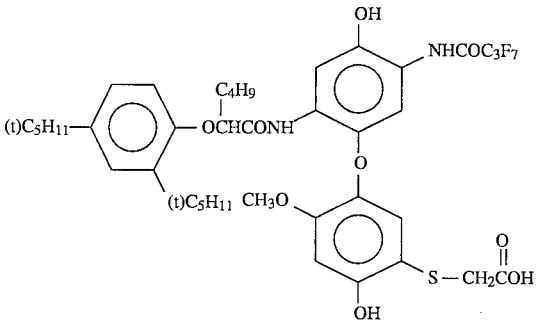

-continued
(42)
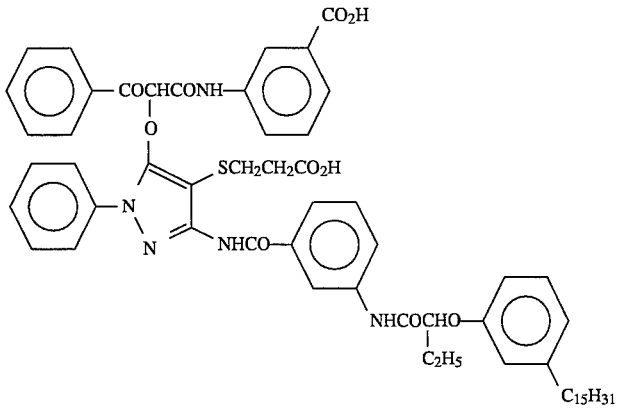
(43)
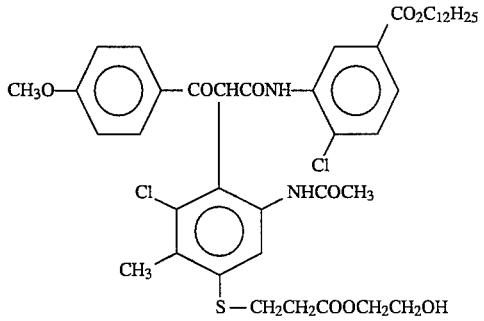
(44)
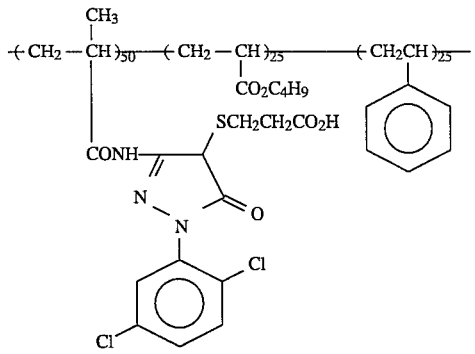
(45)
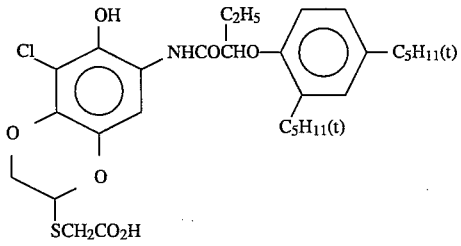
(46)
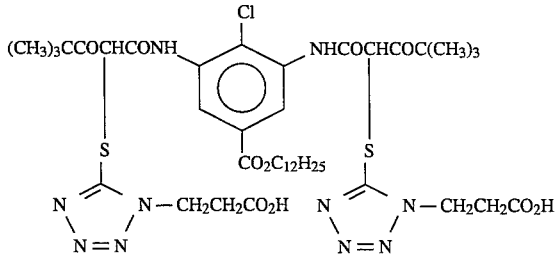

-continued
(47)
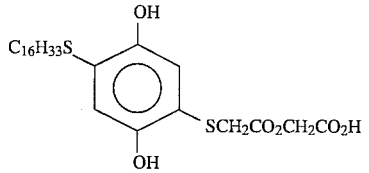
(48)
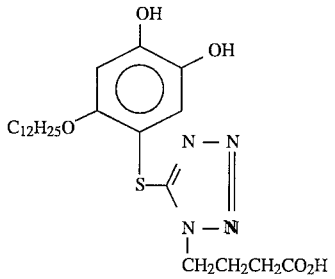
(49)
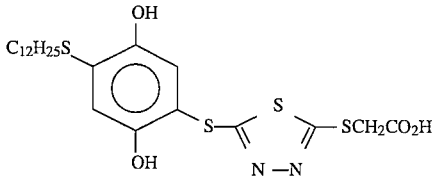
(50)
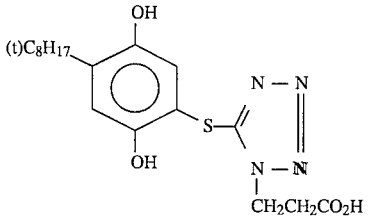
(51)
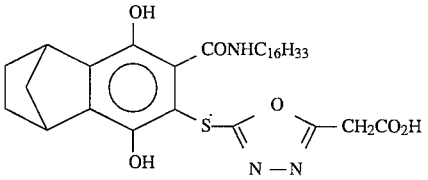
(52)
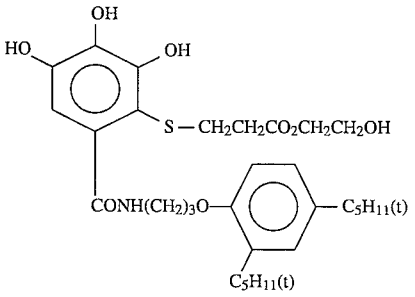
(53)
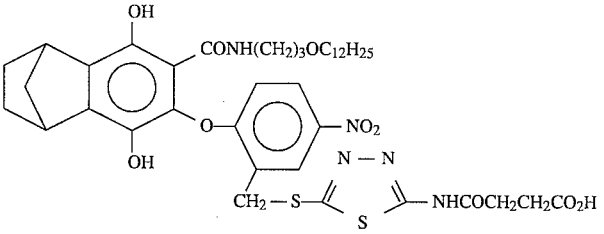

-continued
(54)
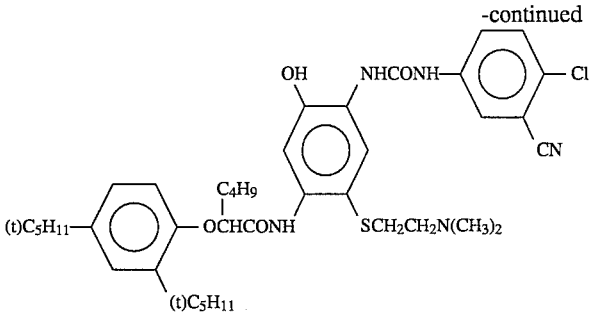
(55)
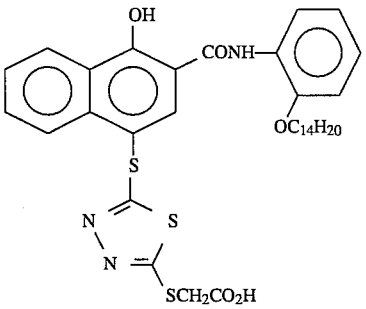
(56)
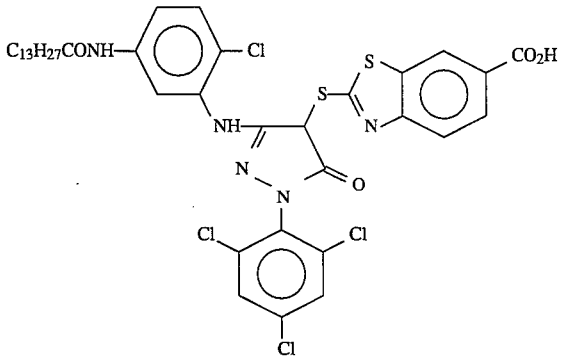
(57)
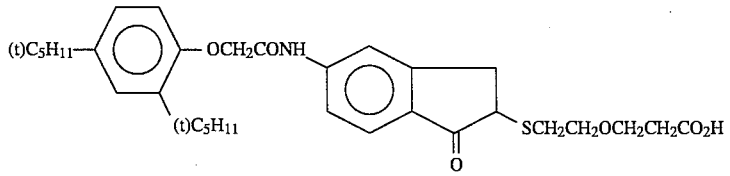
(58)
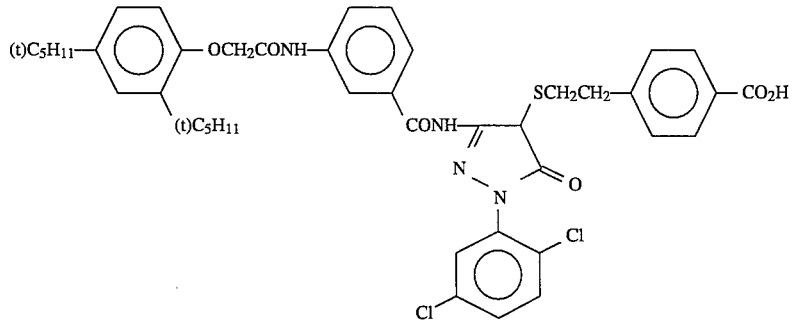

-continued
(59)
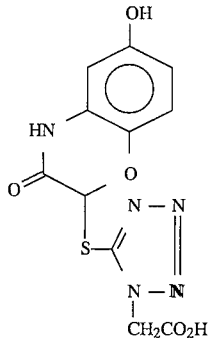
(60)
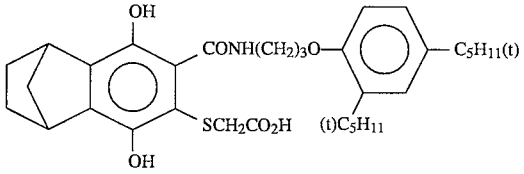
(61)
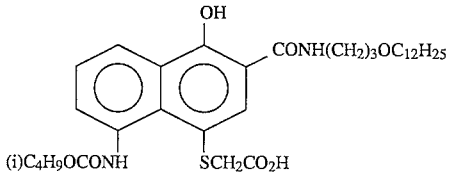
(62)
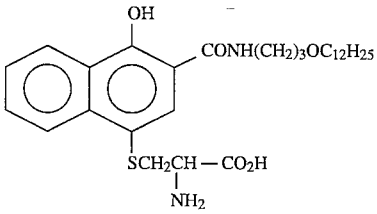
(63)
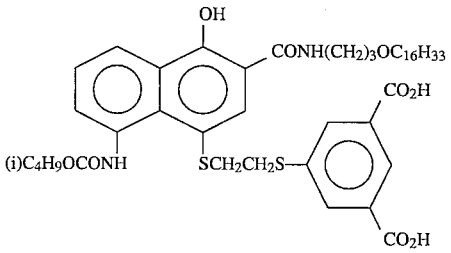
(64)
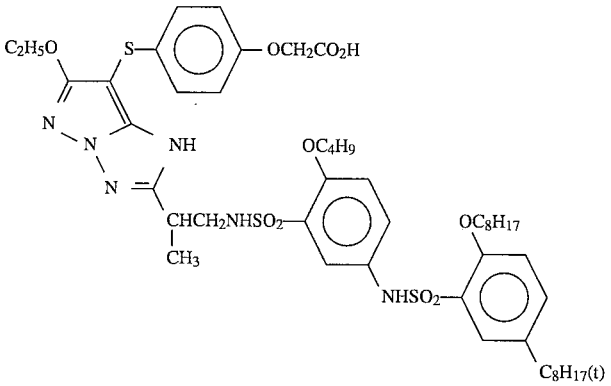

-continued
(65)
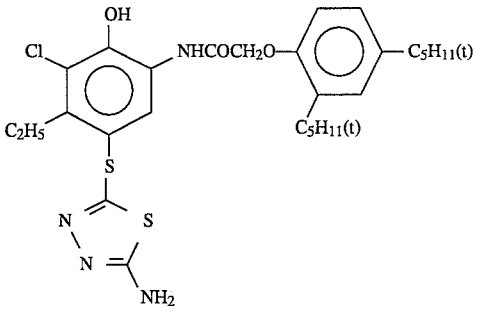
(66)
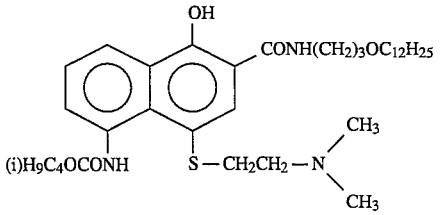
(66)
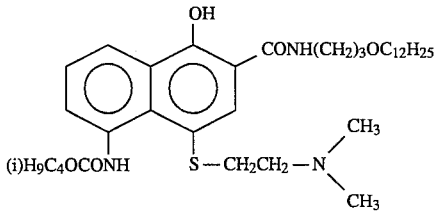
(67)
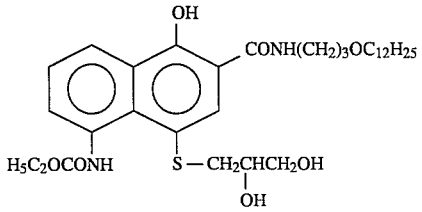
(68)
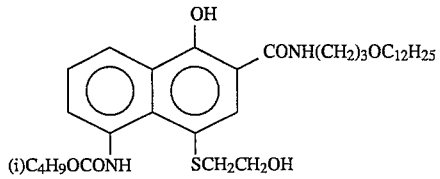
(69)
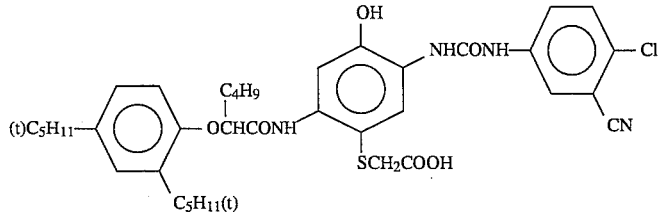
(70)
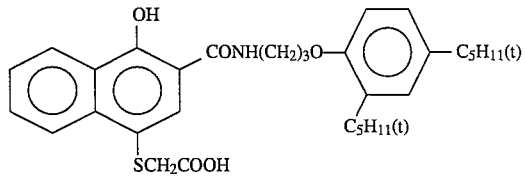

-continued (71)

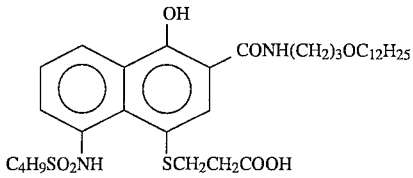

(72)

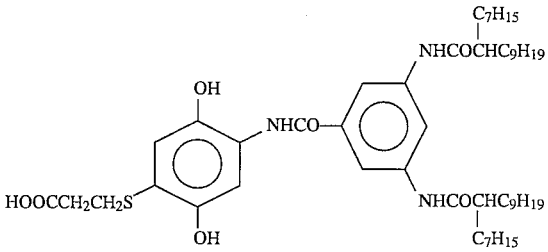

(73)

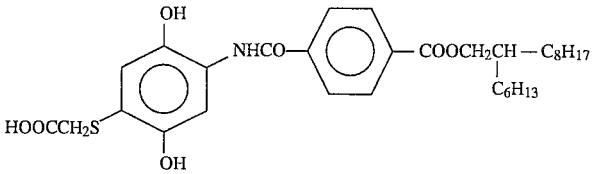

(74)

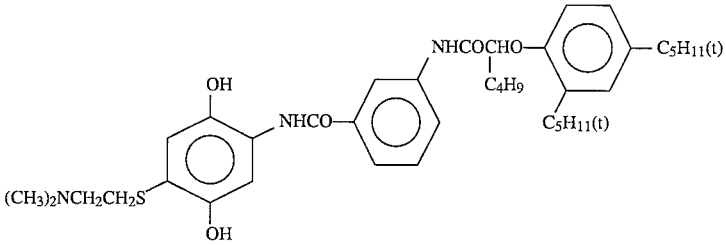

Additionally, known compounds disclosed in *Research Disclosure*, Item No. 24241, ibid., Item No. 1449, JP-A-61-201247, JP-A-63-106749 JP-A-63-121843, and JP-A-63-121844 can also be used.

The bleaching accelerator-releasing compounds which can be used in the present invention can easily be synthesized according to the disclosures of the above listed patents.

The bleaching accelerator-releasing compounds are added to the light-sensitive material in an amount preferably of from $1\times10^{-7}$ to $1\times10^{-1}$ mol per $m^2$, and more preferably of from $1\times10^{-6}$ to $5\times10^{-2}$ mol per $m^2$. While the bleaching accelerator-releasing compound may be incorporated into any and every layer constituting a light-sensitive material, it is preferable to incorporate the compound into light-sensitive emulsion layers. The greater the number of layers to which the compound is added, the more pronounced the effects produced.

Methods for incorporating known couplers into the light-sensitive material (hereinafter described) also apply to the bleaching accelerator-releasing compounds.

The bleaching accelerator-releasing compounds of the present invention have their desilvering accelerating effects enhanced when used in combination with the above-described yellow-colored cyan couplers. Such enhanced effects are not observed or, if at all, are only weakly observed when combined with the couplers described in JP-A-61-221748 and JP-A-1-319744 as above cited, but are observed when combined with the compounds represented by formulae (CI) to (CIV). The degree of the enhanced effects observed with the compounds of formulae (CI) and (CII) is higher than with the compounds of formulae (CIII) and (CIV), and that observed with the compounds of formula (CI) is higher than with the compounds of formula (CII).

Accordingly, in a preferred embodiment of the present invention, the yellow-colored cyan couplers of formula (CI) or (CII), and particularly the couplers of formula (CI), are used in combination with the bleaching accelerator-releasing compounds.

In addition to the above-described effects to improve color reproduction, the present invention further brings about effects to improve processing stability in continuous processing, preservation stability of the light-sensitive material, and dye image stability.

The present color photographic light-sensitive material for photographing can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers having substantially the same color sensitivity are referred to as a light-sensitive layer unit and have a color sensitivity to any of blue light, green light and red light. In this multi-layer silver halide color photographic material, these light-sensitive layer units are normally arranged in the order of a red-sensitive layer unit, a green-sensitive layer unit and a blue-sensitive layer unit as viewed from the support. However, the order can be optionally reversed depending on the purpose of application. Alternatively, two light-sensitive layers having the same color sensitivity can be arranged with a light-sensitive layer from a unit having a different color sensitivity interposed therebetween.

Light-insensitive layers can be provided between these silver halide light-sensitive layers and on the uppermost layer and lowermost layer.

These interlayers can comprise couplers, DIR compounds or the like as described in JP-A-61-43748, JP-A- 59-113438, JP-A-59-113440, JP-A-61-20037 and JP-A-61-20038. These interlayers can further comprise a commonly used color mixing inhibitor.

The plurality of silver halide emulsion layers constituting each light-sensitive layer unit can be preferably arranged in a two-layer structure, i.e., a high sensitivity emulsion layer and a low sensitivity emulsion layer, as described in West German Patent 1,121,470 and British Patent 923,045. In general, these layers are preferably arranged in an order such that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer the support.

In one embodiment of a suitable layer arrangement, the arrangement can be, in order, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), a low sensitivity red-sensitive layer (RL)/support. In another embodiment, the order can be BH, BL, GL, GH, RH, RL/support. In a further embodiment, the order can be BH, BL, GH, GL, RL, RH/support.

As described in JP-B-55-34932 (the term "JP-B" as used herein means an "examined Japanese patent publication"), a layer order of a blue-sensitive layer, GH, RH, GL, and RL/support can be arranged. Alternatively, as described in JP-A-56-25738 and 62-63936, a blue-sensitive layer, GL, RL, GH, RH/support can be arranged.

As described in JP-B-49-15495, a light-sensitive layer unit may have a layer arrangement such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer unit comprises three layers having different light sensitivities, a middle sensitivity emulsion layer, a high sensitivity emulsion layer and a low sensitivity emulsion layer can be arranged in this order remote from the support in a color-sensitive layer unit as described in JP-A-59-202464.

Alternatively, the order of a high sensitivity emulsion layer, a low sensitivity emulsion layer and a middle sensitivity emulsion layer or the order of a low sensitivity emulsion layer, a middle sensitivity emulsion layer and a high sensitivity emulsion layer can be used.

In the case where a layer unit comprises four or more layers, too, the order of arrangement of layers can be chosen and altered similarly.

In order to improve color reproducibility, a donor layer (CL) having an interimage effect and a different spectral sensitivity distribution from the main light-sensitive layer such as BL, GL and RL may be preferably provided adjacent or close to the main light-sensitive layer, as is disclosed in U.S. Pat. Nos. 4,663,271, 4,705,744 and 4,707,436, JP-A-62-160448 and JP-A-63-89850.

As described above, various layer structures and arrangements can be selected depending on the purpose of the light-sensitive material.

A suitable silver halide to be incorporated in the photographic emulsion layer in the present color light-sensitive photographic material is silver bromoiodide, silver chloroiodide or silver bromochloroiodide containing silver iodide in an amount of about 30 mol% or less. Particularly suitable is silver bromoiodide containing silver iodide in an amount of about 2 to about 10 mol%.

The silver halide grains in the photographic emulsions may be so-called regular grains having a regular crystal form, such as cube, octahedron and tetradecahedron, or those having an irregular crystal form such as a spherical or a tabular form, those having a crystal defect such as twinning plane, or those having a combination of these crystal forms.

The silver halide grains may be either fine grains having a projected area diameter of about 0.2 μm or less, or large grains having a projected area diameter of up to about 10 μm. The emulsion may be either a monodisperse emulsion or a polydisperse emulsion.

The preparation of the silver halide photographic emulsion which can be used in the present invention can be accomplished by any suitable method described in *Research Disclosure* (RD) No. 17643 (December 1978), pp. 22–23, "I. Emulsion Preparation and Types", and No. 18716 (November 1979), page 648; Glafkides, *Chimie et Physique Photographique*, Paul Montel (1967), G. F. Duffin, *Photographic Emulsion Chemistry*, Focal Press, (1966); and V. L. Zelikman et al., *Making and Coating Photographic Emulsion*, Focal Press, (1964).

Furthermore, the monodisperse emulsions as described in U.S. Pat. Nos. 3,574,628 and 3,655,394 and British Patent 1,413,748 are preferably used in the present invention.

Tabular grains having an aspect ratio of about 3 or more can be used in the present invention. The preparation of such tabular grains is easily accomplished by any suitable method such as described in Gutoff, *Photographic Science and Engineering*, Vol. 14, pp. 248–257, 1970; U.S. Pat. Nos. 4,434,226, 4,414,310, 4,433,048, and 4,439,520, and British Patent 2,112,157.

The individual silver halide crystals may have either a homogeneous structure or a heterogeneous structure comprising a core and an outer shell differing in halogen composition, or may have a layered structure. Furthermore, the grains may have fused thereto by epitaxy a silver halide having a different halogen composition or may be bonded to a compound other than silver halide, e.g., silver thiocyanate, lead oxide, etc. Mixtures of grains having various crystal forms may also be used.

The above mentioned emulsion may be either the surface latent image type in which latent images are formed mainly on the surface of grains, the internal latent image type in which latent images are formed in the inside of grains, or the type in which latent images are formed both on the surface and in the inside of grains. However, the above mentioned emulsion needs to be a negative type emulsion. If the above mentioned emulsion is the internal latent image type, it may be the core/shell internal latent image type emulsion described in JP-A-63-264740. The process for the preparation of such a core/shell internal latent image type emulsion is described in JP-A-59-133542. The thickness of the emulsion depends on the development process and is preferably from 3 to 40 nm, particularly 5 to 20 nm.

The silver halide emulsion to be used in the present invention is normally subjected to physical ripening, chemical ripening and spectral sensitization. Additives to be used in these steps are described in *Research Disclosure* Nos. 17643, 18716, and 307105 as tabulated below.

In the light-sensitive material of the present invention, two or more light-sensitive silver halide emulsions which are different in at least one characteristic, such as grain size, grain size distribution, halogen composition, grain shape and sensitivity, may be incorporated in the same layer.

Silver halide grains whose surface is fogged as described in U.S. Pat. No. 4,082,553, silver halide grains whose interior is fogged as described in U.S. Pat. No. 4,626,498 and JP-A-59-214852, and colloidal silver may be preferably incorporated in the light-sensitive silver halide emulsion layer and/or substantially light-insensitive hydrophilic colloidal layer. The silver halide grains whose interior and/or surface is fogged are silver halide grains which can be uniformly (nonimagewise) developed regardless of whether they are on the exposed or unexposed portion of the light-sensitive material. The process for the preparation of silver halide grains whose interior or surface is fogged is described in U.S. Pat. No. 4,626,498 and JP-A-59-214852.

Silver halides which form the core of core/shell type silver halide grains whose interior is fogged may have the same halogen composition or different halogen compositions. The silver halide to be fogged on the surface or in the interior thereof, may be silver chloride, silver bromochloride, silver bromoiodide and silver bromochloroiodide. These fogged silver halide grains are not specifically limited in their size. The average grain size is preferably from 0.01 to 0.75 μm, particularly 0.05 to 0.6 μm. The grain shape is not specifically limited. The silver halide grains may have regular crystal forms or may be polydispersant, but are preferably monodispersant (that is, at least 95% of silver halide grains by weight or grain number have grain sizes which fall within ±40% of the average grain size).

In the present invention, finely divided light-insensitive silver halide grains are preferably used. Finely divided light-insensitive silver halide grains are finely divided silver halide grains which are not sensitive to light upon imagewise exposure for obtaining color images and are not substantially developed. Preferably, finely divided light-insensitive silver halide grains are not previously fogged.

The finely divided light-insensitive silver halide grains have a silver bromide content of 0 to 100 mol% and may optionally contain silver chloride and/or silver iodide, preferably 0.5 to 10 mol% silver iodide.

The finely divided light-insensitive silver halide grains preferably have an average grain diameter of 0.01 to 0.5 μm (as calculated in terms of average of diameters of projected area corresponding to sphere), more preferably 0.02 to 0.2 μm.

The preparation of the finely divided light-insensitive silver halide grains can be accomplished in the same manner as ordinary light-sensitive silver halide. In this case, the surface of the silver halide grains does not need to be optically sensitized. Also, the silver halide grains don not need to be spectrally sensitized. However, before being added to the coating solution, the silver halide emulsion preferably comprises a known stabilizer such as a triazole, azaindene, benzothiazolium or mercapto compound incorporated therein. Colloidal silver may be preferably incorporated in the layer containing finely divided light-insensitive silver halide grains.

The amount of silver to be coated on the light-sensitive material of the present invention is preferably from 6.0 g/m$^2$ or less, more preferably 4.5 g/m$^2$ or less.

Known photographic additives which can be used in the present invention are also described in the above cited three references as shown in the following table.

| Kind of additive | RD17643 [Dec. '78] | RD18716 [Nov. '79] | RD307105 [Nov. '89] |
|---|---|---|---|
| 1. Chemical sensitizer | p. 23 | p. 648 right column (RC) | p. 866 |
| 2. Sensitivity increasing agent | | p. 648 RC | |
| 3. Spectral sensitizer and supersensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 left column (LC) | p. 873 |
| 7. Stain inhibitor | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 650 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

In order to inhibit deterioration in photographic properties due to formaldehyde gas, a compound capable of reacting with and fixing formaldehyde such as disclosed in U.S. Pat. Nos. 4,411,987 and 4,435,503 can be incorporated in the light-sensitive material.

Mercapto compounds described in U.S. Pat. Nos. 4,740,454, and 4,788,132, and JP-A-62-18539, and JP-A-1-283551 may be preferably incorporated in the light-sensitive material of the present invention.

A compound which releases a fogging agent, a development accelerator, a silver halide solvent or precursors thereof regardless of the amount of developed silver produced by development disclosed in JP-A-1-106052 may be preferably incorporated in the light-sensitive material of the present invention.

A dye dispersed by the process described in International Patent Disclosure WO88/04794 and JP-A-1-502912 or a dye described in EP317,308A, U.S. Pat. No. 4,420,555, and JP-A-1-259358 may be preferably incorporated in the light-sensitive material of the present invention..

Various color couplers can be used in the present invention. Specific examples of the color couplers are described in the patents identified in the above cited *Research Disclosure* No. 17643, VII-C to G and No. 307105, VII-C to G.

The yellow couplers which are preferably used in combination with the coupler represented by the general formula (CI) to (CIV) are those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

The preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 3,636, JP-A-60-33552, JP-A-60-43659, JP-A-61-72238, JP-A- 60-35730, JP-A-55-

118034, and JP-A-60-185951, RD Nos. 24220 (June 1984) and 24230 (June 1984) , and WO(PCT)88/04795.

The cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Disclosure No. 3,329,729, European Patents 121,365A and 249,453A, and JP-A-61-42658. Furthermore, the pyrazoloazole couplers described in JP-A-64-553, JP-A-64-554, JP-A-64-555 and JP-A-64-556 and the imidazole couplers described in U.S. Pat. No. 4,818,672 can be used.

Typical examples of polymerized dye-forming couplers are described in U.S. Pat. Nos. 3,451,820, 4,367,282, 4,409,320, and 4,576,910, British Patent 2,102,173, and European Patent 341,188A.

Couplers which form a dye having moderate diffusibility preferably include those described in U.S. Pat. No. 4,366,237, British Patent 2,125,570, European Patent 96,570, and West German Patent Publication No. 3,234,533.

In addition to the yellow-colored cyan couplers of the present invention, colored couplers for correction of undesired absorptions of the developed color preferably include those described in *Research Disclosure* No. 17643, VII-G, U.S. Pat. Nos. 4,163,670, 4,004,929, and 4,138,258, JP-B-57-39413, and British Patent 1,146,368. Furthermore, couplers for correction of undesired absorptions of the developed color by a fluorescent dye released upon coupling described in U.S. Pat. No. 4,774,181 and couplers containing as a separable group a dye precursor group capable of reacting with a developing agent to form a dye described in U.S. Pat. No. 4,777,120, can be preferably used.

Couplers capable of releasing a photographically useful group upon coupling can also be used in the present invention. Preferred examples of DIR couplers which release a developing inhibitor are described in the patents cited in *RD* 17643, VII-F, and No. 307105, VII-F, JP-A-57-151944, JP-A-57-154234, JP-A-60-184248, and JP-A-63-37346, JP-A-63-37350 and U.S. Pat. Nos. 4,248,962, and 4,782,012.

Bleach accelerator-releasing couplers such as described in *RD* Nos. 11449, and 24241, and JP-A-61-201247 are effective for reducing the time required for bleaching, particularly when incorporated in a light-sensitive material comprising the above mentioned tabular silver halide grains. Couplers capable of imagewise releasing a nucleating agent or a developing accelerator at the time of development preferably include those described in British Patents 2,097,140 and 2,131,188, and JP-A-59-157638 and JP-A-59-170840. Compounds which undergo a redox reaction with an oxidation product of a developing agent to release a fogging agent, development accelerator, silver halide solvent or the like such as described in JP-A-60-107029, JP-A-60-252340, JP-A-1-44940, and JP-A-1-45687 may be preferably used.

In addition to the foregoing couplers, the photographic material according to the present invention can further comprise competing couplers such as described in U.S. Pat. No. 4,130,427, polyequivalent couplers such as described in U.S. Pat. Nos. 4,283,472, 4,338,393, and 4,310,618, DIR redox compounds or DIR couplers or DIR coupler-releasing couplers such as described in JP-A-60-185950 and JP-A-62-24252, couplers capable of releasing a dye which returns to its original color after release such as described in European Patent 173,302A, couplers capable of releasing a ligand such as described in U.S. Pat. No. 4,553,477, couplers capable of releasing a leuco dye such as described in JP-A-63-75747, and couplers capable of releasing a fluorescent dye such as described in U.S. Pat. No. 4,774,181.

The incorporation of these couplers in the light-sensitive material can be accomplished by any suitable known dispersion method.

Examples of high boiling point solvents to be used in an oil-in-water dispersion process are described in U.S. Pat. No. 2,322,027. Specific examples of high boiling point organic solvents which have a boiling point of 175° C. or higher at normal pressure and which can be used in the oil-in-water dispersion process include phthalic esters (e.g., dibutyl phthalate, dicylcohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl phosphate, tri-2ethylhexyl phosphate, tridecyl phosphate, tributoxy ethyl phosphate, trichloropropyl phosphate, di-2ethylhexyl phenyl phosphonate), benzoic esters (e.g., 2ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropyl naphthalene). An auxiliary solvent can be used such as an organic solvent having a boiling point of about 30° C. or higher, preferably 50° C. to about 160° C. Typical examples of such an organic solvent are ethyl acetate, butyl acetate, ethyl propionate, methyl ethyl ketone, cyclohexanone, 2-ethoxyethyl acetate, and dimethylformamide.

The process and effects of a latex dispersion method and specific examples of latexes to be used in dipping are described in U.S. Pat. No. 4,199,363, West German Patent Application (OLS) 2,541,274, and 2,541,230.

Various preservatives or antimolds such as 1,2-benzisothiazoline- 3-one, n-butyl, p-hydroxybenzoate, phenol, 4-chloro-3,5-dimethylphenol, 2-phenoxyethanol, and 2-(4-thiazolyl)benzimidazole as described in JP-A-63-257747, JP-A-62-272248, and JP-A-1-80941 may be preferably incorporated in the present color light-sensitive material.

The present invention is applicable to various types of color light-sensitive materials, particularly preferably to color negative films for common use or motion picture, color reversal films for slide or television, color papers, color positive films and color reversal papers.

Suitable supports which can be used in the present invention are described in the above cited *RD* 17643 (page 28) and 18716 (right column on page 647 to left column on page 648).

In the present light-sensitive material, the total thickness of all the hydrophilic colloidal layers on the emulsion side is preferably from 28 μm or less, more preferably 23 μm or less, most preferably 18 μm or less and particularly 16 μm or less. The film swelling rate $T_{1/2}$ is preferably 30 seconds or less, more preferably 20 seconds or less. In the present invention, the film thickness is determined after being stored at a temperature of 25° C. and a relative humidity of 55% over 2 days. The film swelling rate $T_{1/2}$ can be determined by a method known in the art, e.g., by means of a swellometer of the type as described in A. Green et al, *Photographic Science Engineering*, Vol. 19, No. 2, pp. 124–129. $T_{1/2}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling rate $T_{1/2}$ can be adjusted by adding a film hardener to a gelatin binder or altering the ageing condition after coating. The percentage of swelling of the light-sensitive material is preferably from 150 to 400%. The percentage of swelling can be calculated from the maximum swollen film thickness determined as described above in accordance with the equation: (maximum swollen film thickness–film thickness)/film thickness.

In the light-sensitive material of the present invention, one or more hydrophilic colloidal layer as backing layers having a total dried thickness of 2 to 20 μm may be preferably provided on the side of the support opposite to the emulsion layer. The backing layers preferably contain the above mentioned additives, e.g., a light absorbent, filter dye, ultraviolet absorbent, antistatic agent, film hardener, binder, plasticizer, coating aid, surface active agent, etc. The percent of swelling of the backing layers is preferably from 150 to 500%.

The color photographic light-sensitive material according to the present invention can be developed in accordance with a conventional method as described in *RD* Nos 17643 (pp. 28–29) and 18716 (left column—right column on page 651).

The color developer to be used in the development of the present light-sensitive material is preferably an alkaline aqueous solution containing as a main component an aromatic primary amine color developing agent. For instance, the color developing agent can be an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl—N-β -hydroxyethylaniline, 3-methyl-4-amino-N-ethyl-N-β -methanesulfonamideethylaniline, 3-methyl-4-amino-N-ethyl-N-β -methoxyethylaniline, and sulfates, hydrochlorides and p-toluenesulfonates thereof. These compounds can be used in combination of two or more thereof depending on the purpose of the application.

The color developer normally contains a pH buffer such as carbonate and phosphate of an alkaline metal or a development inhibitor or a fog inhibitor such as bromides, iodides, benzimidazoles, benzothiazoles and mercapto compounds. If desired, the color developer may further contain various preservatives, e.g., hydroxylamine, diethylhydroxylamine, sulfites, hydrazines (e.g., N,N-biscarboxymethyl hydrazine), phenylsemicarbazides, triethanolamine, and catecholsulfonic acids; organic solvents, e.g., ethylene glycol and diethylene glycol; development accelerators, e.g., benzyl alcohol, polyethylene glycol, quaternary ammonium salts, and amines; color-forming couplers; competing couplers; auxiliary developing agents, e.g., 1-phenyl-3-pyrazolidone; viscosity-imparting agents; various chelating agents exemplified by aminopolycarboxylic acids, aminopolyphosphoric acids, alkylphosphonic acids, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N' -tetramethylenephosphonic acid, and ethylenediamine-di(o-hydroxyphenylacetic acid), and salts thereof.

Reversal processing is usually carried out by black-and-white development followed by color development. Black-and-white developers to be used can contain one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol. The color developer or black-and-white developer usually has a pH of from 9 to 12. The replenishment rate of the developer is usually 3 or less per $m^2$ of the light-sensitive material, depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with the air in the processing tank to thereby prevent evaporation and air-oxidation of the liquid.

The area of the liquid surface in contact with the air can be represented by the opening ratio defined as follows:

$$\text{Opening ratio} = \text{Area of liquid surface in contact with air } (cm^3) / \text{volume of liquid } (cm^3)$$

The opening ratio is preferably 0.1 or less, more preferably 0.001 to 0.05. The reduction of the opening ratio can be accomplished by providing a cover such as a floating cover on the surface of a photographic processing solution in the processing tank, or by a process which comprises the use of a mobile cover as described in JP-A-1-82033, or a slit development process as described in JP-A-63-216050. The reduction of the opening ratio can be applied not only to both the color development and black-and-white development but also to the subsequent steps such as bleach, blix, fixing, rinse and stabilization. The replenishment rate can also be reduced by a means for suppressing accumulation of the bromide ion in the developing solution.

The color development time is normally selected between 2 and 5 minutes. The color development time can be further reduced by carrying out color development at an elevated temperature and a high pH value with a color developing solution containing a color developing agent in a high concentration.

The photographic emulsion layer which has been color-developed is normally subjected to bleaching and fixing to effect desilvering. Bleaching may be effected simultaneously with fixing (i.e., blix), or these two steps may be carried out separately. For speeding up processing, bleaching may be followed by blix. Further, an embodiment wherein two blix baths connected in series are used, an embodiment wherein blix is preceded by fixing, or an embodiment wherein blix is followed by bleaching may be selected arbitrarily according to the purpose.

Bleaching agents to be used include compounds of polyvalent metals, e.g., iron (III), peroxides, quinones, and nitro compounds. Typical examples of these bleaching agents are organic complex salts of iron (III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetato)iron (III) complex salts are preferred for speeding up processing and for conservation of the environment. In particular, aminopolycarboxylic acid-iron (III) complex salts are useful in both a bleaching solution and a blix solution. The bleaching or blix solution comprising such an aminopolycarboxylic acid-iron (III) complex salt normally has a pH value of 4.0 to 8.0. For speeding up processing, it is possible to adopt a lower pH value.

The bleaching bath, blix bath or a prebath thereof can contain, if desired, a bleaching accelerator. Examples of useful bleaching accelerators include compounds containing a mercapto group or a disulfide group such as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A- 53-124424, JP-A-53-141623, and JP-A-53-28426, and *Research Disclosure No.* 17129 (July 1978), thiazolidine derivatives such as described in JP-A-50-140129, thiourea derivatives such as described in U.S. Pat. No. 3,706,561, iodides such as described in West German Patent 1,127,715 and JP-A-58-16235, polyoxyethylene compounds such as described in West German Patents 966,410 and 2,748,430, polyamine compounds such as described in JP-B-45-8836, the compounds as described in JP-A-49-40943, JP-A-49-59644, JP-A-53-94927, JP-A-54-35727, JP-A-55-26506, and JP-A-58-163940, and bromine ions. Preferred among these compounds are those containing a mercapto group or a disulfide group because of their great accelerating effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for photographing.

The bleaching solution or blix solution to be used in the present invention may preferably comprise an organic acid in addition to the above mentioned compounds for the purpose of inhibiting bleach stain. A particularly preferred organic acid is one having an acid dissociation constant (pKa) of 2 to 5. Specific examples of such an organic acid include acetic acid, propionic acid and hydroxyacetic acid.

Fixing agents to be used for fixation in a fixing solution or blix solution include thiosulfates, thiocyanates, thioethers, thioureas, and a large amount of iodides. The thiosulfates are normally used, with ammonium thiosulfate being applicable most often. These thiosulfates may be preferably used in combination with thiocyanates, thioether compounds, thiourea or the like. As preservatives of the fixing bath or blix bath there can be preferably used sulfites, bisulfites, carbonyl bisulfite adducts or sulfinic acid compounds such as described in European Patent 294769A. Further, various aminopolycarboxylic acids or organic phosphonic acids can be added to the fixing bath or blix bath for the purpose of stabilizing the solution.

In the present invention, the fixing solution or blix solution preferably comprises a compound having a pKa of 6.0 to 9.0, preferably an imidazole such as imidazole, 1-methylimidazole, 1-ethylimidazole and 2-methylimidazole, in an amount of 0.1 to 10 mol/l The total desilvering time is preferably short so long as insufficient desilvering does not result. The total desilvering time is preferably from 1 to 3 minutes, more preferably 1 to 2 minutes. The desilvering temperature is from 25° to 50° C., preferably 35° to 45° C. In this preferred temperature range, the desilvering rate can be improved, and the occurrence of stain after processing can be effectively inhibited.

In the desilvering step, agitation is preferably intensified as much as possible. In particular, agitation can be intensified by various methods. For example, the processing solution may be jetted to the surface of the emulsion layer in the light-sensitive material as described in JP-A-62-183460 and JP-A-62-183461. The agitating effect can be improved by a rotary means as described in JP-A-62-183461. Furthermore, the agitating effect can be improved by moving the light-sensitive material with the emulsion surface in contact with a wiper blade provided in the bath so that turbulence occurs on the emulsion surface. Moreover, the agitation can be intensified by increasing the total circulated amount of processing solution. Such agitation improving methods can be effectively applied to the bleaching bath, blix bath or fixing bath. The improvement agitation effect expedites the supply of a bleaching agent, fixing agent or the like into the emulsion film, resulting in an improved desilvering rate. The above mentioned agitation improving method is more effective when a bleach accelerator is used. In this case, the agitation improving method can remarkably enhance the bleach accelerating effect or eliminate the effect of inhibiting fixation by the bleach accelerator.

An automatic developing machine which can be used in the present invention is preferably equipped with a light-sensitive material conveying means as described in JP-A-60-191257, JP-A-60-191258, and JP-A- 60-191259. As described in the above cited JP-A-60-191257, such a conveying means can remarkably reduce the amount of the processing solution carried over from a bath to a succeeding bath, exhibiting a high effect of inhibiting the deterioration of properties of the processing solution. Such an effect is particularly effective for the reduction of the processing time at each step or the replenishment rate of the processing solution.

It is usual that the thus desilvered silver halide color photographic materials of the invention are subjected to washing and/or stabilization. The quantity of water to be used in the washing step can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or direct-flow system), and other various factors. Of these factors, the relationship between the number of washing tanks and the quantity of water in the multistage counter-flow system can be obtained according to the method described in *Journal of the Society of Motion Picture* and *Television Engineers*, Vol. 64, pp. 248–253 (May 1955). According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabendazoles such as described in JP-A-57-8542, chlorine type bactericides, e.g., chlorinated sodium isocyanurate, benzotriazole, and bactericides described in Hiroshi Horiguchi, *Bokinbobaizai no kagaku*, Eisei Gijutsu Gakkai (ed.), *Biseibutsu no mekkin, sakkin, bobigijutsu*, and Nippon Bokin Bobi Gakkai (ed.), *Bokin bobizai jiten* (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization step, any of the known techniques as described in JP-A-57-8543, JP-A-58-14834, and JP-A-60-220345 can be used.

The aforesaid washing step may be followed by stabilization in some cases. For example, a stabilizing bath containing a dye stabilizer and a surface active agent may be used as a final bath for color light-sensitive materials for picture taking. Examples of such a dye stabilizer include aldehydes such as formaldehyde and glutaraldehyde, N-methylol compounds, hexamethylenetetramine, and aldehyde-sulfurous acid adducts. This stabilizing bath may also contain various chelating agents or bactericides.

The overflow accompanying replenishment of the washing bath and/or stabilizing bath can be reused in other steps such as desilvering.

In the processing using an automatic developing machine, if these processing solutions are concentrated due to evaporation, water may be preferably supplied to the system to make up for the concentration.

The silver halide color light-sensitive material may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure* Nos. 14,850 and 15,159, aldol compounds described in *Research Disclosure* No. 13,924, metal complexes as described in U.S. Pat. No. 3,719,492, and urethane compounds as described in JP-A-53-135628.

The silver halide color light-sensitive material may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature is normally from 33° C. to 38° C. However, a higher temperature can be used to accelerate processing, thereby reducing the processing time. On the contrary, a lower temperature can be used to improve the picture quality or the stability of the processing solutions.

The silver halide photographic material can also be applied to a heat-developable light-sensitive material as described in U.S. Pat. No. 4,500,626, JP-A-60- 33449, JP-A-59-218443, and JP-A-61-238056, and European Patent 210,660A2.

As described and demonstrated herein below, the silver halide color photographic material having at least one layer containing a yellow-colored cyan coupler and at least one layer containing a compound capable of releasing a bleaching accelerator on coupling with an oxidation product of an aromatic primary amine color developing agent provides a cyan dye image whose color turbidity is reduced. Further, as compared with a single use of the bleaching accelerator-releasing compound, a combined use with the yellow-colored cyan coupler brings about a marked reduction in the amount of residual silver after processing, thereby providing a color image with improved color reproduction. Silver halide color photographic materials of the present invention additionally exhibit excellent stability of photographic properties in continuous processing or with time and improved dye image stability.

The present invention also provides a method for processing a silver halide color photographic material, which process achieves improved color reproduction and which also causes no increase in the amount of residual silver after processing even when the processing time for all steps excluding color development and drying is shortened.

The present invention will be further described in the following examples, but the present invention should not be construed as being limited thereto.

EXAMPLE 1

Preparation of Sample 101:

The following layers were coated on a cellulose triacetate film support having a subbing layer to prepare a multi-layer color light-sensitive material. The resulting material was designated Sample 101.

| | |
|---|---|
| **1st Layer (Antihalation Layer):** | |
| Black colloidal silver | 0.35 g-Ag/m$^2$ |
| Gelatin | 1.50 g/m$^2$ |
| UV-1 | 0.20 g/m$^2$ |
| CC-1 | 0.05 g/m$^2$ |
| CM-1 | 0.05 g/m$^2$ |
| Solv-1 | 0.20 g/m$^2$ |
| **2nd Layer (Intermediate Layer):** | |
| Gelatin | 1.50 g/m$^2$ |
| UV-1 | 0.01 g/m$^2$ |
| Solv-1 | 0.01 g/m$^2$ |
| **3rd Layer (Low Sensitivity Red-Sensitive Emulsion Layer):** | |
| Mono-dispersed silver iodobromide emulsion (average AgI content: 7.5 mol %; mean grain size: 0.46 μm) | 1.10 g-Ag/m$^2$ |
| Mono-dispersed silver iodobromide emulsion (average AgI content: 2.0 mol %; mean grain size: 0.32 μm) | 0.60 g-Ag/m$^2$ |
| Gelatin | 1.50 g/m$^2$ |
| ExS-1 | $2.5 \times 10^{-4}$ mol/mol-AgX (X: halogen) |
| ExS-2 | $2.5 \times 10^{-4}$ mol/mol-AgX |
| ExS-3 | $5.0 \times 10^{-5}$ mol/mol-AgX |
| ExC-1 | 1.00 g/m$^2$ |
| ExC-4 | 0.05 g/m$^2$ |
| CC-1 | 0.05 g/m$^2$ |
| ExD-1 | 0.002 g/m$^2$ |
| Solv-1 | 0.50 g/m$^2$ |
| **4th Layer (High Sensitivity Red-Sensitive Emulsion Layer):** | |
| Mono-dispersed silver iodobromide emulsion (average AgI content: 6.0 mol %; mean grain size: 0.78 μm) | 2.30 g-Ag/m$^2$ |
| Gelatin | 1.50 g/m$^2$ |
| ExS-1 | $2.0 \times 10^{-4}$ mol/mol-AgX |
| ExS-2 | $2.0 \times 10^{-4}$ mol/mol-AgX |
| ExS-3 | $1.0 \times 10^{-5}$ mol/mol-AgX |
| ExC-2 | 0.015 g/m$^2$ |
| ExC-3 | 0.25 g/m$^2$ |
| CC-1 | 0.015 g/m$^2$ |
| ExD-2 | 0.05 g/m$^2$ |
| Solv-1 | 0.50 g/m$^2$ |
| **5th Layer (Intermediate Layer):** | |
| Gelatin | 0.50 g/m$^2$ |
| **6th Layer (Low Sensitivity Green-Sensitive Emulsion, Layer):** | |
| Mono-dispersed silver iodobromide emulsion (average AgI content: 7.5 mol %; mean grain size: 0.46 μm) | 1.20 g-Ag/m$^2$ |
| Gelatin | 1.00 g/m$^2$ |
| ExS-4 | $5.0 \times 10^{-4}$ mol/mol-AgX |
| ExS-5 | $1.0 \times 10^{-4}$ mol/mol-AgX |
| ExM-1 | 0.40 g/m$^2$ |
| CM-1 | 0.05 g/m$^2$ |
| ExD-3 | 0.015 g/m$^2$ |
| ExD-4 | 0.02 g/m$^2$ |
| Solv-2 | 0.60 g/m$^2$ |
| **7th Layer (Intermediate Layer):** | |
| Gelatin | 0.80 g/m$^2$ |

| | |
|---|---|
| Solv-1 | 0.20 g/m$^2$ |
| 8th Layer (High Sensitivity Green-Sensitive Emulsion Layer): | |
| Mono-dispersed silver bromide emulsion (average AgI content: 6.0 mol %; mean grain size: 0.78 μm) | 1.60 g-Ag/m$^2$ |
| Gelatin | 1.00 g/m$^2$ |
| ExS-6 | $1.5 \times 10^{-4}$ mol/mol-AgX |
| ExS-7 | $2.5 \times 10^{-4}$ mol/mol-AgX |
| ExS-8 | $5.0 \times 10^{-5}$ mol/mol-AgX |
| ExM-2 | 0.05 g/m$^2$ |
| ExM-3 | 0.15 g/m$^2$ |
| CM-2 | 0.05 g/m$^2$ |
| ExD-3 | 0.01 g/m$^2$ |
| Solv-3 | 0.50 g/m$^2$ |
| 9th Layer (Yellow Filter Layer): | |
| Yellow colloidal silver | 0.15 g-Ag/m$^2$ |
| Gelatin | 0.80 g/m$^2$ |
| Cpd-1 | 0.10 g/m$^2$ |
| Solv-3 | 0.10 g/m$^2$ |
| 10th Layer (Low Sensitivity- Blue-Sensitive Emulsion Layer): | |
| Mono-dispersed silver iodobromide emulsion (average AgI content: 7.5 mol %; mean grain size: 0.46 μm) | 0.35 g-Ag/m$^2$ |
| Mono-dispersed silver iodobromide emulsion (average AgI content: 2.0 mol %; mean grain size: 0.32 μm) | 0.35 g-Ag/m$^2$ |
| Gelatin | 1.00 g/m$^2$ |
| ExS-10 | $7.0 \times 10^{-4}$ mol/mol-AgX |
| ExY-1 | 0.50 g/m$^2$ |
| ExY-2 | 0.10 g/m$^2$ |
| ExD-2 | 0.01 g/m$^2$ |
| Solv-3 | 0.15 g/m$^2$ |
| 11th Layer (High Sensitivity Blue-Sensitive Emulsion Layer): | |
| Mono-dispersed silver iodobromide emulsion (average AgI content: 8.0 mol %; mean grain size: 0.95 μm) | 0.70 g-Ag/m$^2$ |
| Mono-dispersed silver iodobromide emulsion (average AgI content: 7.5 mol %; mean grain size: 0.46 μm) | 0.30 g-Ag/m$^2$ |
| Gelatin | 1.10 g/m$^2$ |
| ExS-9 | $1.0 \times 10^{-4}$ mol/mol-AgX |
| ExS-10 | $3.0 \times 10^{-4}$ mol/mol-AgX |
| ExY-1 | 0.30 g/m$^2$ |
| ExY-2 | 0.05 g/m$^2$ |
| Solv-3 | 0.07 g/m$^2$ |
| 12th Layer (1st Protective Layer): | |
| Silver iodobromide fine grains emulsion (AgI content: 2.0 mol %; mean grain size: 0.08 μm) | 0.50 g-Ag/m$^2$ |
| Gelatin | 1.00 g/m$^2$ |
| UV-1 | 0.10 g/m$^2$ |
| UV-2 | 0.05 g/m$^2$ |
| Cpd-2 | 0.50 g/m$^2$ |
| Cpd-3 | 0.20 g/m$^2$ |
| Solv-1 | 0.10 g/m$^2$ |
| Solv-4 | 0.10 g/m$^2$ |
| 13th Layer (2nd Protective Layer): | |
| Gelatin | 0.60 g/m$^2$ |
| Alkali-soluble matting agent (average particle size: 2 μm) | 0.10 g/m$^2$ |
| Lubricant | 0.04 g/m$^2$ |
| ExF-1 | 0.005 g/m$^2$ |
| ExF-2 | 0.01 g/m$^2$ |
| W-1 | 0.005 g/m$^2$ |

Each of the above layers further contained a coating aid W-2, a dispersing aid W-3, hardening agents H-1 and H-2, an antiseptic Cpd-4, a stabilizer Cpd-5, and antifoggants Cpd-6 and Cpd-7.

Structural formulae of the compounds used in Sample 101 are shown below.

ExS-1

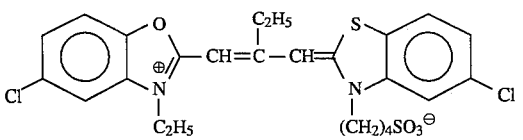

ExS-2

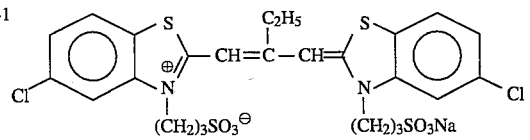

ExS-3

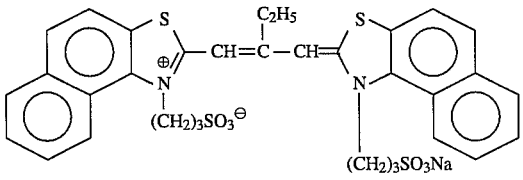

ExS-4

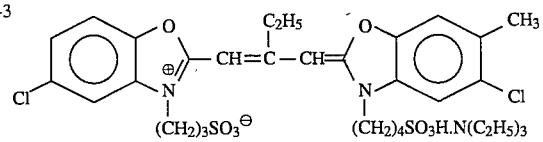

ExS-5

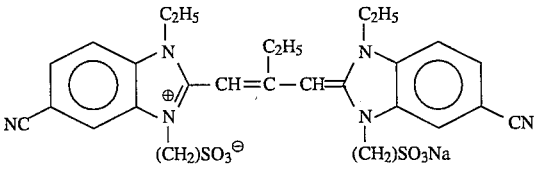

ExS-6

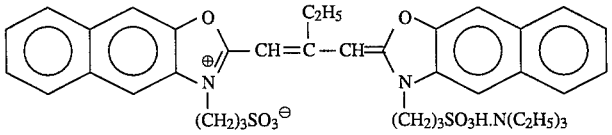

-continued
ExS-7
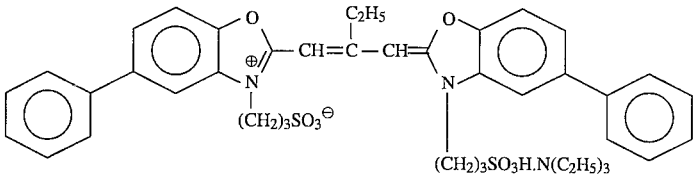
ExS-8
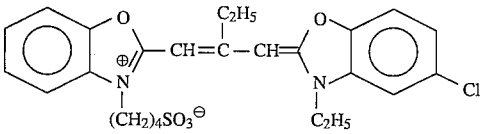
ExS-9
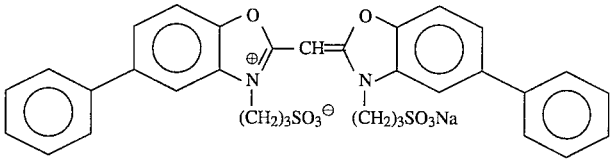
ExS-10
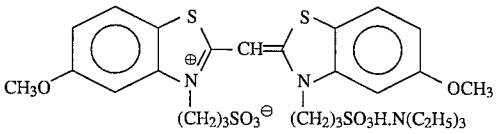
ExC-1
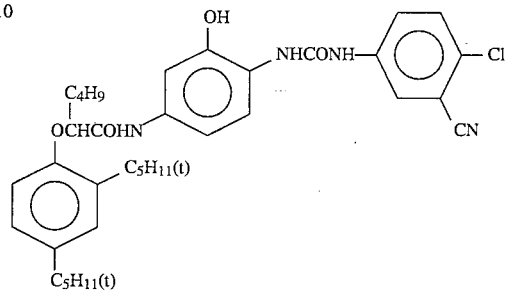
ExC-2
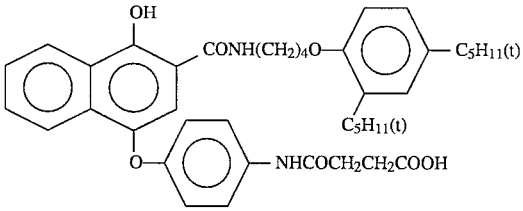
ExC-3
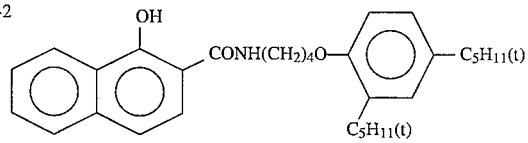
ExC-4
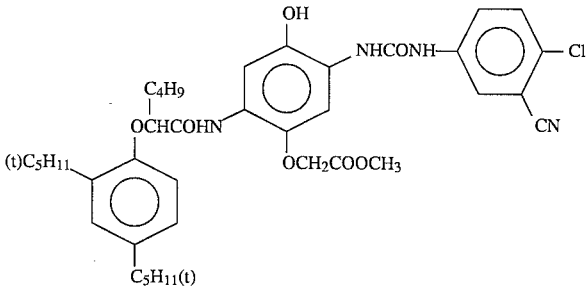

-continued
ExM-1
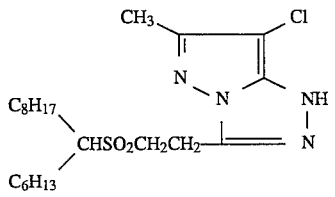
ExM-2
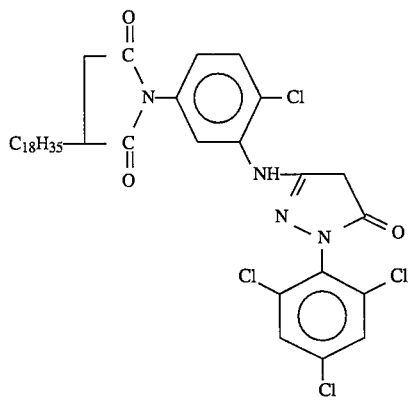
ExM-3
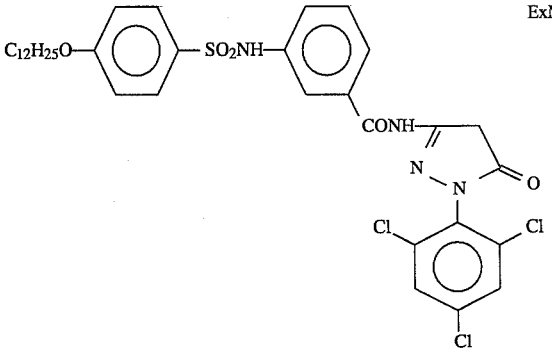
ExY-1
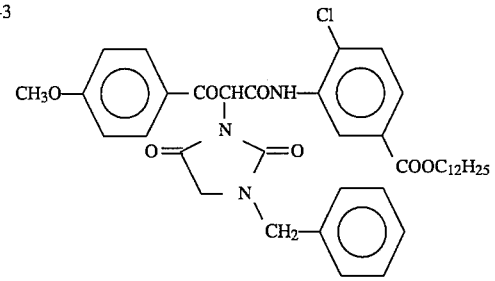
ExY-2
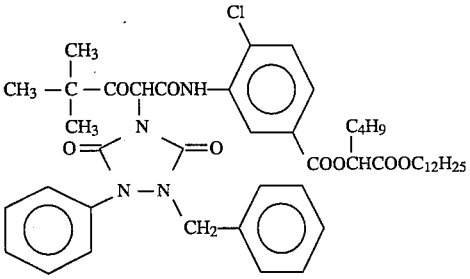
CC-1
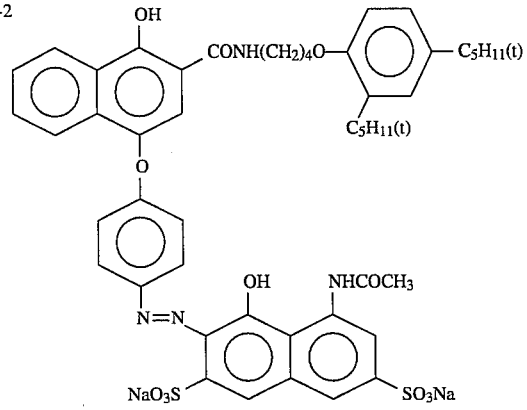
CM-1
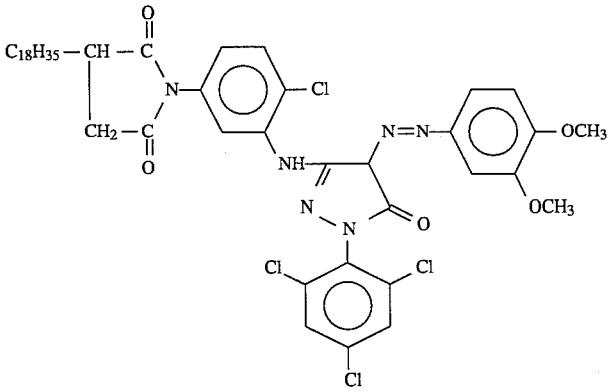

-continued
CM-2
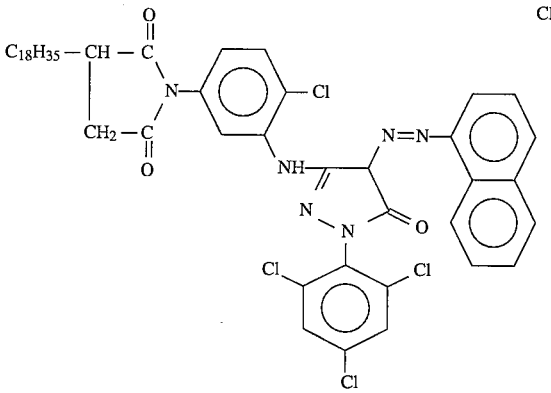
ExD-1
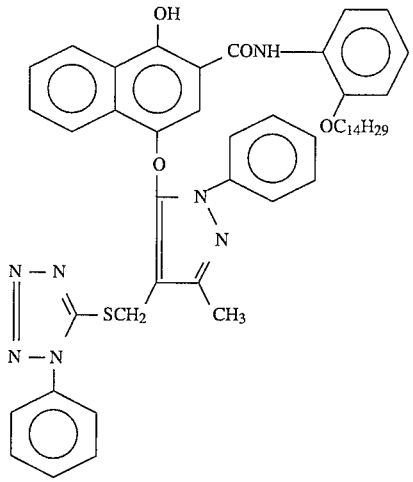
ExD-2
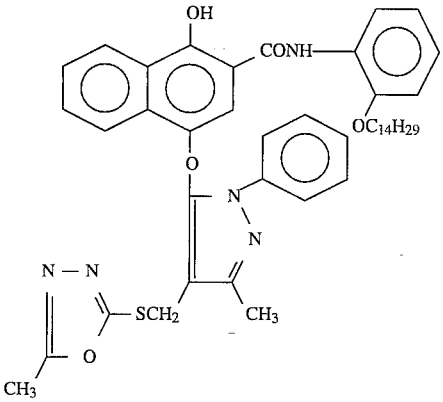
ExD-3
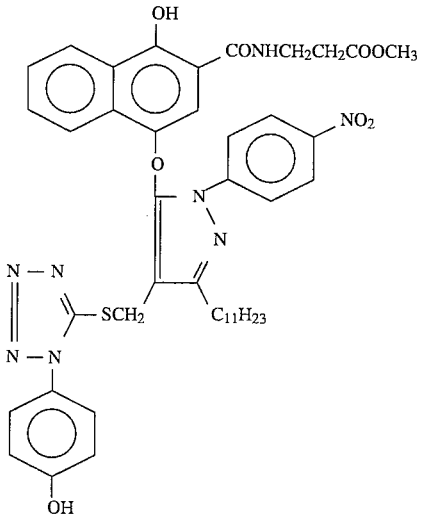
ExD-4
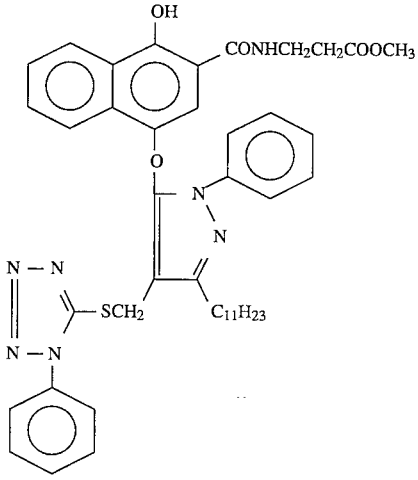
ExF-1
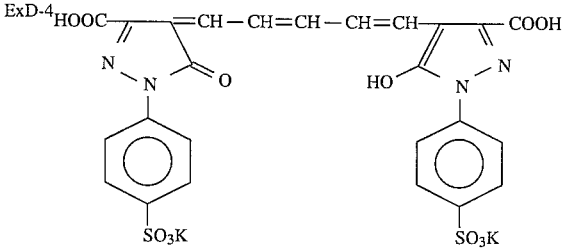

-continued
ExF-2
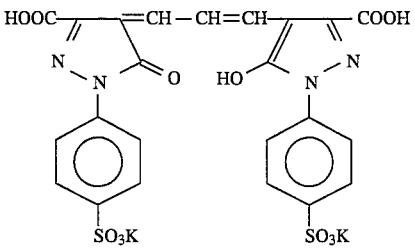
UV-1
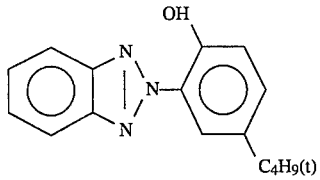
UV-2
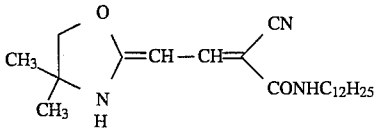
Cpd-1
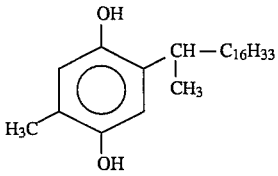
Cpd-2
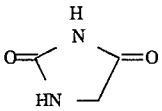
Cpd-3
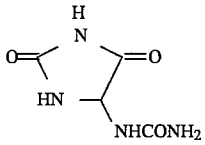
Cpd-4
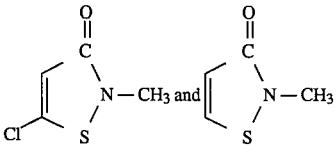
(1:1 by weight)
Cpd-5
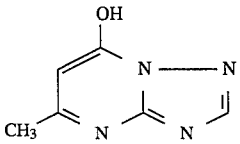
Cpd-6
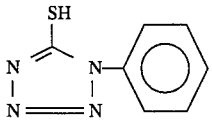
Cpd-7
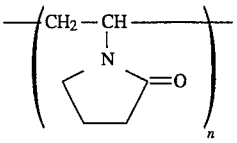
(n ≈ 60)
Solv-1
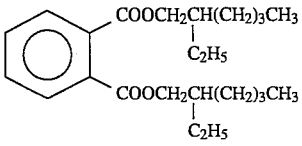
Solv-2
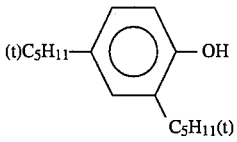
Solv-3
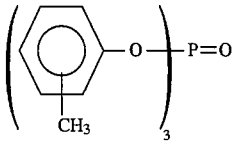
Solv-4
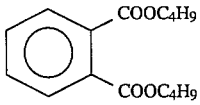
W-1
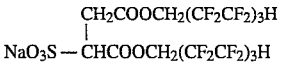
W-2
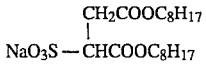
W-3
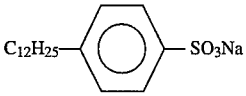
Lubricant
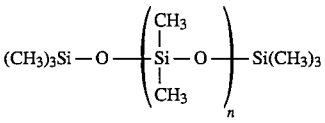
H-1
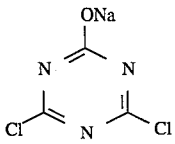
H-2
$[(CH_2{=}CHSO_2CH_2)_3CCH_2SO_2(CH_2)_3]_2N(CH_2)_2SO_3K$ Preparation of Sample 102:

Sample 102 was prepared in the same manner as Sample 101, except for adding 0.10 g/m$^2$ and 0.02 g/m$^2$ of the yellow-colored cyan coupler compound shown below (Compound II-1 described in JP-A-1-319744) to the 3rd and 4th layers (red-sensitive emulsion layers), respectively, changing the amount of ExC-1 in the 3rd layer to 0.93 g/m$^2$, and changing the amount of ExC-3 in the 4th layer to 0.24 g/m$^2$.

Compound II-1:

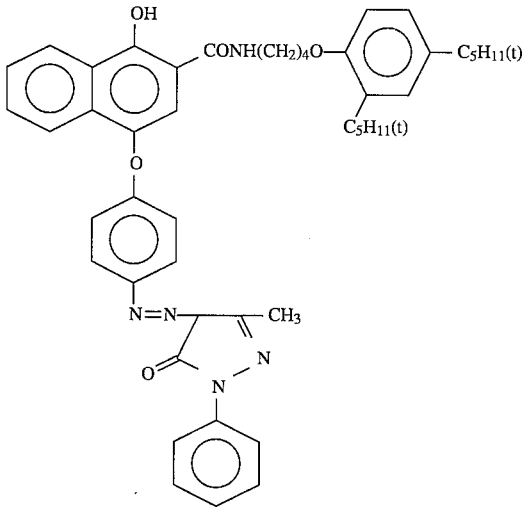

Preparation of Sample 103:

Sample 103 was prepared in the same manner as Sample 101, except for adding to the 3rd layer 0.15 g/m$^2$ of Compound (37) of the present invention as a bleaching accelerator-releasing coupler, changing the amount of ExC-1 in the 3rd layer to 0. 87 g/m2 adding to the 4th layer 0.20 g/m$^2$ of Compound (14) of the present invention as a bleaching accelerator-releasing coupler, and changing the amount of ExC-3 in the 4th layer to 0.10 g/m$^2$.

Preparation of Sample 104:

Sample 104 was prepared in the same manner as Sample 101, except for (1) adding to the 3rd layer the same amount and kind of the yellow-colored cyan coupler as used in the 3rd layer of Sample 102 and adding the same amount and kind of the bleaching accelerator-releasing coupler as used in the 3rd layer of Sample 103, (2) changing the amount of ExC-1 in the 3rd layer to 0.80 g/m$^2$, (3) adding to the 4th layer the same amount and kind of the yellow-colored cyan coupler as used in the 4th layer of Sample 102 and the same amount and kind of the bleaching accelerator-releasing coupler as used in the 4th layer of Sample 103, and (4) changing the amount of ExC-3 in the 4th layer to 0.09 g/m$^2$.

Preparation of Sample 105:

Sample 105 was prepared in the same manner as Sample 102, except for replacing the yellow-colored cyan coupler, Compound II-1 of JP-A-1-319744, as used in the 3rd and 4th layers with the respective equimolar amounts of the yellow-colored cyan coupler compound C-4 shown below (Compound C-4 described in JP-A-61-221748).

Compound C-4:

-continued

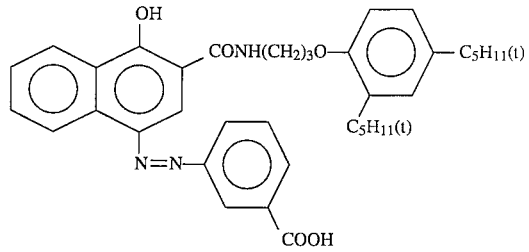

Preparation of Sample 106:

Sample 106 was prepared in the same manner as Sample 104, except for replacing the yellow-colored cyan coupler used in the 3rd and 4th layers with the same molar amount and kind of the yellow-colored cyan coupler as used in Sample 105.

Preparation of Sample 107:

Sample 107 was prepared in the same manner as Sample 102, except for replacing the yellow-colored cyan coupler used in the 3rd and 4th layers with the respective equimolar amount of the yellow-colored cyan coupler of the present invention (YC-10).

Preparation of Sample 108:

Sample 108 was prepared in the same manner as Sample 104, except for replacing the yellow-colored cyan coupler as used in the 3rd and 4th layers with the same molar amount and kind of the yellow-colored cyan coupler as used in Sample 107.

Preparation of Sample 109:

Sample 109 was prepared in the same manner as Sample 107, except for replacing (YC-10) with the equimolar amount of (YC-37).

Preparation of Sample 110:

Sample 110 was prepared in the same manner as Sample 108, except for (1) replacing (YC-10) with the equimolar amount of (YC-37), (2) replacing the bleaching accelerator-releasing coupler used in the 3rd layer with the equimolar amount of Compound (54), and (3) replacing the bleaching accelerator-releasing coupler used in the 4th layer with the equimolar amount of Compound (34).

Preparation of Sample 111:

Sample 111 was prepared in the same manner as Sample 107, except for replacing (YC-10) with the equimolar amount of (YC-51).

Preparation of Sample 112:

Sample 112 was prepared in the same manner as Sample 108, except for (1) replacing (YC-10) with the equimolar amount of (YC-51), (2) replacing the bleaching accelerator-releasing coupler (37) used in the 3rd layer with the equimolar amount of (69), and (3) replacing the bleaching accelerator-releasing coupler (14) used in the 4th layer with the equimolar amount of (33).

Each of Samples 101 to 112 was cut to size and fabricated to prepare a set of two films for each sample. One of the films was wedgewise exposed to light through a red separation filter, and the other was uniformly exposed to white light. The exposed samples were then processed according to the following processing steps.

| Step | Time | Temperature |
|---|---|---|
| Color Development | 3'15" | 38° C. |
| Bleaching | 6'30" | 38° C. |
| Washing | 2'10" | 24° C. |
| Fixing | 4'20" | 38° C. |

-continued

| Step | Time | Temperature |
|---|---|---|
| Washing (1) | 1'05" | 24° C. |
| Washing (2) | 1'00" | 24° C. |
| Stabilization | 1'05" | 38° C. |
| Drying | 4'20" | 55° C. |

Compositions of the processing solutions used were as follows.

| | |
|---|---|
| Color Developer: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH = 10.05 | |
| Bleaching Bath: | |
| Sodium (ethylenediaminetetraacetato)-iron(II) trihydrate | 100.0 g |
| Disodium ethylenediaminetetraacetate | 10.0 g |
| Ammonium bromide | 140.0 g |
| Ammonium nitrate | 30.0 g |
| Aqueous ammonia (27%) | 6.5 ml |
| Water to make | 1.0 l |
| pH = 6.0 | |
| Fixer: | |
| Disodium ethylenediaminetetraacetate | 0.5 g |
| Sodium sulfite | 7.0 g |
| Sodium bisulfite | 5.0 g |
| Aqueous ammonium thiosulfate solution (700 g/l) | 170.0 ml |
| Water to make | 1.0 l |
| pH = 6.7 | |
| Stabilizing Solution: | |
| Formalin (37%) | 2.0 ml |
| Polyoxyethylene-p-monononylphenyl ether (average degree of polymerization: 10) | 0.3 g |
| Disodium ethylenediaminetetraacetate | 0.05 g |
| Water to make | 1.0 l |
| pH = 5.0–8.0 | |

Densities of the samples which were wedgewise exposed to red light were measured to obtain a characteristic curve. In order to evaluate color turbidity of the cyan dye image, the difference ($\Delta D_y$) between the yellow density at the area which was exposed at the same exposure amount as that which gave a density of the minimum density +1.0 in the characteristic curve and the yellow density at the undeveloped area ($_r$) was obtained. A smaller difference ($\Delta D_y$) means lesser color turbidity of the cyan dye image with increased saturation, indicating more excellent color reproduction.

The samples which were uniformly exposed to white light was subjected to fluorescent X-ray analysis to quantitatively determine silver remaining in the processed sample.

The results of these measurements are shown in Table 1 below.

TABLE 1

| Sample No. | Yellow-Colored Cyan Coupler (3rd & 4th Layers) | Beaching Accelerator-Releasing Coupler (3rd & 4th Layers) | $\Delta D_y$ | Residual Silver (mg/m²) |
|---|---|---|---|---|
| 101 (Comparison) | — | — | 0.14 | 56 |
| 102 (Comparison) | (II-1) of JP-A-1-319744 | — | 0.09 | 56 |
| 103 (Comparison) | — | 3rd layer - (37) 4th layer - (14) | 0.14 | 40 |
| 104 (Invention) | (II-1) of JP-A-1-319744 | 3rd layer - (37) 4th layer - (14) | 0.09 | 23 |
| 105 (Comparison) | (C-4) of JP-A-61-221748 | — | 0.10 | 55 |
| 106 (Invention) | " | 3rd layer - (37) 4th layer - (14) | 0.10 | 25 |
| 107 (Comparison) | (YC-10) of the invention | — | 0.06 | 56 |
| 108 (Invention) | " | 3rd layer - (37) 4th layer - (14) | 0.06 | 15 |
| 109 (Comparison) | (YC-37) of the invention | — | 0.06 | 56 |
| 110 (Invention) | " | 3rd layer - (54) 4th layer - (34) | 0.06 | 17 |
| 111 (Comparison) | (YC-51) of the invention | — | 0.07 | 56 |
| 112 (Invention) | " | 3rd layer - (69) 4th layer - (33) | 0.07 | 20 |

As can be seen from the results in Table 1, use of yellow-colored cyan couplers obviously reduces color turbidity. It is also apparent that in the order of effect they are a colored coupler having a water-soluble 6-hydroxy-2-pyridon-5-ylazo group (YC-10), a colored coupler having a water-soluble 2-acylaminophenylazo group (YC-37), a colored coupler having a water-soluble pyrazolon-4-ylazo group (YC-51), the coupler (II-1) of JP-A-1-319744, and the coupler (C-4) of JP-A-61-221748.

It is known in practice that a residual silver amount exceeding 30 mg/m² causes great deterioration of photographic performance properties in terms of color reproduction and/or gradation balance. In this connection, the results in Table 1 reveal that a bleaching accelerator-releasing agent is insufficient for decreasing the remaining silver when used alone but exhibits an unexpected improving effect when used in combination with these yellow-colored cyan couplers. This desilvering improving effect probably occurs because an azo-containing group which is released from the yellow-colored cyan coupler in the coupling reaction takes part in desorption of compounds which have been adsorbed onto silver and have interfered with the bleaching action, such as sensitizing dyes.

EXAMPLE 2

Each of Samples 101 to 112 prepared in Example 1 (a set of two films per each sample) was exposed to light in the same manner as in Example 1.

Separately, Sample 101 of Example 1 was image-wise exposed to light and continuously processed with a processing machine for motion picture film according to the following schedule until the cumulative amount of the replenisher added to the bleaching bath reached three times the bath volume.

Then, the above-prepared exposed samples were processed with the processing machine in the same manner.

| Step | Time | Temp. | Rate of Replenishment* | Tank Volume |
|---|---|---|---|---|
| Color Development | 3' 00" | 37.5° C. | 20 ml | 10 l |
| Bleaching | 30" | 38.0° C. | 45 ml | 5 l |
| Blixing | 30" | 38.0° C. | — | 5 l |
| Fixing | 30" | 38.0° C. | 30 ml | 5 l |
| Washing (1) | 20" | 38.0° C. | — | 5 l |
| Washing (2) | 20" | 38.0° C. | 30 ml | 5 l |
| Stabilization | 20" | 38.0° C. | 20 ml | 5 l |
| Drying | 1' | 55° C. | | |

Note:
*per m of 35-mm wide film

Washing was conducted in a counter-flow system of from (2) toward (1), and all overflow from the washing tank (1) was circulated to the fixing tank.

All overflow from the bleaching tank and fixing tank was circulated to the blix tank.

The amount of the developer carried over into the bleaching step and the amount of the fixer carried over into the washing step were 2.5 ml and 2.0 ml, respectively, per m of 35-mm wide film. Each cross-over time between two steps was 5 seconds, and this cross-over time was included in the processing time of the preceding step.

The bleaching tank, blixing tank, and fixing tank each had an opening ratio of 0.02.

Stirring in the automatic developing machine was effected by spouting jet streams through a plurality of holes of 1.2 mm in diameter from the outside to the inside of the rack by means of a IWAKI magnet pump and striking the jet streams against the emulsion surface of the light-sensitive material from a distance of about 10 mm. The size of the pump, flow rate, and number of spouting holes in each tank are shown below.

| Step | Pump | Flow Rate (l/min) | Number of Spouting Holes |
|---|---|---|---|
| Color Development | MD-20 | 15 | 54 |
| Bleaching | MD-20 | 15 | 54 |
| Fixing | MD-20 | 15 | 54 |
| Washing (1) | MD-10 | 8 | 36 |
| Washing (2) | MD-10 | 8 | 36 |
| Stabilization | MD-10 | 8 | 36 |

The evaporation loss of water in each processing solution was made up for every day with water having been treated in the same manner as for washing water as hereinafter described.

Only during processing, the bleaching bath was aerated.

Compositions of the processing solutions are shown below.

| | Running Solution | Replenisher |
|---|---|---|
| Developer: | | |
| Diethylenetriaminepenta-acetic acid | 2.0 g | 2.0 g |
| 1-Hydroxyethylidene-1,1-diphosphonic acid | 3.0 g | 3.2 g |
| Sodium sulfite | 4.0 g | 5.8 g |
| Potassium carbonate | 40.0 g | 40.0 g |
| Potassium bromide | 1.3 g | 0.4 g |
| Potassium iodide | 1.5 mg | — |
| Hydroxylamine sulfate | 2.4 g | 3.6 g |
| 2-Methyl-4-[N-ethyl-N-(β-hydroxyethyl)amino]aniline sulfate | 4.5 g | 6.4 g |
| Water to make | 1.0 l | 1.0 l |
| pH (adjusted with 50% potassium hydroxide) | 10.05 | 10.15 |
| Bleaching Bath: | | |
| Ammonium (1,3-propylenediaminetetraacetato)iron (II) monohydrate | 110 g | 220 g |
| Ammonium bromide | 70 g | 140 g |
| Ammonium nitrate | 20 g | 40 g |
| 98% Acetic acid | 30 g | 60 g |
| Hydroxyacetic acid | 60 g | 120 g |
| Water to make | 1000 ml | 1000 ml |
| pH (adjusted with 27% aqueous ammonia) | 3.8 | 2.5 |
| Fixing Bath: | | |
| Diammonium ethylenediamine-tetraacetate | 18 g | 54 g |
| Ammonium sulfite | 20.0 g | 60 g |
| Ammonium thiosulfate aqueous solution (700 g/l) | 280.0 ml | 840.0 ml |
| Imidazole | 25 g | 75 g |
| Water to make | 1.0 l | 1.0 l |
| pH | 7.4 | 7.45 |

Blixing Bath:

Running solution comprised the above-described bleaching bath and fixing bath at a volume ratio of 1:6. All the overflow from the bleaching bath and fixing bath was introduced to the blixing bath.

Washing Water:

Tap water was passed through a mixed bed column packed with an H-type strongly acidic cation exchange resin Amberlite IR-120B (produced by Rohm & Haas Co.) and an OH-type strongly basic anion exchange resin Amberlite IRA-400 (produced by Rohm & Haas Co.) to reduce its calcium and magnesium ions each to 3 mg/l or less, respectively, and then 20 mg/l of sodium isocyanurate dichloride and 150 mg/l of sodium sulfate were added thereto. The thus treated water had a pH between 6.5 and 7.5.

Stabilizing Bath:

Running solution and replenisher had the same composition.

| | |
|---|---|
| Formalin (37%) | 1.2 ml |
| Surface active agent: $[C_{10}H_{21}—O—(CH_2CH_2O)_{10}—H]$ | 0.4 g |
| Disodium ethylenediaminetetraacetate dihydrate | 0.05 g |
| Water to make | 1 l |
| pH = 5.0–7.0 | |

The thus processed sample was evaluated in the same manner as in Example 1. The results obtained are shown in Table 2 below.

TABLE 2

| Sample No. | Yellow-Colored Cyan Coupler (3rd & 4th Layers) | Bleaching Accelerator-Releasing Coupler (3rd & 4th Layers) | $\Delta D_y$ | Residual Silver (mg/m$^2$) |
|---|---|---|---|---|
| 101 (Comparison) | — | — | 0.14 | 67 |
| 102 (Comparison) | (II-1) of JP-A-1-319744 | — | 0.09 | 67 |
| 103 (Comparison) | — | 3rd layer-(37) 4th layer-(14) | 0.14 | 50 |
| 104 (Invention) | (II-1) of JP-A-1-319744 | 4th layer-(14) | 0.09 | 25 |
| 105 (Comparison) | (C-4) of JP-A-61-221748 | — | 0.10 | 67 |
| 106 (Invention) | (C-4) of JP-A-61-221748 | 3rd layer-(37) 4th layer-(14) | 0.10 | 28 |
| 107 (Comparison) | (YC-10) of the invention | — | 0.06 | 64 |
| 108 (Invention) | (YC-10) of the invention | 3rd layer-(37) 4th layer-(14) | 0.06 | 16 |
| 109 (Comparison) | (YC-37) of the invention | — | 0.06 | 66 |
| 110 (Invention) | (YC-37) of the invention | 3rd layer-(54) 4th layer-(34) | 0.06 | 18 |
| 111 (Comparison) | (YC-51) of the invention | — | 0.07 | 67 |
| 112 (Invention) | (YC-51) of the invention | 3rd layer-(69) 4th layer-(33) | 0.07 | 22 |

With respect to color turbidity, it is apparent that use of yellow-colored cyan couplers reduces color turbidity similarly to Example 1.

With respect to silver remaining after processing, even when the total processing time after color development up to and including stabilization is greatly reduced, i.e., 2 minutes and 30 seconds in this example, the amount of residual silver of Samples 104, 106, 108, 110, and 112 according to the present invention is not significantly different from the result of Example 1, indicating excellent desilvering properties. To the contrary, the comparative samples contain increased silver as compared with Example 1.

On account of the observed reductions in color turbidity and residual silver, the light-sensitive materials according to the present invention exhibit excellent effects to improve color reproduction.

EXAMPLE 3

The following layers were coated on a cellulose triacetate film support having a subbing layer to prepare a multi-layer color light-sensitive material (designated Sample 301).

In the following compositions, UV, Solv, ExF, ExS, ExC ExM, ExY and Cpd show ultraviolet absorbent, high boiling organic solvent, colorant, sensitized dye, cyan coupler, magenta coupler, yellow coupler and additives, respectively.

| 1st Layer (Antihalation Layer): | |
|---|---|
| Black colloidal silver | 0.15 g-Ag/m$^2$ |
| Gelatin | 2.0 g/m$^2$ |
| ExM-6 | 0.2 g/m$^2$ |
| UV-1 | 0.03 g/m$^2$ |
| UV-2 | 0.06 g/m$^2$ |
| UV-3 | 0.07 g/m$^2$ |
| Solv-1 | 0.3 g/m$^2$ |
| Solv-2 | 0.08 g/m$^2$ |
| ExF-1 | 0.01 g/m$^2$ |
| ExF-2 | 0.01 g/m$^2$ |
| ExF-3 | 0.005 g/m$^2$ |
| Cpd-6 | 0.001 g/m$^2$ |

-continued

| 2nd Layer (Low Sensitivity Red-Sensitive Emulsion Layer): | |
|---|---|
| Silver iodobromide emulsion (AgI content: 4 mol %; uniform AgI type; sphere-equivalent diameter: 0.4 μm; coefficient of variation of sphere-equiv. diameter: 30%; tabular grains (aspect ratio = 3.0)) | 0.30 g-Ag/m$^2$ |
| Silver iodobromide emulsion (AgI content: 6 mol %; high AgI inside type (core/shell = 2:1); sphere-equiv. diameter: 0.45 μm; coefficient of variation of sphere-equiv. diameter: 23%; tabular grains (aspect ratio = 2.0)) | 0.15 g-Ag/m$^2$ |
| Gelatin | 0.8 g/m$^2$ |
| ExS-1 | 2.3 × 10$^{-4}$ mol/mol-AgX (X: halogen) |
| ExS-2 | 1.4 × 10$^{-4}$ mol/mol-AgX |
| ExS-5 | 2.3 × 10$^{-4}$ mol/mol-AgX |
| ExS-7 | 4.2 × 10$^{-6}$ mol/mol-AgX |
| ExC-1 | 0.17 g/m$^2$ |
| ExC-2 | 0.03 g/m$^2$ |
| ExC-3 | 0.009 g/m$^2$ |
| **3rd Layer (Middle Sensitivity Red-Sensitive Emulsion Layer):** | |
| Silver iodobromide emulsion (AgI content: 6 mol %; high AgI inside type (core/shell = 2:1); sphere-equiv. diameter: 0.65 μm; coefficient of variation of sphere/equiv. diameter: 23%; tabular grains (aspect ratio = 2.0)) | 0.55 g-Ag/m$^2$ |
| Gelatin | 1.0 g/m$^2$ |
| ExS-1 | 2.3 × 10$^{-4}$ mol/mol-AgX |
| ExS-2 | 1.4 × 10$^{-4}$ mol/mol-AgX |
| ExS-5 | 2.3 × 10$^{-4}$ mol/mol-AgX |
| ExS-7 | 4.2 × 10$^{-6}$ mol/mol-AgX |
| ExC-1 | 0.31 g/m$^2$ |
| ExC-2 | 0.01 g/m$^2$ |

| | |
|---|---|
| ExC-3 | 0.10 g/m$^2$ |

4th Layer (High Sensitivity Red-Sensitive Emulsion Layer):

| | |
|---|---|
| Silver iodobromide emulsion (AgI content: 9.3 mol %; multi-layered grains (core/intermediate/shell Ag content = 3:4:2; core/intermediate/shell AgI content = 24/0/6 mol %); sphere-equiv. diameter: 0.75 μm; coefficient of variation of sphere-equiv. diameter: 23%; tabular grains (aspect ratio = 2.5)) | 1.0 g-Ag/m$^2$ |
| Gelatin | 1.4 g/m$^2$ |
| ExS-1 | $1.9 \times 10^{-4}$ mol/mol-AgX |
| ExS-2 | $1.2 \times 10^{-4}$ mol/mol-AgX |
| ExS-5 | $1.9 \times 10^{-4}$ mol/mol-AgX |
| ExS-7 | $8.0 \times 10^{-6}$ mol/mol-AgX |
| ExC-1 | 0.08 g/m$^2$ |
| ExC-4 | 0.09 g/m$^2$ |
| Solv-1 | 0.08 g/m$^2$ |
| Solv-2 | 0.20 g/m$^2$ |
| Cpd-7 | $4.6 \times 10^{-4}$ g/m$^2$ |

5th Layer (Intermediate Layer):

| | |
|---|---|
| Gelatin | 0.6 g/m$^2$ |
| Cpd-1 | 0.1 g/m$^2$ |
| Polyethyl acrylate latex | 0.08 g/m$^2$ |
| Solv-1 | 0.08 g/m$^2$ |

6th Layer (Low Sensitivity Green-Sensitive Emulsion Layer):

| | |
|---|---|
| Silver iodobromide emulsion (AgI content: 4 mol %; uniform AgI type; sphere-equiv. diameter: 0.33 μm; coefficient of variation of sphere-equiv. diameter: 37%; tabular grains (aspect ratio = 2.0)) | 0.16 g-Ag/m$^2$ |
| Gelatin | 0.4 g/m$^2$ |
| ExS-3 | $1.6 \times 10^{-4}$ mol/mol-AgX |
| ExS-4 | $4.8 \times 10^{-4}$ mol/mol-AgX |
| ExS-5 | $1 \times 10^{-4}$ mol/mol-AgX |
| ExM-5 | 0.08 g/m$^2$ |
| ExM-13 | 0.09 g/m$^2$ |
| ExM-7 | 0.03 g/m$^2$ |
| ExY-8 | 0.01 g/m$^2$ |
| Solv-1 | 0.06 g/m$^2$ |
| Solv-4 | 0.01 g/m$^2$ |

7th Layer (Middle Sensitivity Green-Sensitive Emulsion Layer):

| | |
|---|---|
| Silver iodobromide emulsion (AgI content: 4 mol %; uniform AgI type; sphere-equiv. diameter: 0.55 μm; coefficient of variation of sphere-equiv. diameter: 15%; tabular grains (aspect ratio = 4.0)) | 0.24 g-Ag/m$^2$ |
| Gelatin | 0.6 g/m$^2$ |
| ExS-3 | $2 \times 10^{-4}$ mol/mol-AgX |
| ExS-4 | $7 \times 10^{-4}$ mol/mol-AgX |
| ExS-5 | $1.4 \times 10^{-4}$ mol/mol-AgX |
| ExM-5 | 0.08 g/m$^2$ |
| ExM-14 | 0.13 g/m$^2$ |
| ExM-7 | 0.04 g/m$^2$ |
| ExY-8 | 0.04 g/m$^2$ |
| Solv-1 | 0.14 g/m$^2$ |
| Solv-4 | 0.01 g/m$^2$ |

8th Layer (High Sensitivity Green-Sensitive Emulsion Layer):

| | |
|---|---|
| Silver iodobromide emulsion (AgI content: 8.8 mol %; multi-layered structure (core/intermediate/shell Ag content = 3:4:2; core/intermediate/shell AgI content = 24/0/3 mol %); sphere-equiv. diameter: 0.75 μm; coefficient of variation of sphere-equiv. diameter: 23%; tabular grains (aspect ratio = 1.6)) | 0.4 g-Ag/m$^2$ |
| Gelatin | 0.6 g/m$^2$ |
| ExS-4 | $5.2 \times 10^{-4}$ mol/mol-AgX |
| ExS-5 | $1 \times 10^{-4}$ mol/mol-AgX |
| ExS-8 | $0.3 \times 10^{-4}$ mol/mol-AgX |
| ExM-5 | 0.08 g/m$^2$ |
| ExM-6 | 0.03 g/m$^2$ |
| ExY-8 | 0.02 g/m$^2$ |
| ExC-1 | 0.01 g/m$^2$ |
| ExC-4 | 0.01 g/m$^2$ |
| Solv-1 | 0.23 g/m$^2$ |
| Solv-2 | 0.05 g/m$^2$ |
| Solv-4 | 0.01 g/m$^2$ |
| Cpd-7 | $1 \times 10^{-4}$ g/m$^2$ |
| Cpd-8 | 0.01 g/m$^2$ |

9th Layer (Intermediate Layer):

| | |
|---|---|
| Gelatin | 0.6 g/m$^2$ |
| Cpd-1 | 0.04 g/m$^2$ |
| Polyethyl acrylate latex | 0.05 g/m$^2$ |
| Solv-1 | 0.02 g/m$^2$ |
| UV-4 | 0.03 g/m$^2$ |
| UV-5 | 0.04 g/m$^2$ |

10th Layer
(Layer Donating Interimage Effect to Red-Sensitive Layer:

| | |
|---|---|
| Silver iodobromide emulsion (AgI content: 8 mol %; high AgI inside type (core/shell = 2:1); sphere-equiv. diameter: 0.65 μm; coefficient of variation of sphere-equiv. diameter: 25%; tabular grains (aspect ratio = 2.0)) | 0.62 g-Ag/m$^2$ |
| Silver iodobromide emulsion (AgI content: 4 mol %; uniform AgI type; sphere-equiv. diameter: 0.4 μm; coefficient of variation of sphere-equiv. diameter: 30%; tabular grains (aspect ratio = 3.0)) | 0.18 g-Ag/m$^2$ |
| Gelatin | 1.0 g/m$^2$ |
| ExS-3 | $6 \times 10^{-4}$ mol/mol-AgX |
| ExM-10 | 0.19 g/m$^2$ |
| Solv-1 | 0.30 g/m$^2$ |
| Solv-6 | 0.03 g/m$^2$ |

11th Layer (Yellow Filter Layer):

| | |
|---|---|
| Yellow colloidal silver | 0.06 g-Ag/m$^2$ |
| Gelatin | 0.8 g/m$^2$ |
| Cpd-2 | 0.13 g/m$^2$ |
| Solv-1 | 0.13 g/m$^2$ |
| Cpd-1 | 0.07 g/m$^2$ |
| Cpd-6 | 0.002 g/m$^2$ |
| H-1 | 0.13 g/m$^2$ |

12th Layer (Low Sensitivity Blue-Sensitive Emulsion Layer):

| | |
|---|---|
| Silver iodobromide emulsion (AgI content: 4.5 mol %; uniform AgI type; sphere-equiv. diameter: 0.7 μm; coefficient of variation of sphere-equiv. diameter: 15%; tabular grains (aspect ratio = 7.0)) | 0.38 g-Ag/m$^2$ |
| Silver iodobromide emulsion (AgI content: 3 mol %; uniform AgI type; sphere-equiv. diameter: 0.3 μm; coefficient of variation of sphere-equiv. diameter: 30%; tabular grains (aspect ratio = 7.0)) | 0.21 g-Ag/m$^2$ |
| Gelatin | 2.1 g/m$^2$ |
| ExS-6 | $9 \times 10^{-4}$ mol/mol-AgX |
| ExC-1 | 0.13 g/m$^2$ |
| ExC-4 | 0.03 g/m$^2$ |

| | |
|---|---|
| ExY-9 | 0.14 g/m$^2$ |
| ExY-11 | 0.70 g/m$^2$ |
| ExY-16 | 0.40 g/m$^2$ |
| Solv-1 | 0.51 g/m$^2$ |

13th Layer (Intermediate Layer):

| | |
|---|---|
| Gelatin | 0.4 g/m$^2$ |
| ExY-12 | 0.20 g/m$^2$ |
| Solv-1 | 0.19 g/m$^2$ |

14th Layer (High Sensitivity Blue-Sensitive Emulsion Layer):

| | |
|---|---|
| Silver iodobromide emulsion (AgI content: 10 mol %; high AgI inside type; sphere-equiv. diameter: 1.0 μm; coefficient of variation of sphere-equiv. diameter: 25%; multiple-twinned tabular grains (aspect ratio = 2.0)) | 0.30 g-Ag/m$^2$ |
| Gelatin | 0.5 g/m$^2$ |
| ExS-6 | $1 \times 10^{-4}$ mol/mol-AgX |
| ExY-9 | 0.01 g/m$^2$ |
| ExY-11 | 0.12 g/m$^2$ |
| ExY-15 | 0.09 g/m$^2$ |
| ExC-1 | 0.01 g/m$^2$ |
| Solv-1 | 0.10 g/m$^2$ |

15th Layer (1st Protective Layer):

| | |
|---|---|
| Fine silver iodobromide emulsion (AgI content: 2 mol %; uniform AgI type; sphere-equiv. diameter: 0.07 μm) | 0.10 g-Ag/m$^2$ |
| Gelatin | 0.7 g/m$^2$ |
| UV-4 | 0.11 g/m$^2$ |
| UV-5 | 0.16 g/m$^2$ |
| Solv-5 | 0.02 g/m$^2$ |
| H-1 | 0.13 g/m$^2$ |
| Cpd-5 | 0.10 g/m$^2$ |
| Polyethyl acrylate latex | 0.09 g/m$^2$ |

16th Layer (2nd Protective Layer):

| | |
|---|---|
| Fine silver iodobromide emulsion (AgI content: 2 mol %; uniform AgI type; sphere-equiv. diameter: 0.07 μm) | 0.18 g-Ag/m$^2$ |
| Gelatin | 0.85 g/m$^2$ |
| Polymethyl methacrylate (diameter: 1.5 μm) | 0.2 g/m$^2$ |
| Cpd-4 | 0.04 g/m$^2$ |
| W-4 | 0.02 g/m$^2$ |
| H-1 | 0.17 g/m$^2$ |

In order to facilitate coating or stabilize emulsions, each layer further contained an emulsion stabilizer Cpd-3 (0.07 g/m$^2$) and surface active agents W-1 (0.006 g/m$^2$), W-2 (0.18 g/m$^2$), W-3 (0.10 g/m$^2$) and W-5(0.15 g/m$^2$).

Structural formulae or compound names of the compounds used in Sample 301 are shown below.

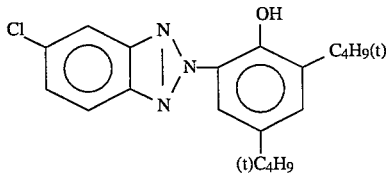

UV-1

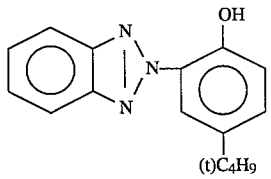

UV-2

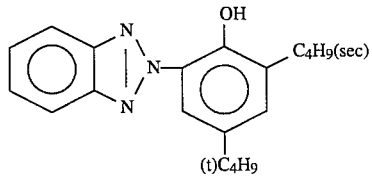

UV-3

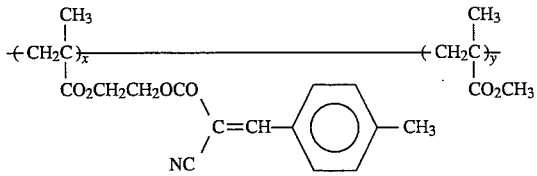

x:y = 70:30 (wt %)

UV-4

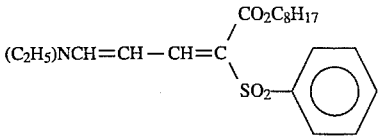

UV-5

Tricresyl phosphate

Solv-1

-continued
Dibutyl phthalate — Solv-2
Solv-4
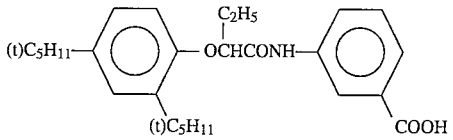
Trihexyl phosphate — Solv-5
Solv-6
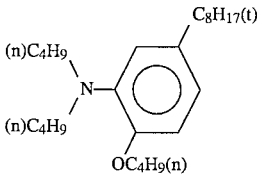
ExF-1
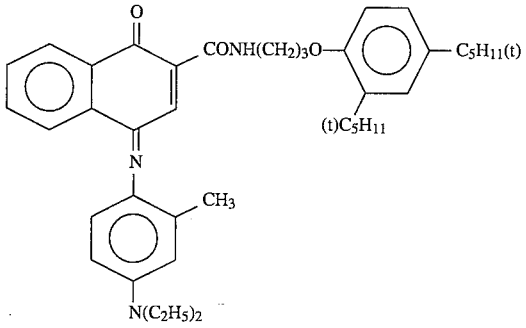
ExF-2
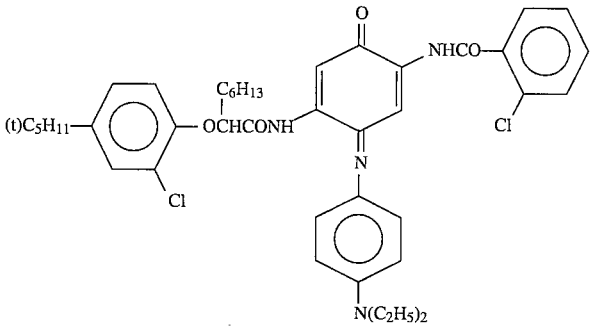
ExF-3
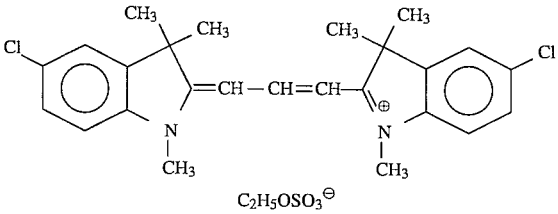
ExS-1
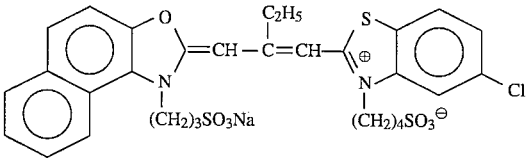
ExS-2
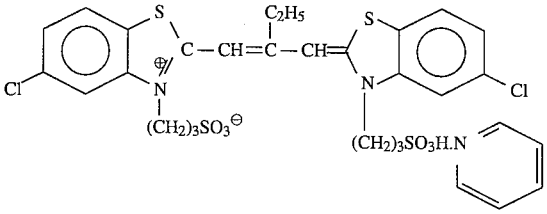

-continued
ExS-3
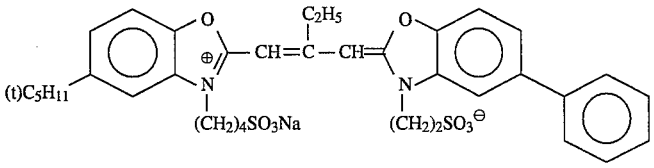
ExS-4
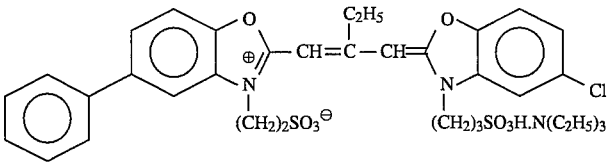
ExS-5
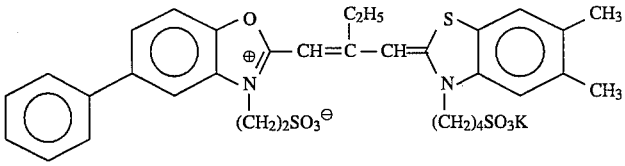
ExS-6
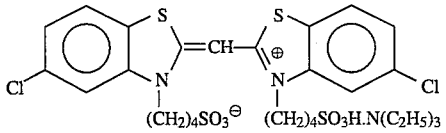
ExS-7
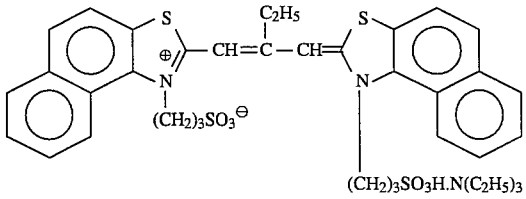
ExS-8
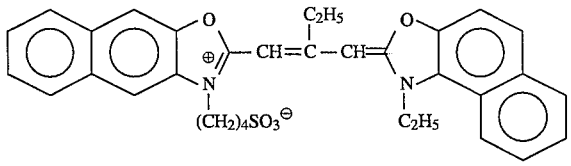
ExC-1
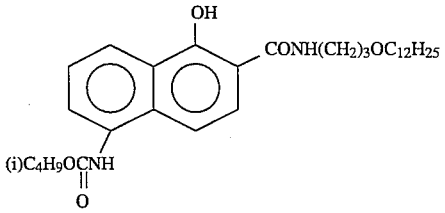

-continued
ExC-2
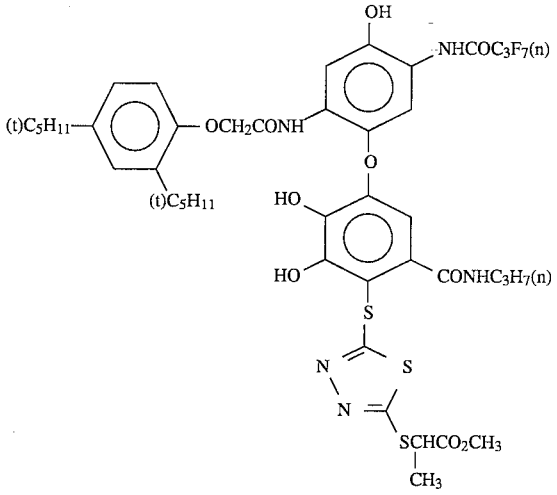
ExC-3
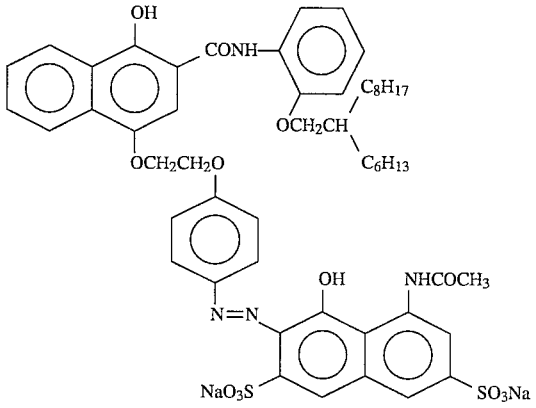
ExC-4
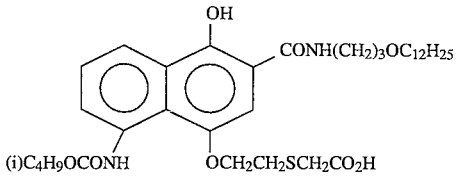
ExM-5
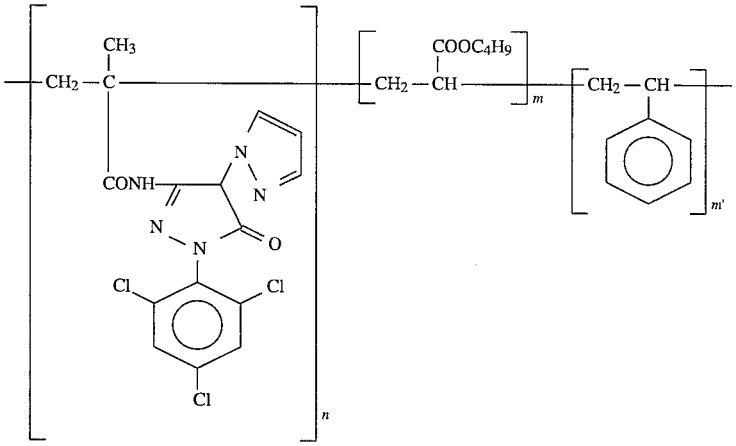
n = 50
m = 25
m' = 25
mol. wt. ca. 20,000
+R2

-continued
ExM-6
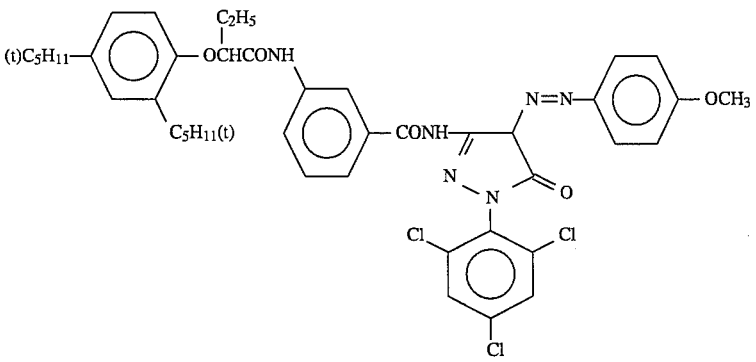
ExM-7
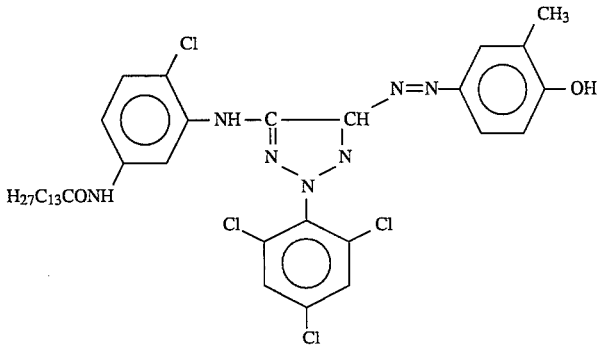
ExM-10
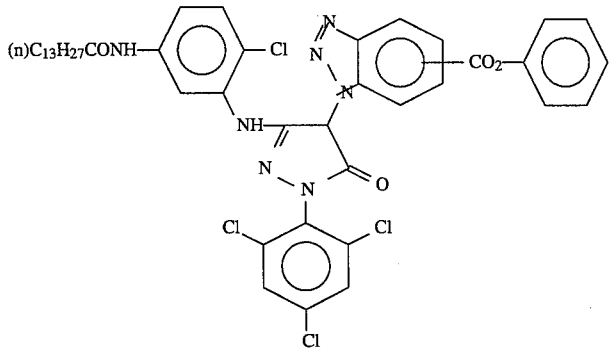
ExY-8
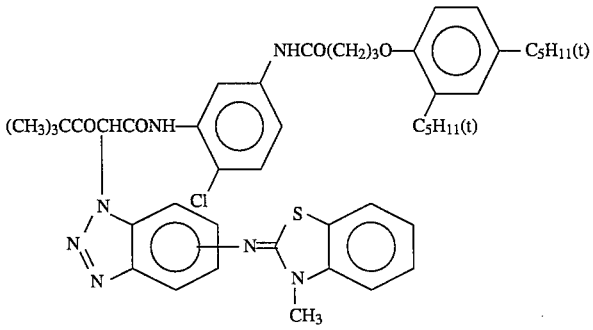
ExY-9
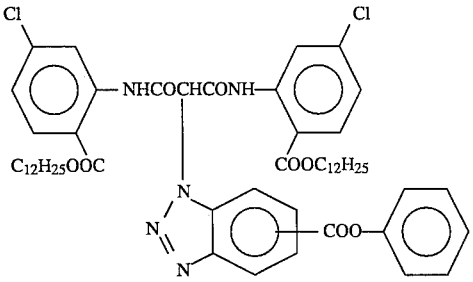

-continued
ExY-11
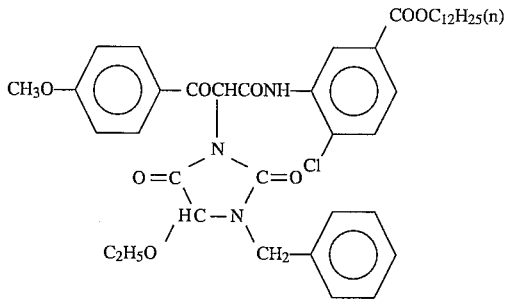
ExY-12
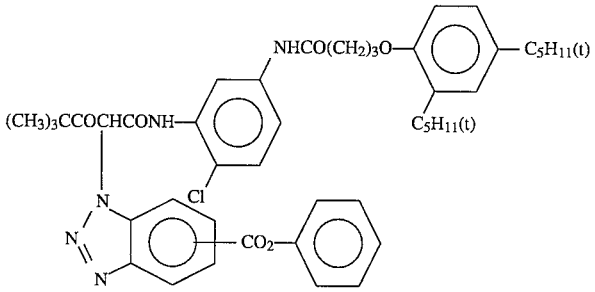
ExM-13
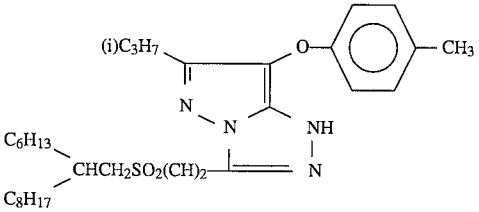
ExM-14
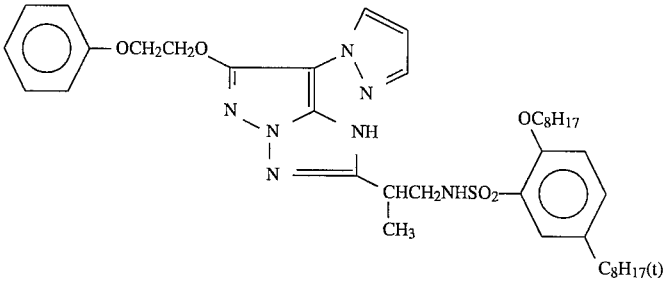
ExY-15
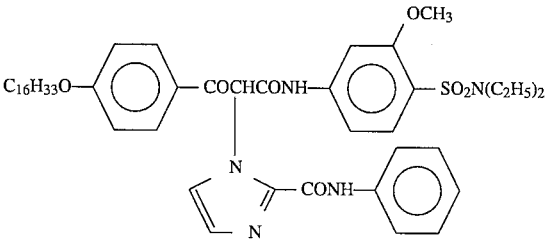
ExY-16
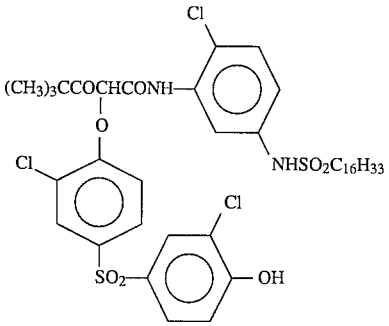

-continued
Cpd-1
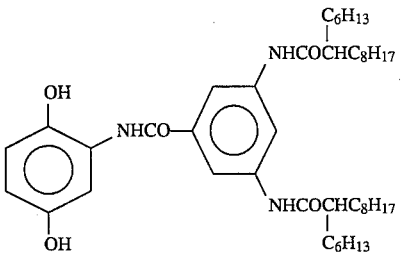
Cpd-2
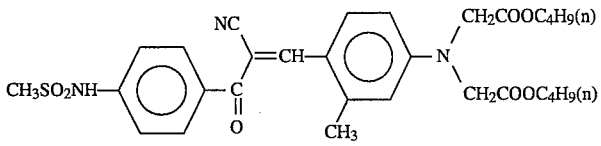
Cpd-3
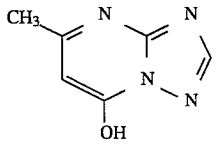
Cpd-4
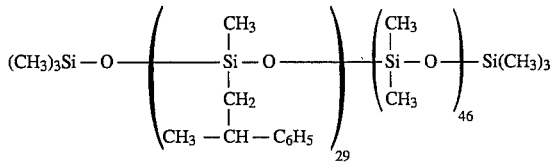
Cpd-5
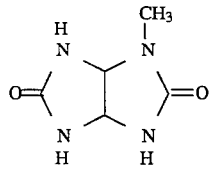
Cpd-6
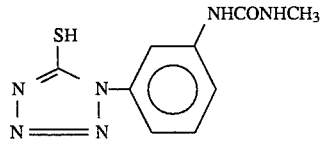
Cpd-7
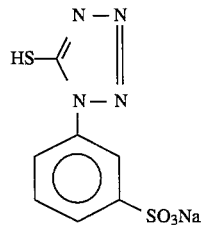
Cpd-8
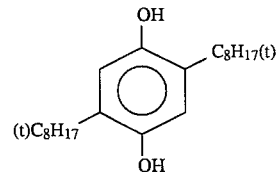
H-1
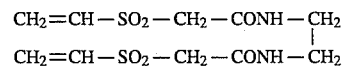

-continued

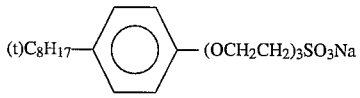

W-1

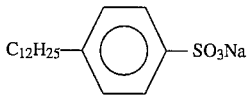

W-2

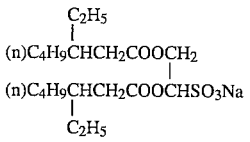

W-3

$C_8F_{17}SO_2N(C_3H_7)CH_2COOK$

W-4

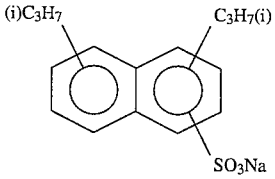

W-5

Preparation of Sample 302:

Sample 302 was prepared in the same manner as Sample 301, except that the 2nd, 3rd, and 4th red-sensitive emulsion layers further contained 0.03 g/m$^2$, 0.07 g/m$^2$, and 0.02 g/m$^2$ of the yellow-colored cyan coupler of the invention (YC-7), respectively.

Preparation of Sample 303:

Sample 303 was prepared in the same manner as Sample 302, except that the 4th layer further contained 0.03 g/m$^2$ of the bleaching accelerator-releasing coupler (61) of the invention, and the amount of ExC-1 was changed to 0.06 g/m$^2$.

Preparation of Sample 304:

Sample 304 was prepared in the same manner as Sample 303, except the 1st layer further contained 0.02 g/m$^2$ of the bleaching accelerator-releasing compound (50) of the invention.

Preparation of Sample 305:

Sample 305 was prepared in the same manner as Sample 304, except that the 8th layer further contained 0.02 g/m$^2$ of the bleaching accelerator-releasing coupler (31) of the invention, the amount of ExM-5 was changed to 0.06 g/m$^2$, and ExC-4 in the 12th layer was replaced with the same amount of the bleaching accelerator-releasing compound (61) of the invention.

Each of Samples 301 to 305 was cut to size, fabricated, and exposed to light in the same manner as in Example 1.

Separately, Sample 301 was imagewise exposed to light and continuously processed with an automatic developing machine according to the following steps until the cumulative amount of the replenisher for the bleaching bath reached three times the tank volume.

Then, the above-prepared exposed samples were processed with the automatic developing machine in the same manner.

| Step | Temperature | Time | Rate of Replenishment* | Tank Volume |
|---|---|---|---|---|
| Color | 37.8° C. | 3'15" | 21 ml | 5 l |

-continued

| Step | Temperature | Time | Rate of Replenishment* | Tank Volume |
|---|---|---|---|---|
| Development | | | | |
| Bleaching | 38.0° C. | 45" | 4.5 ml | 2 l |
| Fixing(1) | 38.0° C. | 45" | — | 2 l |
| Fixing (2) | 38.0° C. | 45" | 30 ml | 2 l |
| Stabilization (1) | 38.0° C. | 20" | — | 1 l |
| Stabilization (2) | 38.0° C. | 20" | — | 1 l |
| Stabilization (3) | 38.0° C. | 20" | 35 ml | 1 l |
| Drying | 55° C. | 1'00" | | |

Note:

*per m of 35-mm wide film

The fixing was carried out in a two-tank counter-flow system of from (2) to (1). The stabilization was carried out in a three-tank counter-flow system of from (3) to (2) and from (2) to (1).

The fixing tank of the automatic developing machine used was equipped with a jet stream stirring means as described in JP-A-62-183460, p. 3 so that a jet stream of the fixing bath was made to strike against the emulsion surface of the light-sensitive material.

Compositions of the processing solutions which were used are as follows.

| | Running Solution | Replenisher |
|---|---|---|
| Color Developer: | | |
| Hydroxyethyliminodiacetic acid | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |

-continued

| | Running Solution | Replenisher |
|---|---|---|
| Hydroxylamine sulfate | 2.0 g | 3.6 g |
| 4-(N-Ethyl-N-β-hydroxyethyl-amino)-2-methylaniline sulfate | $1.0 \times 10^{-2}$ mol | $1.3 \times 10^{-2}$ mol |
| Water to make | 1.0 l | 1.0 l |
| pH | 10.00 | 10.15 |
| **Bleaching Bath:** | | |
| (1,3-Diaminopropanetetra-acetato)iron (II) salt | 130 g | 190 g |
| 1,3-Diaminopropanetetra-acetic acid | 3.0 g | 4.0 g |
| Ammonium bromide | 85 g | 120 g |
| Acetic acid | 50 g | 70 g |
| Ammonium nitrate | 30 g | 40 g |
| Water to make | 1.0 l | 1.0 l |
| pH (adjusted with acetic acid and ammonia) | 4.3 | 3.5 |
| **Fixing Bath:** | | |
| 1-Hydroxyethylidene-1,1-diphosphonic acid | 5.0 g | 7.0 g |
| Disodium ethylenediamine-tetraacetate | 0.5 g | 0.7 g |
| Sodium sulfite | 10.0 g | 12.0 g |
| Sodium bisulfite | 8.0 g | 10.0 g |
| Ammonium thiosulfate aqueous solution (700 g/l) | 170.0 ml | 200.0 ml |
| Ammonium thiocyanate | 100.0 g | 150.0 g |
| Thiourea | 3.0 g | 5.0 g |
| 3,6-Dithia-1,8-octanediol | 3.0 g | 5.0 g |
| Water to make | 1.0 l | 1.0 l |
| pH (adjusted with acetic acid and ammonia) | 6.5 | 6.7 |
| **Stabilizing Bath:** | | |
| Running solution and replenisher had the same composition. | | |
| Formalin (37%) | | 1.2 ml |
| 5-Chloro-2-methyl-4-isothiazolin-3-one | | 6.0 mg |
| 2-Methyl-4-isothiazolin-3-one | | 3.0 mg |
| Surface active agent: $[C_{10}H_{21}—O—(CH_2CH_2O)_{10}—H]$ | | 0.4 g |
| Ethylene glycol | | 1.0 g |
| Water to make | | 1.0 l |
| pH | | 5.0–7.0 |

The thus processed samples were evaluated in the same manner as in Example 1, with respect to color turbidity ($\Delta D_y$) and residual amount of silver on the photosensitive material after processing and the results obtained are shown in Table 3 below.

TABLE 3

| Sample No. | Yellow-Colored Cyan Coupler (2nd, 3rd & 4th Layers) | Bleaching Accelerator-Coupler | $\Delta D_y$ | Residual Silver (mg/m$^2$) |
|---|---|---|---|---|
| 301 (Comparison) | — | — | 0.14 | 23 |
| 302 (Comparison) | YC-7 | — | 0.06 | 21 |
| 303 (Invention) | YC-7 | 4th layer-(61) | 0.06 | 12 |
| 304 (Invention) | YC-7 | 1st layer-(50)<br>4th layer-(61) | 0.06 | 10 |
| 305 (Invention) | YC-7 | 1st layer-(50)<br>4th layer-(61)<br>8th layer-(31)<br>12th layer-(61) | 0.06 | 6 |

With respect to color turbidity, it is apparent from the results of Table 3 that use of yellow-colored cyan couplers reduces color turbidity.

With respect to silver remaining after processing, where the above-described processing schedule was followed, in which the total processing time of desilvering after color development up to and including stabilization was 3 minutes and 15 minutes, the amount of residual silver can be reduced by the combined use of a yellow-colored cyan coupler and a bleaching accelerator-releasing compound.

It can thus be seen that excellent color reproduction can be achieved in the present invention through reduced color turbidity combined with reduced residual silver.

Then, each of Samples 301 to 305 was processed in the same manner as in Example 2, except for reducing the blixing time and fixing time to 20 seconds, respectively, and reducing the washing time in tanks (1) and (2) to 15 seconds, respectively (the total processing time from the desilvering after color development up to and including stabilization was reduced to 2 minutes). Evaluations were made in the same manner as in Example 1. The results obtained are shown in Table 4 below.

TABLE 4

| Sample No. | Yellow-Colored Cyan Coupler (2nd, 3rd & 4th Layers) | Bleaching Accelerator-Coupler | $\Delta D_y$ | Residual Silver (mg/m$^2$) |
|---|---|---|---|---|
| 301 (Comparison) | — | — | 0.14 | 32 |
| 302 (Comparison) | YC-7 | — | 0.06 | 31 |
| 303 (Invention) | YC-7 | 4th layer-(61) | 0.06 | 13 |
| 304 (Invention) | YC-7 | 1st layer-(50)<br>4th layer-(61) | 0.06 | 11 |
| 305 (Invention) | YC-7 | 1st layer-(50)<br>4th layer-(61)<br>8th layer-(31)<br>12th layer-(61) | 0.06 | 6 |

It can be seen from the results in Table 4 that color turbidity can be reduced by the use of yellow-colored cyan couplers similarly to the results of Table 3 even when the total processing time after color development is reduced to 2 minutes. Further, when the yellow-colored cyan coupler is combined with a bleaching accelerator-releasing compound, the amount of residual silver can be decreased to thereby improve color reproducibility. It is also apparent from the results in Tables 3 and 4 that use of the bleaching accelerator-releasing compound in a plurality of layers further reduces the amount of residual silver.

EXAMPLE 4

When a sample prepared in the same manner as Sample 305 of Example 3, except for replacing YC-7 with an equimolar amount of YC-1, YC-3, YC-16, YC-32, YC-35, or YC-42 was processed according to the procedures shown in Example 3, results similar to those shown in Tables 3 and 4 were obtained, proving that both color turbidity and desilvering properties were improved.

Further, a sample was prepared in the same manner as Sample 305, except for replacing the bleaching accelerator-releasing compound (50) in the 1st layer with an equimolar amount of compounds (47), (49), (51), (52) or (53); replacing compound (61) in the 4th layer with an equimolar amount of compounds (3), (13), (17), (40) or (63); replacing compound (31) in the 8th layer with an equimolar amount of compounds (27), (35), (38), (44) or (58); and replacing compound (61) in the 12th layer with an equimolar amount of compounds (66), (68), (11), (18) or (43). Each of these samples was processed according to the same rapid processing procedures as used in Example 3 (the total processing time after color development was 2 minutes). When evaluated in the same manner as in Example 1, every processed sample had an amount of residual silver of 10 mg/m$^2$ or less, and thus were excellent in desilvering properties. With respect to color turbidity, all the samples showed substantially the same results as in Example 3. Color reproducibility was thus confirmed to be improved.

EXAMPLE 5

Sample 501 was prepared in the same manner as Sample 301 of Example 3, except that the bleaching accelerator-releasing compounds of the present invention were added to a plurality of layers as shown in Table 5 below.

TABLE 5

| Layer for Addition | | Bleaching Accelerator-Releasing Compound | |
|---|---|---|---|
| | | Compound No. | Amount (g/m$^2$) |
| Red-sensitive layers | 2nd layer | (71) | 0.01 |
| | 3rd layer | (7) | 0.01 |
| | 4th layer | (22) | 0.02 |
| Intermediate layer | 5th layer | (60) | 0.02 |
| Green-sensitive layers | 6th layer | (6) | 0.01 |
| | 7th layer | (32) | 0.01 |
| | 8th layer | (28) | 0.01 |
| Donor layer | 10th layer | (5) | 0.02 |
| Blue-sensitive layers | 12th layer | (46) | 0.01 |
| | 14th layer | (57) | 0.01 |

Sample 502 was prepared in the same manner as Sample 301, except for adding yellow colored cyan coupler (YC-2) to the 2nd, 3rd, and 4th layers (red-sensitive emulsion layers) in an amount of 0.035 g/m$^2$, 0.070 g/m$^2$, and 0.030 g/m$^2$, respectively.

Sample 503 was prepared in the same manner as Sample 502, except for replacing (YC-2) with the corresponding equimolar amount of Compound (II-3) of JP-A- 1-319744 shown below.

Compound II-3:

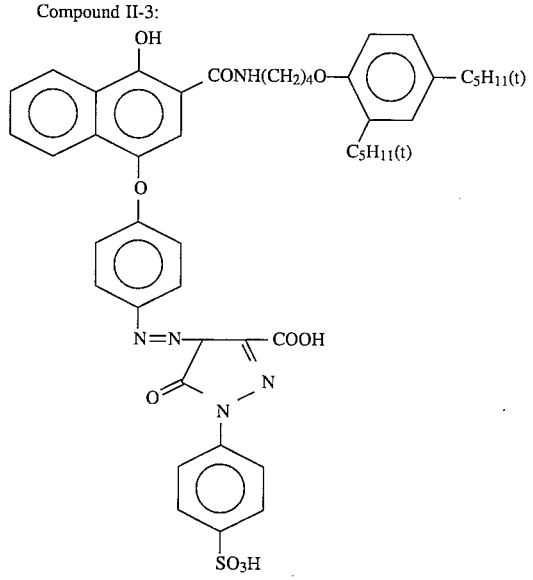

Sample 504 was prepared in the same manner as Sample 503, except for replacing Compound (II-3) with the equimolar amount of Compound (C-2) of JP-A-61-221748 shown below.

Compound (C-2):

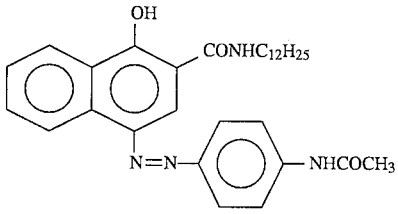

Sample 505 was prepared in the same manner as Sample 501, except for adding to the 2nd, 3rd, and 4th layers the same kind and amounts of the yellow-colored cyan coupler as used in Sample 502 (YC-2).

Sample 506 was prepared in the same manner as Sample 501, except for using the same kind and amounts of the yellow-colored cyan coupler as used in Sample 503.

Sample 507 was prepared in the same manner as Sample 501, except for using the same kind and amounts of the yellow-colored cyan coupler as used in Sample 504.

Samples 508 to 517 were prepared in the same manner as Sample 505, except for replacing (YC-2) with the equimolar amounts of each of the couplers shown in Table 6 below.

Sample 518 was prepared in the same manner as Sample 515, except for replacing the bleaching accelerator-releasing compounds used in the red-sensitive emulsion layers (2nd, 3rd & 4th layers) with respectively the same amounts of the compounds shown in Table 6.

Samples 519 and 520 were prepared in the same manner as Sample 505, except for replacing (YC-2) with the respective equimolar amounts of the yellow-colored cyan coupler shown in Table 6 and replacing the bleaching accelerator-releasing compounds in the layers shown in Table 6 with respectively the same amounts of the compounds shown in Table 6. In Sample 520, a bleaching accelerator-releasing compound was also added to the 9th layer (intermediate layer) as shown in Table 6.

Sample 521 was prepared in the same manner as Sample 505, except for replacing the bleaching accelerator-releasing compounds used in the red-sensitive emulsion layers (2rd, 3rd & 4th layers) with the respective equimolar amounts of the compound disclosed in U.S. Pat. No. 3,893,858 shown below. Compound of U.S. Pat. No. 3,893,858:

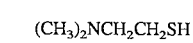

Sample 522 was prepared in the same manner as Sample 521, except for replacing the compound of U.S. Pat. No. 3,893,858 with the respective equimolar amounts of a compound of formula:

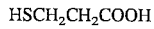

Each of Samples 501 to 522 was cut to size, fabricated, exposed to light in the same manner as in Example 1, and processed according to the same rapid processing method as used in Example 3 in which the total processing time from desilvering after color development up to and including stabilization was reduced to 2 minutes. The processed samples were evaluated for color turbidity ($\Delta D_y$) and silver remaining in the same manner as in Example 1. In addition, the following performance properties were also evaluated.

5-1) Stability in Continuous Processing:

Sample 301 of Example 3 after being imagewise exposed, was continuously processed according to the processing method described above until the cumulative amount of the replenisher added to the color development tank reached 3 times the tank volume. Before and after this continuous processing, each of Samples 501 to 522, after being wedgewise exposed to white light, was processed, and the characteristic curve for each sample was obtained by measuring densities with red light. A logarithm of the reciprocal of the exposure amount providing a density of (minimum density +0.2) was calculated as sensitivity (S). The difference ($\Delta S_1$) between the sensitivity of a sample processed before the start of continuous processing and that of a sample processed after the continuous processing was obtained to evaluate performance stability in continuous processing.

5-2) Stability of Light-Sensitive Material With Time:

One set of samples were preserved at 5° C., while another set of samples were preserved at 50° C. and 55% RH (relative humidity), both for 3 days.

Then, each sample was wedgewise exposed to white light and processed with the processing solutions before the start of the above-described continuous processing. Sensitivity was obtained in the same manner as in (5-1) above to calculate the difference in sensitivity $\Delta S_2$) between a sample preserved at 5° C. and that preserved at 50° C.

5-3) Dye Image Stability:

Each of the samples processed before the start of the above-described continuous processing was preserved at 60° C. and 70% RH for 30 days. Densities were measured with red light before and after the preservation. The ratio of the density after the preservation of the area which had a density of (minimum density +1.2) before the preservation to the density of (minimum density +1.2) before the preservation was calculated to obtain a percent dye retention (%).

The results of these evaluations are shown in Table 6.

TABLE 6

| Sample No. | Yellow-Colored Cyan Coupler | Bleaching Accelerator-Releasing Compound | Color Turbidity ($\Delta D_y$) | Residual Silver Amount (mg/m$^2$) | Stability in Continuous Processing ($\Delta S_1$) | Stability of Material With Time ($\Delta S_2$) | Dye Image Stability (%) |
|---|---|---|---|---|---|---|---|
| 301 (Comparison) | — | — | 0.14 | 32 | −0.05 | +0.05 | 94 |
| 501 (Comparison) | — | see Table 5 | 0.13 | 15 | −0.09 | +0.04 | 92 |
| 502 (Comparison) | (YC-2) | — | 0.06 | 30 | −0.03 | +0.03 | 98 |
| 503 (Comparison) | (II-3)* | — | 0.09 | 31 | −0.05 | +0.05 | 96 |
| 504 (Comparison) | (C-2)** | — | 0.10 | 32 | −0.07 | +0.08 | 94 |
| 505 (Invention) | (YC-2) | the same as in Sample 501 | 0.06 | 5 | −0.02 | +0.02 | 98 |
| 506 (Invention) | the same as in Sample 503 | the same as in Sample 501 | 0.09 | 10 | −0.04 | +0.04 | 96 |
| 507 (Invention) | the same as in Sample 504 | the same as in Sample 501 | 0.10 | 13 | −0.07 | +0.07 | 94 |
| 508 (Invention) | (YC-6) | the same as in Sample 501 | 0.06 | 5 | −0.02 | +0.02 | 98 |
| 509 (Invention) | (YC-13) | the same as in Sample 501 | 0.06 | 5 | −0.02 | +0.02 | 98 |
| 510 (Invention) | (YC-33) | the same as in Sample 501 | 0.06 | 7 | −0.03 | +0.03 | 97 |
| 511 (Invention) | (YC-37) | the same as in Sample 501 | 0.06 | 7 | −0.03 | +0.03 | 97 |
| 512 (Invention) | (YC-47) | the same as in Sample 501 | 0.08 | 9 | −0.04 | +0.04 | 96 |
| 513 (Invention) | (YC-73) | the same as in Sample 501 | 0.09 | 11 | −0.05 | +0.05 | 95 |
| 514 (Invention) | (YC-78) | the same as in Sample 501 | 0.09 | 11 | −0.05 | +0.05 | 95 |
| 515 (Invention) | (YC-85) | the same as in Sample 501 | 0.05 | 5 | −0.02 | +0.02 | 98 |
| 516 (Invention) | (YC-87) | the same as in Sample 501 | 0.05 | 5 | −0.02 | +0.02 | 98 |
| 517 (Invention) | 2nd layer: (YC-86); 3rd layer: (YC-86)/(YC-26 = 1/1 by mole; 4th layer: (YC-26) | the same as in Sample 501 | 0.05 | 5 | −0.02 | +0.02 | 98 |
| 518 (Invention) | (YC-85) | 2nd layer: (68)/(52) = 1/1 by weight; 3rd, 4th layers: (66) | 0.05 | 5 | −0.02 | +0.02 | 98 |
| 519 (Invention) | (YC-85) | 2nd–4th layers: (70); 5th layer: (72); 10th layer: (72) | 0.05 | 5 | −0.02 | +0.02 | 98 |

TABLE 6-continued

| Sample No. | Yellow-Colored Cyan Coupler | Bleaching Accelerator-Releasing Compound | Color Turbidity ($\Delta D_y$) | Residual Silver Amount (mg/m$^2$) | Stability in Continuous Processing ($\Delta S_1$) | Stability of Material With Time ($\Delta S_2$) | Dye Image Stability (%) |
|---|---|---|---|---|---|---|---|
| 520 (Invention) | (YC-90) | 2nd–3rd layers: (70); 4th layer: (70)/(72) = 2/1 by mole; 5th layer: (72); 9th layer: 72) (0.01 g/m$^2$) | 0.05 | 5 | −0.02 | +0.02 | 98 |
| 521 (Comparison) | (YC-2) | $(CH_3)_2NCH_2CH_2SH$ *** | 0.06 | 23 | −0.15 | −0.08 | 95 |
| 522 (Comparison) | (YC-2) | $(HSCH_2CH_2COOH)$ *** | 0.06 | 25 | −0.18 | −0.12 | 95 |

Note:
*Disclosed in JP-A-1-319774
**Disclosed in JP-A-61-221748
***Disclosed in U.S. Pat. No. 3,893,858

On making comparisons among the samples satisfying the conditions of the present invention (Samples 505 to 518), it can be seen that the effects to reduce color turbidity and the residual silver amount and to thereby improve color reproducibility are produced with the compounds of formula (CI), the compounds of formula (CII), the compounds of formula (CIII), the compounds of formula (CIV), and the compounds of the cited literatures in the order of from the highest effects to the lowest.

It is also seen that, in addition to the abovedescribed effects, the samples satisfying the conditions of the present invention exhibit improving effects on stability of photographic properties in continuous processing or with time and dye image stability. These effects are also manifested in the above-described order of yellow-colored cyan couplers. The effects obtained with the compounds of formulae (CI) and (CII) are particularly outstanding.

Comparisons between Comparative Samples 301 and 501 to 504 with Samples 505 to 518 of the present invention also reveal that the above-mentioned various effects are significantly enhanced when the yellow-colored cyan coupler and the bleaching accelerator-releasing compound are used in combination over the individual use of each of them.

It can be also seen that a sample containing in its emulsion layer a bleaching accelerator which has been used in a processing solution for the purpose of increasing bleaching power as in Sample 519 or 520 surely shows a reduction in residual silver amount but to a small extent. It is still more disadvantageous that such use of a bleaching accelerator results in great reduction in stability against continuous processing or stability of the light-sensitive material with time, indicating difficulty in using these bleaching accelerators in light-sensitive materials under the present circumstances.

While the invention has been described in detail and with reference to specific examples thereof, it will be apparent to one skilled in the art that various changes and modifications can be made therein without departing from the spirit and scope thereof.

What is claimed is:

1. A silver halide color photographic light-sensitive material for forming a color image which contains a cyan dye comprising a support having thereon at least one silver halide emulsion layer, a yellow-colored cyan coupler which has a maximum absorption of between 400 and 500 nm and forms a cyan due having a maximum absorption of between 630 and 750 nm by coupling with an oxidation product of an aromatic primary amine developing agent and which is represented by formula (CI), wherein said color image is formed in the light sensitive material by the cyan dye formed by said coupler, and a compound capable of releasing a bleaching accelerator or a precursor thereof on reaction with an oxidation product of an aromatic primary amine developing agent:

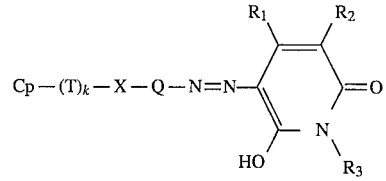

(CI)

wherein Cp represents a cyan coupler group; T represents a timing group bonded to the coupling position of Cp; k represents 0 or 1; X represents a divalent linking group connecting $(T)_k$; and Q represents an arylene group or a divalent heterocyclic group; $R_1$and $R_2$ each represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group, or an alkylsulfonyl group; $R_3$ represent a hydrogen atom, an alkyl group, a cycloalkyl group, an aryl group, or a heterocyclic group; provided that at least one T, X, Q, $R_1$, $R_2$, and $R_3$ contains a water-soluble group.

2. The silver halide color photographic material of claim 1, wherein the yellow-colored cyan coupler is incorporated in a red-sensitive emulsion layer.

3. The silver halide color photographic material of claim 1, wherein the compound capable of releasing a bleaching accelerator is represented by formula (I):

$$A—(L_2)_p—Z \quad (I)$$

wherein A represents a group whose bond to $(L_2)_p$—Z is split off on reacting with an oxidation product of a developing agent; $L_2$ represents a timing group or a group whose bond to Z is split on reacting with an oxidation product of a developing agent; p represents 0 or an integer of from 1 to 3; where p is 2 or more, the plural $L_2$ groups may be the same or different; and Z represents a group which manifests a bleaching accelerating effect on the splitting of its bond to $A—(L_2)_p$.

4. The silver halide photographic material of claim 3, wherein A in formula (I) is a redox group represented by formula (II):

$$A_1—P—(X_2=Y)_n—Q_2—A_2 \quad (II)$$

wherein P and $Q_2$ each represents an oxygen atom or a substituted or unsubstituted imino group; at least one n $X_2$ and n Y represents a methine group having $—(L_{21})_a—(L_{22})_b—Z$ as a substituent, with the other $X_2$ and Y each representing a substituted or unsubstituted methine group or a nitrogen atom; $L_{21}$ represents a timing group or a group whose bond to $(L_{22})_b—Z$ is cleaved on reacting with an oxidation product of a developing agent; $L_{22}$ represents a timing group or a group whose bond to Z is cleaved on reacting with an oxidation product of a developing agent; Z represents a group which manifests a bleach accelerating effect on the cleaving of its bond to $—(L_{21})_a—(L_{22})_b$; a and b each represents 0 or 1; n represents an integer of from 1 to 3; where n is 2 or more, the plural X or Y groups may be the same or different; $A_1$ and $A_2$ each represents a hydrogen atom or a group removable with an alkali; or any two of P, $X_2$, Y, $Q_2$, $A_1$, and $A_2$ each represents a divalent group which together form a cyclic structure.

5. The silver halide color photographic material of claim 1, wherein the compound capable of releasing a bleaching accelerator is represented by formula (I'):

$$A—(L_{21})_a—(L_{22})_b—Z \quad (I')$$

wherein A represents a group whose bond to $(L_{21})_a—(L_2)_b—Z$ is split on reacting with an oxidation product of a developing agent; $L_{21}$ represents a timing group or a group whose bond to $(L_{22})_b—Z$ is split on reacting with an oxidation product of a developing agent; $L_{22}$ represents a timing group or a group whose bond to Z is split on reacting with an oxidation product of a developing agent; Z represents a group which manifests a bleaching accelerating effect on the splitting of its bond to $A—(L_{21})_a—(L_{22})_b$; and a and b each represents 0 or 1.

6. The silver halide photographic material of claim 5, wherein A in formula (I') is a redox group represented by formula (II):

$$A_1—P—(X_2=Y)_n—Q_2—A_2 \quad (II)$$

wherein P and $Q_2$ each represents an oxygen atom or a substituted or unsubstituted imino group; at least one n $X_2$ and n Y represents a methine group having $—(L_{21})_a—(L_{22})_b—Z$ as a substituent, with the other $X_2$ and Y each representing a substituted or unsubstituted methine group or a nitrogen atom; $L_{21}$ represents a timing group or a group whose bond to $(L_{22})_b—Z$ is cleaved on reacting with an oxidation product of a developing agent; $L_{22}$ represents a timing group or a group whose bond to Z is cleaved on reacting with an oxidation product for a developing agent; Z represents a group which manifests a bleach accelerating effect on the cleaving of its bond to $—(L_{21})_a—(L_{22})_b$; a and b each represents 0 or 1; n represents an integer of from 1 to 3; where n is 2 or more, the plural X or Y groups may be the same or different; $A_1$ and $A_2$ each represents a hydrogen atom or a group removable with an alkali; or any two of P, $X_2$, Y, $Q_2$, $A_1$, and $A_2$ each represents a divalent group which together form a cyclic structure.

7. The silver halide color photographic material of claim 5, wherein Z in formula (I') is represented by formula (XII):

$$*—S—R_{81}—\{(X_{21})_r—R_{82}\}_l—Y_2 \quad (XII)$$
$$(Y_1)_m$$

wherein * indicates the position for bonding to $A—(L_{21})_a—(L_{22})_b—$; $R_{81}$ represents an aliphatic group having from 1 to 8 carbon atoms; $R_{82}$ represents an aliphatic group having from 1 to 8 carbon atoms, a divalent aromatic group having from 6 to 10 carbon atoms, or a 3-to 8-membered divalent heterocyclic group; $X_{21}$ represents —O—, —S—, —COO—, $—SO_2—$, $—N(R_{83})—$, $—N(R_{83})—CO—$, $—N(R_{83})—SO_2—$, —S—CO—, —CO—, $—N(R_{83})—COO—$, $—N=(R_{83})—$, $—N(R_{83})\ CO—N(R_{84})$ —, or $—N(R_{83})SO_2N(R_{84})—$; $Y_1$ represents a carboxyl group or a salt thereof, a sulfo group or a salt thereof, a hydroxyl group, a phospho group or a salt thereof, an unsubstituted amino group, an amino group substituted with an aliphatic group having from 1 to 4 carbon atoms, $—NHSO_2—R_{85}$, or $—SO_2NH—R_{85}$; $Y_2$ has the same meaning as $Y_1$ or represents a hydrogen atom; r represents 0 or 1; l represents 0 or an integer of from 1 to 4; m represents an integer of from 1 to 4; provided that each $Y_1$ is bonded to $R_{81}—\{(X_{21})_r—R_{82}\}_l$ of formula (XII), at a position(s) of $R_{81}—\{(X_{21})_r—R_{82}\}l$ capable of substitution; where m is 2 or more, the plural $Y_1$ groups may be the same or different; where l is 2 or more, the plural groups $(X_{21})_r—R_{82}$ may be the same or different; and $R_{83}$, $R_{84}$, and $R_{85}$ each represents a hydrogen atom or an aliphatic group having from 1 to 8 carbon atoms.

8. The silver halide color photographic material of claim 5, wherein Z in formula (I') is represented by formula (XIII):

$$*—S—X_{22}—\{(X_{21})_r—R_{82}\}_l—Y_2 \quad (XIII)$$
$$(Y_1)_m$$

wherein * represents the position for bonding to $A—(L_{21})_a—(L_{22})_b—$; $x_{22}$ represents an aromatic group having 6 to 10 carbon atoms, at least one carbon atom of which is bonded to S; $R_{82}$ represents an aliphatic group having from 1 to 8 carbon atoms, a divalent aromatic group having from 6 to 10 carbon atoms, or a 3- to 8-membered divalent heterocyclic group; $X_{21}$ represents —O—,—S—, —COO—, $—SO_2—$, $—N(R_{83})—$, $—N(R_{83})—CO—$, $—N(R_{83})—SO_2—$, —S—CO—, —CO—, $—N(R_{83})—COO—$, $—N=(R_{83})—$, $—N(R_{83})CO—N(R_{84})—$, or $—N(R_{83})SO_2N(R_{84})—$; $Y_1$ represents a carboxyl group or a salt thereof, a sulfo group or a salt thereof, a hydroxyl group, a phospho group or a salt thereof, an unsubstituted amino group an amino group substituted with an aliphatic group having from 1 to 4 carbon atoms, $—NHSO_2—R_{85}$, or $—SO_2NH—R_{85}$, $R_{83}$, $R_{84}$, and $R_{85}$ each represents a hydrogen atom or an aliphatic group having from 1 to 8 carbon atoms, $Y_2$ has the same meaning as $Y_1$ or represents a hydrogen atom; r represents 0 or 1; l represents 0 or an integer of from 1 to 4; m represents an integer of from 1 to 4; where m is 2 or more, the plural $Y_1$ groups may be the same or different; where l is 2 or more, the plural groups $(X_{21})_r—R_{82}$ may be the same or different; provided that each $Y_1$ is bonded to $X_2—\{(X_{21})_r—R_{82}\}_l$ of formula (XIII), at a position(s) of $X_{22}—\{(X_{21})r—R_{82}\}_l$ capable of substitution.

9. The silver halide color photographic material of claim 5, wherein Z in formula (I') is represented by formula (XIV):

$$*—S—X_{23}—\{(X_{21})_r—R_{82}\}_{l2}— \quad (XIV)$$
$$(Y_1)_u$$

wherein $Z_{23}$ represents a 3- to 8-membered heterocyclic group containing, in its ring, at least one carbon atom at which it is bonded to S; u represents 0 or an integer of from 1 to 4; provided that each $Y_1$ is bonded to $X_{23}$—{$(X_{21})_r$—$R_{82})_l$ of formula (XIV) at a position(s) $X_{23}$—{$(X_{21})_r$—$R_{82}$}$_l$ capable of substitution; where us is 2 or more, the plural $Y_1$ groups may be the same of different; * indicates the position for bonding to A—$(L_{21})_a$—$(L_{22})_b$—; $R_{81}$ represents an aliphatic group having from 1 to 8 carbon atoms; $R_{82}$ has the same meaning as $R_{81}$ or represents a divalent aromatic group having from 6 to 10 carbon atoms, or a 3- to 8-membered divalent heterocyclic group; $X_{21}$ represents —O—, —S—, —COO—, —$SO_2$—, —N($R_{83}$)—, —N($R_{83}$)—CO—, —N($R_{83}$) —$SO_2$—, —S—CO—, —CO—, —N($R_{83}$)—COO—, —N=($R_{83}$)—, —N($R_{83}$)CO—N($R_{84}$)—, or —N($R_{83}$)$SO_2$N($R_{84}$)—; $Y_1$ represents a carboxyl group or a salt thereof, a sulfo group or a salt thereof, a hydroxyl group, a phospho group or a salt thereof, an unsubstituted amino group, an amino group substituted with an aliphatic group having from 1 to 4 carbon atoms, —$NHSO_2$—$R_{85}$, or —$SO_2NH$—$R_{85}$; $Y_2$ has the same meaning as $Y_1$ or represents a hydrogen atom; r represents 0 or 1; l represents 0 or an integer of from 1 to 4; m represents an integer of from 1 to 4; provided that each $Y_1$ is bonded to $R_{81}$—$(X_{21})_r$—$R_{82})_l$ of formula (XII), at a position(s) of $R_{81}$—{$(X_{21})_r$—$R_{82}$}l capable of substitution; where m is 2 or more, the plural $Y_1$ groups may be the same or different; where l is 2 or more, the plural groups $(X_{21})_r$—$R_{82}$ may be the same or different; $R_{83}$, $R_{84}$, and $R_{85}$ each represents a hydrogen atom or an aliphatic group having from 1 to 8 carbon atoms.

* * * * *